US010603555B2

(12) United States Patent
Beach et al.

(10) Patent No.: US 10,603,555 B2
(45) **Date of Patent: *Mar. 31, 2020**

(54) GOLF CLUB HEAD

(71) Applicant: Taylor Made Golf Company, Inc., Carlsbad, CA (US)

(72) Inventors: Todd P. Beach, Encinitas, CA (US); Matthew David Johnson, Carlsbad, CA (US); Nathan T. Sargent, Oceanside, CA (US); Kraig Alan Willett, Fallbrook, CA (US); Michelle Penney, Carlsbad, CA (US); Marc Kronenberg, Hobe Sound, FL (US); Matthew Greensmith, Vista, CA (US); Joseph Henry Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 21 days.

This patent is subject to a terminal disclaimer.

(21) Appl. No.: 15/614,999

(22) Filed: Jun. 6, 2017

(65) Prior Publication Data

US 2017/0304692 A1 Oct. 26, 2017

Related U.S. Application Data

(63) Continuation of application No. 14/575,745, filed on Dec. 18, 2014, now Pat. No. 9,700,769, which is a (Continued)

(51) Int. Cl.
*A63B 53/06* (2015.01)
*A63B 60/52* (2015.01)
(Continued)

(52) U.S. Cl.
CPC ..... *A63B 53/06* (2013.01); *A63B 53/02* (2013.01); *A63B 53/0466* (2013.01);
(Continued)

(58) Field of Classification Search
CPC ..... A63B 53/06; A63B 53/0466; A63B 60/52; A63B 53/02; A63B 2053/0433;
(Continued)

(56) References Cited

U.S. PATENT DOCUMENTS 411,000 A 9/1889 Anderson
1,133,129 A 3/1915 Govan
(Continued)

FOREIGN PATENT DOCUMENTS

CN 2436182 6/2001
CN 201353407 12/2009
(Continued)

OTHER PUBLICATIONS

Adams Golf Speedline F11 Ti 14.5 degree fairway wood (www.bombsquadgolf.com, posted Oct. 18, 2010).
(Continued)

*Primary Examiner* — Sebastiano Passaniti
(74) *Attorney, Agent, or Firm* — Klarquist Sparkman, LLP

(57) ABSTRACT

A golf club head includes a body defining an interior cavity. The body includes a sole positioned at a bottom portion of the golf club head, a crown positioned at a top portion, and a skirt positioned around a periphery between the sole and crown. The body has a forward portion and a rearward portion. The club head includes a face positioned at the forward portion of the body. The face defines a striking surface having an ideal impact location at a golf club head origin. Embodiments include club heads for a fairway wood that at least one of a high moment of inertia, a low center-
(Continued)

of-gravity, a thin crown and a high coefficient of restitution. A sleeve for easily disconnecting a shaft to the club head allows for selective adjustment of the head's loft and lie angle.

19 Claims, 24 Drawing Sheets

Related U.S. Application Data continuation of application No. 13/975,106, filed on Aug. 23, 2013, now Pat. No. 8,956,240, which is a continuation of application No. 13/873,128, filed on Apr. 29, 2013, now Pat. No. 8,753,222, which is a continuation of application No. 13/469,023, filed on May 10, 2012, now Pat. No. 8,430,763, which is a continuation of application No. 13/338,197, filed on Dec. 27, 2011, now Pat. No. 8,900,069.

(60) Provisional application No. 61/427,772, filed on Dec. 28, 2010.

(51) Int. Cl.
*A63B 53/04* (2015.01)
*A63B 53/02* (2015.01)

(52) U.S. Cl.
CPC ..... *A63B 60/52* (2015.10); *A63B 53/047* (2013.01); *A63B 53/0487* (2013.01); *A63B 2053/023* (2013.01); *A63B 2053/045* (2013.01); *A63B 2053/0408* (2013.01); *A63B 2053/0412* (2013.01); *A63B 2053/0433* (2013.01); *A63B 2053/0491* (2013.01); *A63B 2209/00* (2013.01); *A63B 2209/02* (2013.01)

(58) Field of Classification Search
CPC ..... A63B 2053/0412; A63B 2209/00; A63B 2209/02; A63B 53/047; A63B 2053/045; A63B 53/0487; A63B 2053/023; A63B 2053/0491; A63B 2053/0408
USPC ..... 473/324–350, 287–292
See application file for complete search history.

(56) References Cited

U.S. PATENT DOCUMENTS 1,135,621 A 4/1915 Roberts et al.
1,320,163 A 10/1919 Fitz
1,518,316 A 12/1924 Ellingham
1,526,438 A 2/1925 Scott
1,538,312 A 5/1925 Beat
1,592,463 A 7/1926 Marker
1,658,581 A 2/1928 Tobia
1,697,846 A 1/1929 Anderson
1,704,119 A 3/1929 Buhrke
1,705,997 A 3/1929 Quynn
1,854,548 A 4/1932 Hunt
1,970,409 A 8/1934 Wiedemann
D107,007 S 11/1937 Cashmore
2,214,356 A 9/1940 Wettlaufer
2,225,930 A 12/1940 Sexton
2,257,575 A 9/1941 Reach
2,328,583 A 9/1943 Reach
2,360,364 A 10/1944 Reach
2,375,249 A 5/1945 Richer
2,460,435 A 2/1949 Schaffer
2,652,256 A 9/1953 Thomas
2,681,523 A 6/1954 Sellers
2,691,525 A 10/1954 Callaghan
3,064,980 A 11/1962 Steiner
3,084,940 A 4/1963 Cissel
3,466,047 A 9/1969 Rodia et al.
3,486,755 A 12/1969 Hodge
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,680,868 A 8/1972 Jacob
3,692,306 A 9/1972 Glover
3,743,297 A 7/1973 Dennis
3,810,631 A 5/1974 Braly
3,860,244 A 1/1975 Cosby
3,897,066 A 7/1975 Belmont
3,976,299 A 8/1976 Lawrence et al.
3,979,122 A 9/1976 Belmont
3,979,123 A 9/1976 Belmont
3,997,170 A 12/1976 Goldberg
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,150,702 A 4/1979 Holmes
4,189,976 A 2/1980 Becker
4,214,754 A 7/1980 Zebelean
4,262,562 A 4/1981 MacNeill
D259,698 S 6/1981 MacNeill
4,322,083 A 3/1982 Imai
4,340,229 A 7/1982 Stuff, Jr.
4,398,965 A 8/1983 Campau
4,411,430 A 10/1983 Dian
4,423,874 A 1/1984 Stuff, Jr.
4,438,931 A 3/1984 Motomiya
4,471,961 A 9/1984 Masghati et al.
4,489,945 A 12/1984 Kobayashi
4,530,505 A 7/1985 Stuff
D284,346 S 6/1986 Masters
4,602,787 A 7/1986 Sugioka et al.
4,607,846 A 8/1986 Perkins
4,712,798 A 12/1987 Preato
4,730,830 A 3/1988 Tilley
4,736,093 A 4/1988 Braly
4,754,974 A 7/1988 Kobayashi
4,754,977 A 7/1988 Sahm
4,762,322 A 8/1988 Molitor et al.
4,795,159 A 1/1989 Nagamoto
4,803,023 A 2/1989 Enomoto et al.
4,809,983 A 3/1989 Langert
4,867,457 A 9/1989 Lowe
4,867,458 A 9/1989 Sumikawa et al.
4,869,507 A 9/1989 Sahm
4,890,840 A 1/1990 Kobayashi
4,895,371 A 1/1990 Bushner
4,915,558 A 4/1990 Muller
4,962,932 A 10/1990 Anderson
4,994,515 A 2/1991 Washiyama et al.
5,006,023 A 4/1991 Kaplan
5,020,950 A 6/1991 Ladouceur
5,028,049 A 7/1991 McKeighen
5,039,267 A 8/1991 Wollar
5,042,806 A 8/1991 Helmstetter
5,050,879 A 9/1991 Sun et al.
5,058,895 A 10/1991 Igarashi
5,067,715 A 11/1991 Schmidt et al.
5,076,585 A 12/1991 Bouquet
5,078,400 A 1/1992 Desbiolles et al.
5,121,922 A 6/1992 Harsh, Sr.
5,122,020 A 6/1992 Bedi
5,193,810 A 3/1993 Antonious
5,213,328 A 5/1993 Long et al.
5,219,408 A 6/1993 Sun
5,221,086 A 6/1993 Antonious
5,232,224 A 8/1993 Zeider
5,244,210 A 9/1993 Au
5,251,901 A 10/1993 Solheim et al.
5,253,869 A 10/1993 Dingle et al.
D343,558 S 1/1994 Latraverse et al.

(56) References Cited

U.S. PATENT DOCUMENTS 5,297,794 A 3/1994 Lu
5,301,941 A 4/1994 Allen
5,306,008 A 4/1994 Kinoshita
5,316,305 A 5/1994 McCabe
5,320,005 A 6/1994 Hsiao
5,328,176 A 7/1994 Lo
5,330,187 A 7/1994 Schmidt et al.
5,346,216 A 9/1994 Aizawa
5,346,217 A 9/1994 Tsuchiya et al.
5,385,348 A 1/1995 Wargo
5,395,113 A 3/1995 Antonious
5,410,798 A 5/1995 Lo
5,419,556 A 5/1995 Take
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,449,260 A 9/1995 Whittle
5,451,056 A 9/1995 Manning
5,467,983 A 11/1995 Chen
D365,615 S 12/1995 Shimatani
5,472,201 A 12/1995 Aizawa et al.
5,472,203 A 12/1995 Schmidt et al.
5,480,152 A 1/1996 Schmidt et al.
5,511,786 A 4/1996 Antonious
5,518,243 A 5/1996 Redman
5,533,730 A 7/1996 Ruvang
5,538,245 A 7/1996 Moore
5,564,705 A 10/1996 Kobayashi et al.
5,571,053 A 11/1996 Lane
5,573,467 A 11/1996 Chou et al.
5,582,553 A 12/1996 Ashcraft et al.
5,603,668 A 2/1997 Antonious
5,613,917 A 3/1997 Kobayashi et al.
5,616,088 A 4/1997 Aizawa et al.
5,620,379 A 4/1997 Borys
5,624,331 A 4/1997 Lo et al.
5,629,475 A 5/1997 Chastonay
5,632,694 A 5/1997 Lee
5,658,206 A 8/1997 Antonious
5,669,827 A 9/1997 Nagamoto
5,681,228 A 10/1997 Mikame et al.
5,683,309 A 11/1997 Reimers
5,688,189 A 11/1997 Bland
5,709,613 A 1/1998 Sheraw
5,718,641 A 2/1998 Lin
5,720,674 A 2/1998 Galy
D392,526 S 3/1998 Nicely
5,735,754 A 4/1998 Antonious
5,746,664 A 5/1998 Reynolds, Jr.
5,749,795 A 5/1998 Schmidt et al.
5,755,627 A 5/1998 Yamazaki et al.
5,762,567 A 6/1998 Antonious
5,766,095 A 6/1998 Antonious
5,769,737 A 6/1998 Holladay et al.
5,776,010 A 7/1998 Helmstetter et al.
5,776,011 A 7/1998 Su et al.
5,788,584 A * 8/1998 Parente ..... A63B 53/04
473/290
5,788,587 A 8/1998 Tseng
5,798,587 A 8/1998 Lee
5,803,829 A 9/1998 Hayashi
RE35,955 E 11/1998 Lu
5,851,160 A 12/1998 Rugge et al.
5,873,791 A 2/1999 Allen
5,888,148 A 3/1999 Allen
D409,463 S 5/1999 McMullin
5,908,356 A 6/1999 Nagamoto
5,911,638 A 6/1999 Parente et al.
5,913,735 A 6/1999 Kenmi
5,916,042 A 6/1999 Reimers
5,924,938 A 7/1999 Hines
D412,547 S 8/1999 Fong
5,935,019 A 8/1999 Yamamoto
5,935,020 A 8/1999 Stites et al.
5,941,782 A 8/1999 Cook
5,947,840 A 9/1999 Ryan
5,967,905 A 10/1999 Nakahara et al.
5,971,867 A 10/1999 Galy
5,976,033 A 11/1999 Takeda
5,997,415 A 12/1999 Wood
6,015,354 A 1/2000 Ahn et al.
6,017,177 A 1/2000 Lanham
6,019,686 A 2/2000 Gray
6,023,891 A 2/2000 Robertson et al.
6,032,677 A 3/2000 Blechman et al.
6,033,318 A 3/2000 Drajan, Jr. et al.
6,033,321 A 3/2000 Yamamoto
6,042,486 A 3/2000 Gallagher
6,056,649 A 5/2000 Imai
6,062,988 A 5/2000 Yamamoto
6,074,308 A 6/2000 Domas
6,077,171 A 6/2000 Yoneyama
6,086,485 A 7/2000 Hamada et al.
6,089,994 A 7/2000 Sun
6,120,384 A 9/2000 Drake
6,123,627 A 9/2000 Antonious
6,139,445 A 10/2000 Werner et al.
6,149,533 A 11/2000 Finn
6,162,132 A 12/2000 Yoneyama
6,162,133 A 12/2000 Peterson
6,171,204 B1 1/2001 Starry
6,186,905 B1 2/2001 Kosmatka
6,190,267 B1 2/2001 Marlowe et al.
6,193,614 B1 2/2001 Sasamoto et al.
6,203,448 B1 3/2001 Yamamoto
6,206,789 B1 3/2001 Takeda
6,206,790 B1 3/2001 Kubica et al.
6,210,290 B1 4/2001 Erickson et al.
6,217,461 B1 4/2001 Galy
6,238,303 B1 5/2001 Fite
6,244,974 B1 6/2001 Hanberry, Jr.
6,248,025 B1 6/2001 Murphy et al.
6,254,494 B1 7/2001 Hasebe et al.
6,264,414 B1 7/2001 Hartmann et al.
6,270,422 B1 8/2001 Fisher
6,277,032 B1 8/2001 Smith
6,290,609 B1 9/2001 Takeda
6,296,579 B1 10/2001 Robinson
6,299,546 B1 10/2001 Wang
6,299,547 B1 10/2001 Kosmatka
6,306,048 B1 10/2001 McCabe et al.
6,319,149 B1 11/2001 Lee
6,319,150 B1 11/2001 Werner et al.
6,334,817 B1 1/2002 Ezawa et al.
6,338,683 B1 1/2002 Kosmatka
6,340,337 B2 1/2002 Hasebe et al.
6,344,000 B1 2/2002 Hamada
6,344,001 B1 2/2002 Hamada et al.
6,344,002 B1 2/2002 Kajita
6,348,012 B1 2/2002 Erickson et al.
6,348,013 B1 2/2002 Kosmatka
6,348,014 B1 2/2002 Chiu
6,354,961 B1 3/2002 Allen
6,364,788 B1 4/2002 Helmstetter et al.
6,379,264 B1 4/2002 Forzano
6,379,265 B1 4/2002 Hirakawa et al.
6,383,090 B1 5/2002 O'Doherty et al.
6,386,987 B1 5/2002 Lejeune, Jr.
6,386,990 B1 5/2002 Reyes et al.
6,390,933 B1 5/2002 Galloway
6,409,612 B1 6/2002 Evans et al.
6,422,951 B1 7/2002 Burrows
6,425,832 B2 7/2002 Cackett et al.
6,434,811 B1 8/2002 Helmstetter et al.
6,436,142 B1 8/2002 Paes et al.
6,440,009 B1 8/2002 Guibaud et al.
6,440,010 B1 8/2002 Deshmukh
6,443,851 B1 9/2002 Liberatore
6,447,405 B1 9/2002 Chen
6,458,044 B1 10/2002 Vincent et al.
6,461,249 B2 10/2002 Liberatore
6,471,604 B2 10/2002 Hocknell et al.

(56) References Cited

U.S. PATENT DOCUMENTS 6,475,101 B2 11/2002 Burrows
6,475,102 B2 11/2002 Helmstetter et al.
6,478,692 B2 11/2002 Kosmatka
6,491,592 B2 12/2002 Cackett et al.
6,508,978 B1 1/2003 Deshmukh
6,514,154 B1 2/2003 Finn
6,524,197 B2 2/2003 Boone
6,524,198 B2 2/2003 Takeda
6,527,649 B1 3/2003 Neher et al.
6,530,847 B1 3/2003 Antonious
6,530,848 B2 3/2003 Gillig
6,533,679 B1 3/2003 McCabe et al.
6,547,676 B2 4/2003 Cackett et al.
6,558,273 B2 5/2003 Kobayashi et al.
6,565,448 B2 5/2003 Cameron et al.
6,565,452 B2 5/2003 Helmstetter et al.
6,569,029 B1 5/2003 Hamburger
6,569,040 B2 5/2003 Bradstock
6,572,489 B2 6/2003 Miyamoto et al.
6,575,845 B2 6/2003 Galloway et al.
6,575,854 B1 6/2003 Yang et al.
6,582,323 B2 6/2003 Soracco et al.
6,592,468 B2 7/2003 Vincent et al.
6,602,149 B1 8/2003 Jacobson
6,604,568 B2 8/2003 Bliss et al.
6,605,007 B1 8/2003 Bissonnette et al.
6,607,452 B2 8/2003 Helmstetter et al.
6,612,938 B2 9/2003 Murphy et al.
6,616,547 B2 9/2003 Vincent et al.
6,638,180 B2 10/2003 Tsurumaki
6,638,183 B2 10/2003 Takeda
D482,089 S 11/2003 Burrows
D482,090 S 11/2003 Burrows
D482,420 S 11/2003 Burrows
6,641,487 B1 11/2003 Hamburger
6,641,490 B2 11/2003 Ellemor
6,648,772 B2 11/2003 Vincent et al.
6,648,773 B1 11/2003 Evans
6,652,387 B2 11/2003 Liberatore
D484,208 S 12/2003 Burrows
6,663,506 B2 12/2003 Nishimoto et al.
6,669,571 B1 12/2003 Cameron et al.
6,669,578 B1 12/2003 Evans
6,669,580 B1 12/2003 Cackett et al.
6,676,536 B1 1/2004 Jacobson
6,679,786 B2 1/2004 McCabe
6,695,712 B1 2/2004 Iwata et al.
6,716,111 B2 4/2004 Liberatore
6,716,114 B2 4/2004 Nishio
6,719,510 B2 4/2004 Cobzaru
6,719,641 B2 4/2004 Dabbs et al.
6,739,982 B2 5/2004 Murphy et al.
6,739,983 B2 5/2004 Helmstetter et al.
6,743,118 B1 6/2004 Soracco
6,749,523 B1 6/2004 Forzano
6,757,572 B1 6/2004 Forest
6,758,763 B2 7/2004 Murphy et al.
6,773,360 B2 8/2004 Willett et al.
6,773,361 B1 8/2004 Lee
6,776,726 B2 8/2004 Sano
6,800,038 B2 10/2004 Willett et al.
6,805,643 B1 10/2004 Lin
6,808,460 B2 10/2004 Namiki
6,824,475 B2 11/2004 Burnett et al.
6,835,145 B2 12/2004 Tsurumaki
D501,036 S 1/2005 Burrows
6,855,068 B2 2/2005 Antonious
6,860,818 B2 3/2005 Mahaffey et al.
6,860,823 B2 3/2005 Lee
6,860,824 B2 3/2005 Evans
6,875,124 B2 4/2005 Gilbert et al.
6,875,129 B2 4/2005 Erickson et al.
6,881,158 B2 4/2005 Yang et al.
6,881,159 B2 4/2005 Galloway et al.
6,887,165 B2 5/2005 Tsurumaki
6,890,267 B2 5/2005 Mahaffey et al.
6,904,663 B2 6/2005 Willett et al.
6,923,734 B2 8/2005 Meyer
6,926,619 B2 8/2005 Helmstetter et al.
6,939,247 B1 9/2005 Schweigert et al.
6,960,142 B2 11/2005 Bissonnette et al.
6,964,617 B2 11/2005 Williams
6,969,326 B2 11/2005 De Shiell
6,974,393 B2 12/2005 Caldwell et al.
6,988,960 B2 1/2006 Mahaffey et al.
6,991,558 B2 1/2006 Beach et al.
D515,165 S 2/2006 Zimmerman et al.
6,997,820 B2 2/2006 Willett et al.
7,004,852 B2 2/2006 Billings
7,025,692 B2 4/2006 Erickson et al.
7,029,403 B2 4/2006 Rice et al.
7,077,762 B2 7/2006 Kouno et al.
7,086,964 B2 8/2006 Chen et al.
7,134,971 B2 11/2006 Franklin et al.
7,137,905 B2 11/2006 Kohno
7,137,906 B2 11/2006 Tsunoda et al.
7,140,974 B2 11/2006 Chao et al.
7,147,572 B2 12/2006 Kohno
7,147,573 B2 12/2006 DiMarco
7,153,220 B2 12/2006 Lo
7,163,468 B2 1/2007 Gibbs et al.
7,166,038 B2 1/2007 Williams et al.
7,166,040 B2 1/2007 Hoffman et al.
7,166,041 B2 1/2007 Evans
7,169,060 B2 1/2007 Stevens et al.
7,179,034 B2 2/2007 Ladouceur
7,186,190 B1 3/2007 Beach et al.
7,189,169 B2 3/2007 Billings
7,198,575 B2 4/2007 Beach et al.
7,201,669 B2 4/2007 Stites et al.
7,223,180 B2 5/2007 Willett et al.
7,252,600 B2 8/2007 Murphy et al.
7,255,654 B2 8/2007 Murphy et al.
7,267,620 B2 9/2007 Chao et al.
7,273,423 B2 9/2007 Imamoto
7,278,926 B2 10/2007 Frame
7,278,927 B2 10/2007 Gibbs et al.
7,294,064 B2 11/2007 Tsurumaki et al.
7,294,065 B2 11/2007 Liang et al.
7,351,161 B2 4/2008 Beach
7,377,860 B2 5/2008 Breier et al.
7,396,293 B2 7/2008 Soracco
7,407,447 B2 8/2008 Beach et al.
7,419,441 B2 9/2008 Hoffman et al.
7,445,563 B1 11/2008 Werner
7,448,963 B2 11/2008 Beach et al.
D588,223 S 3/2009 Kuan
7,500,924 B2 3/2009 Yokota
7,520,820 B2 4/2009 Dimarco
7,530,901 B2 5/2009 Imamoto et al.
7,530,903 B2 5/2009 Imamoto et al.
7,530,904 B2 5/2009 Beach et al.
7,540,811 B2 6/2009 Beach et al.
7,563,175 B2 7/2009 Nishitani et al.
7,568,985 B2 8/2009 Beach et al.
7,572,193 B2 8/2009 Yokota
7,578,753 B2 8/2009 Beach et al.
7,582,024 B2 9/2009 Shear
7,585,233 B2 9/2009 Horacek
7,591,737 B2 9/2009 Gibbs et al.
7,591,738 B2 9/2009 Beach et al.
7,621,823 B2 11/2009 Beach et al.
7,628,707 B2 12/2009 Beach et al.
7,632,193 B2 12/2009 Thielen
7,632,194 B2 12/2009 Beach et al.
7,632,196 B2 12/2009 Reed et al.
7,641,569 B2 1/2010 Best et al.
D612,440 S 3/2010 Oldknow
7,670,235 B2 3/2010 Lo
7,674,189 B2 3/2010 Beach et al.
7,682,264 B2 3/2010 Hsu et al.
7,717,803 B2 5/2010 DiMarco
7,744,484 B1 6/2010 Chao
7,749,101 B2 7/2010 Imamoto et al.

(56) References Cited

U.S. PATENT DOCUMENTS

| | | | |
|---|---|---|---|
| 7,753,806 | B2 | 7/2010 | Beach et al. |
| 7,758,451 | B2 | 7/2010 | Liang et al. |
| 7,771,291 | B1 | 8/2010 | Willett et al. |
| 7,798,914 | B2 | 9/2010 | Noble et al. |
| 7,824,277 | B2 | 11/2010 | Bennett et al. |
| 7,857,711 | B2 | 12/2010 | Shear |
| 7,857,713 | B2 | 12/2010 | Yokota |
| 7,867,105 | B2 | 1/2011 | Moon |
| 7,887,431 | B2 | 2/2011 | Beach et al. |
| 7,887,434 | B2 | 2/2011 | Beach et al. |
| 7,896,753 | B2 | 3/2011 | Boyd et al. |
| 7,914,393 | B2 | 3/2011 | Hirsch et al. |
| 7,946,931 | B2 | 5/2011 | Oyama |
| 7,988,565 | B2 | 8/2011 | Abe |
| 8,012,038 | B1 | 9/2011 | Beach et al. |
| 8,012,039 | B2 | 9/2011 | Greaney et al. |
| 8,016,694 | B2 | 9/2011 | Llewellyn et al. |
| 8,025,587 | B2 | 9/2011 | Beach et al. |
| 8,083,609 | B2 | 12/2011 | Burnett et al. |
| 8,088,021 | B2 | 1/2012 | Albertsen et al. |
| 8,105,175 | B2 | 1/2012 | Breier et al. |
| 8,118,689 | B2 | 2/2012 | Beach et al. |
| 8,147,350 | B2 | 4/2012 | Beach et al. |
| 8,157,672 | B2 | 4/2012 | Greaney et al. |
| 8,167,737 | B2 | 5/2012 | Oyama |
| 8,177,661 | B2 | 5/2012 | Beach et al. |
| 8,182,364 | B2 | 5/2012 | Cole et al. |
| 8,197,358 | B1 | 6/2012 | Watson |
| 8,206,244 | B2 | 6/2012 | Honea et al. |
| 8,235,831 | B2 | 8/2012 | Beach et al. |
| 8,235,841 | B2 | 8/2012 | Stites et al. |
| 8,235,844 | B2 | 8/2012 | Albertsen et al. |
| 8,241,143 | B2 | 8/2012 | Albertsen et al. |
| 8,241,144 | B2 | 8/2012 | Albertsen et al. |
| 8,257,195 | B1 | 9/2012 | Erickson |
| 8,257,196 | B1 | 9/2012 | Abbott et al. |
| 8,262,498 | B2 | 9/2012 | Beach et al. |
| 8,277,337 | B2 | 10/2012 | Shimazaki |
| 8,292,756 | B2 | 10/2012 | Greaney et al. |
| 8,303,431 | B2 | 11/2012 | Beach et al. |
| 8,328,659 | B2 | 12/2012 | Shear |
| 8,337,319 | B2 | 12/2012 | Sargent et al. |
| 8,353,786 | B2 | 1/2013 | Beach et al. |
| D675,692 | S | 2/2013 | Oldknow et al. |
| D678,964 | S | 3/2013 | Oldknow et al. |
| D678,965 | S | 3/2013 | Oldknow et al. |
| D678,968 | S | 3/2013 | Oldknow et al. |
| D678,969 | S | 3/2013 | Oldknow et al. |
| D678,970 | S | 3/2013 | Oldknow et al. |
| D678,971 | S | 3/2013 | Oldknow et al. |
| D678,972 | S | 3/2013 | Oldknow et al. |
| D678,973 | S | 3/2013 | Oldknow et al. |
| 8,398,503 | B2 | 3/2013 | Beach et al. |
| 8,403,771 | B1 | 3/2013 | Rice et al. |
| D679,354 | S | 4/2013 | Oldknow et al. |
| 8,430,763 | B2 | 4/2013 | Beach et al. |
| 8,435,134 | B2 | 5/2013 | Tang et al. |
| 8,496,541 | B2 | 7/2013 | Beach et al. |
| 8,496,544 | B2 | 7/2013 | Curtis et al. |
| 8,517,855 | B2 | 8/2013 | Beach et al. |
| 8,517,860 | B2 | 8/2013 | Albertsen et al. |
| 8,529,368 | B2 | 9/2013 | Rice et al. |
| 8,562,453 | B2 | 10/2013 | Sato |
| 8,579,728 | B2 | 11/2013 | Morales et al. |
| 8,591,351 | B2 | 11/2013 | Albertsen et al. |
| 8,602,907 | B2 | 12/2013 | Beach et al. |
| 8,616,999 | B2 | 12/2013 | Greaney et al. |
| D697,152 | S | 1/2014 | Harbert et al. |
| 8,622,847 | B2 | 1/2014 | Beach et al. |
| 8,628,433 | B2 | 1/2014 | Stites et al. |
| 8,632,419 | B2 | 1/2014 | Tang et al. |
| 8,641,555 | B2 | 2/2014 | Stites et al. |
| 8,663,029 | B2 | 3/2014 | Beach et al. |
| 8,678,949 | B2 | 3/2014 | Shimazaki |
| 8,690,704 | B2 | 4/2014 | Thomas |
| 8,695,487 | B2 | 4/2014 | Sakane et al. |
| 8,696,487 | B2 | 4/2014 | Beach et al. |
| 8,696,491 | B1 | 4/2014 | Myers |
| 8,702,531 | B2 | 4/2014 | Boyd et al. |
| 8,721,471 | B2 | 5/2014 | Albertsen et al. |
| 8,727,900 | B2 | 5/2014 | Beach et al. |
| D707,768 | S | 6/2014 | Oldknow et al. |
| D707,769 | S | 6/2014 | Oldknow et al. |
| D707,773 | S | 6/2014 | Oldknow et al. |
| 8,753,222 | B2 | 6/2014 | Beach et al. |
| 8,753,226 | B2 | 6/2014 | Rice et al. |
| 8,758,153 | B2 | 6/2014 | Sargent et al. |
| D708,281 | S | 7/2014 | Oldknow et al. |
| 8,790,195 | B1 | 7/2014 | Myers et al. |
| 8,821,312 | B2 | 9/2014 | Burnett et al. |
| 8,827,831 | B2 | 9/2014 | Burnett et al. |
| 8,834,289 | B2 | 9/2014 | de la Cruz et al. |
| 8,834,290 | B2 | 9/2014 | Bezilla et al. |
| 8,834,293 | B2 | 9/2014 | Thomas et al. |
| 8,845,450 | B2 | 9/2014 | Beach et al. |
| 8,845,454 | B2 | 9/2014 | Boyd et al. |
| D714,893 | S | 10/2014 | Atwell |
| 8,876,622 | B2 | 11/2014 | Beach et al. |
| 8,876,627 | B2 | 11/2014 | Beach et al. |
| 8,888,607 | B2 | 11/2014 | Beach et al. |
| 8,900,069 | B2 | 12/2014 | Beach et al. |
| D722,122 | S | 2/2015 | Greensmith |
| 8,956,240 | B2 | 2/2015 | Beach et al. |
| 8,956,244 | B1 | 2/2015 | Westrum et al. |
| 8,986,133 | B2 | 3/2015 | Bennett et al. |
| 9,033,821 | B2 | 5/2015 | Beach et al. |
| 9,101,811 | B1 | 8/2015 | Goudarzi et al. |
| 9,180,348 | B2 * | 11/2015 | Beach ..... A63B 53/0466 |
| 9,180,349 | B1 | 11/2015 | Seluga et al. |
| 9,186,560 | B2 | 11/2015 | Harbert |
| 9,205,312 | B2 | 12/2015 | Zimmerman et al. |
| 9,211,447 | B2 | 12/2015 | Harbert |
| 9,220,953 | B2 | 12/2015 | Beach |
| 9,295,885 | B2 | 3/2016 | Matsunaga et al. |
| 9,403,069 | B2 | 8/2016 | Boyd et al. |
| 9,486,677 | B1 | 11/2016 | Seluga et al. |
| 9,498,688 | B2 | 11/2016 | Galvan |
| 9,597,558 | B1 | 3/2017 | Seluga et al. |
| 9,597,561 | B1 | 3/2017 | Seluga et al. |
| 9,623,291 | B2 | 4/2017 | Greensmith et al. |
| 9,636,552 | B2 | 5/2017 | Cleghorn et al. |
| 9,662,545 | B2 * | 5/2017 | Beach ..... A63B 60/52 |
| 9,687,701 | B1 | 6/2017 | Seluga et al. |
| 9,687,702 | B1 | 6/2017 | Seluga et al. |
| 9,694,257 | B1 | 7/2017 | Seluga et al. |
| 9,700,763 | B2 * | 7/2017 | Harbert ..... A63B 53/04 |
| 9,700,769 | B2 * | 7/2017 | Beach ..... A63B 53/0466 |
| 9,707,457 | B2 | 7/2017 | Mata et al. |
| 9,717,962 | B1 | 8/2017 | Seluga et al. |
| 9,776,058 | B2 | 10/2017 | Seluga et al. |
| 9,795,840 | B2 | 10/2017 | Greensmith et al. |
| 9,814,954 | B2 | 11/2017 | Westrum et al. |
| 9,855,476 | B2 | 1/2018 | Seluga et al. |
| 9,901,794 | B2 | 2/2018 | Beno et al. |
| 9,908,017 | B2 | 3/2018 | Seluga et al. |
| 9,914,030 | B2 | 3/2018 | Cleghorn et al. |
| 9,931,549 | B1 | 4/2018 | Seluga et al. |
| 10,076,688 | B1 * | 9/2018 | Harbert ..... A63B 53/0466 |
| 10,183,202 | B1 * | 1/2019 | Harbert ..... A63B 53/0466 |
| 2001/0049310 | A1 | 12/2001 | Cheng et al. |
| 2002/0022535 | A1 | 2/2002 | Takeda |
| 2002/0025861 | A1 | 2/2002 | Ezawa |
| 2002/0032075 | A1 | 3/2002 | Vatsvog |
| 2002/0055396 | A1 | 5/2002 | Nishimoto et al. |
| 2002/0072434 | A1 | 6/2002 | Yabu |
| 2002/0123394 | A1 | 9/2002 | Tsurumaki |
| 2002/0137576 | A1 | 9/2002 | Dammen |
| 2002/0160854 | A1 | 10/2002 | Beach et al. |
| 2002/0169036 | A1 | 11/2002 | Boone |
| 2002/0183134 | A1 | 12/2002 | Allen et al. |
| 2003/0013545 | A1 | 1/2003 | Vincent et al. |
| 2003/0032500 | A1 | 2/2003 | Nakahara et al. |
| 2003/0036442 | A1 | 2/2003 | Chao et al. |
| 2003/0130059 | A1 | 7/2003 | Billings |

(56) References Cited

U.S. PATENT DOCUMENTS

| | | | |
|---|---|---|---|
| 2004/0023729 | A1 | 2/2004 | Nagai et al. |
| 2004/0087388 | A1 | 5/2004 | Beach et al. |
| 2004/0121852 | A1 | 6/2004 | Tsurumaki |
| 2004/0157678 | A1 | 8/2004 | Kohno |
| 2004/0176180 | A1 | 9/2004 | Yamaguchi et al. |
| 2004/0176183 | A1 | 9/2004 | Tsurumaki |
| 2004/0180730 | A1 | 9/2004 | Franklin et al. |
| 2004/0192463 | A1 | 9/2004 | Tsurumaki et al. |
| 2004/0235584 | A1 | 11/2004 | Chao et al. |
| 2004/0242343 | A1 | 12/2004 | Chao |
| 2005/0049075 | A1 | 3/2005 | Chen et al. |
| 2005/0070371 | A1 | 3/2005 | Chen et al. |
| 2005/0096151 | A1 | 5/2005 | Hou et al. |
| 2005/0101404 | A1 | 5/2005 | Long et al. |
| 2005/0124435 | A1 | 6/2005 | Gambetta et al. |
| 2005/0137024 | A1 | 6/2005 | Stites et al. |
| 2005/0181884 | A1 | 8/2005 | Beach et al. |
| 2005/0227781 | A1 | 10/2005 | Huang et al. |
| 2005/0239575 | A1 | 10/2005 | Chao et al. |
| 2005/0239576 | A1 | 10/2005 | Stites et al. |
| 2005/0266933 | A1 | 12/2005 | Galloway |
| 2006/0035722 | A1 | 2/2006 | Beach et al. |
| 2006/0058112 | A1 | 3/2006 | Haralason et al. |
| 2006/0068932 | A1 | 3/2006 | Rice et al. |
| 2006/0073910 | A1 | 4/2006 | Imamoto et al. |
| 2006/0084525 | A1 | 4/2006 | Imamoto et al. |
| 2006/0122004 | A1 | 6/2006 | Chen et al. |
| 2006/0154747 | A1 | 7/2006 | Beach et al. |
| 2006/0172821 | A1 | 8/2006 | Evans |
| 2006/0189407 | A1 | 8/2006 | Soracco |
| 2006/0240908 | A1 | 10/2006 | Adams et al. |
| 2007/0021234 | A1 | 1/2007 | Tsurumaki et al. |
| 2007/0026961 | A1 | 2/2007 | Hou |
| 2007/0049400 | A1 | 3/2007 | Imamoto et al. |
| 2007/0049415 | A1 | 3/2007 | Shear |
| 2007/0049417 | A1 | 3/2007 | Shear |
| 2007/0105646 | A1 | 5/2007 | Beach et al. |
| 2007/0105647 | A1 | 5/2007 | Beach et al. |
| 2007/0105648 | A1 | 5/2007 | Beach et al. |
| 2007/0105649 | A1 | 5/2007 | Beach et al. |
| 2007/0105650 | A1 | 5/2007 | Beach et al. |
| 2007/0105651 | A1 | 5/2007 | Beach et al. |
| 2007/0105652 | A1 | 5/2007 | Beach et al. |
| 2007/0105653 | A1 | 5/2007 | Beach et al. |
| 2007/0105654 | A1 | 5/2007 | Beach et al. |
| 2007/0105655 | A1 | 5/2007 | Beach et al. |
| 2007/0117648 | A1 | 5/2007 | Yokota |
| 2007/0117652 | A1 | 5/2007 | Beach et al. |
| 2008/0020861 | A1 | 1/2008 | Adams et al. |
| 2008/0146370 | A1 | 6/2008 | Beach et al. |
| 2008/0161127 | A1 | 7/2008 | Yamamoto |
| 2008/0261715 | A1 | 10/2008 | Carter |
| 2008/0261717 | A1 | 10/2008 | Hoffman et al. |
| 2008/0280698 | A1 | 11/2008 | Hoffman et al. |
| 2009/0062029 | A1 | 3/2009 | Stites et al. |
| 2009/0088269 | A1 | 4/2009 | Beach et al. |
| 2009/0088271 | A1 | 4/2009 | Beach et al. |
| 2009/0137338 | A1 | 5/2009 | Kajita |
| 2009/0170632 | A1 | 7/2009 | Beach et al. |
| 2009/0264214 | A1 | 10/2009 | De La Cruz et al. |
| 2009/0286611 | A1 | 11/2009 | Beach et al. |
| 2009/0286618 | A1 | 11/2009 | Beach et al. |
| 2009/0318245 | A1 | 12/2009 | Yim et al. |
| 2010/0016095 | A1 | 1/2010 | Burnett et al. |
| 2010/0029404 | A1 | 2/2010 | Shear |
| 2010/0029408 | A1 | 2/2010 | Abe |
| 2010/0035701 | A1 | 2/2010 | Kusumoto |
| 2010/0048316 | A1 | 2/2010 | Honea et al. |
| 2010/0048321 | A1 | 2/2010 | Beach et al. |
| 2010/0075774 | A1 | 3/2010 | Ban |
| 2010/0113176 | A1 | 5/2010 | Boyd et al. |
| 2010/0144461 | A1 | 6/2010 | Ban |
| 2010/0167837 | A1 | 7/2010 | Ban |
| 2010/0197423 | A1 | 8/2010 | Thomas et al. |
| 2010/0197426 | A1 | 8/2010 | De La Cruz et al. |
| 2010/0234127 | A1 | 9/2010 | Snyder et al. |
| 2010/0331103 | A1 | 12/2010 | Takahashi et al. |
| 2011/0021284 | A1 | 1/2011 | Stites et al. |
| 2011/0098127 | A1 | 4/2011 | Yamamoto |
| 2011/0151989 | A1 | 6/2011 | Golden et al. |
| 2011/0151997 | A1 | 6/2011 | Shear |
| 2011/0195798 | A1 | 8/2011 | Sander et al. |
| 2011/0218053 | A1 | 9/2011 | Tang et al. |
| 2011/0294599 | A1 | 12/2011 | Albertsen et al. |
| 2012/0083362 | A1 | 4/2012 | Albertsen et al. |
| 2012/0083363 | A1 | 4/2012 | Albertsen et al. |
| 2012/0122601 | A1 | 5/2012 | Beach et al. |
| 2012/0142452 | A1 | 6/2012 | Burnett et al. |
| 2012/0149491 | A1 | 6/2012 | Beach et al. |
| 2012/0165110 | A1 | 6/2012 | Cheng |
| 2012/0165111 | A1 | 6/2012 | Cheng |
| 2012/0196701 | A1 | 8/2012 | Stites et al. |
| 2012/0202615 | A1 | 8/2012 | Beach et al. |
| 2012/0220387 | A1 | 8/2012 | Beach et al. |
| 2012/0244960 | A1 | 9/2012 | Tang et al. |
| 2012/0270676 | A1 | 10/2012 | Burnett et al. |
| 2012/0277029 | A1 | 11/2012 | Albertsen et al. |
| 2012/0277030 | A1 | 11/2012 | Albertsen et al. |
| 2012/0289361 | A1 | 11/2012 | Beach et al. |
| 2012/0302366 | A1 | 11/2012 | Murphy |
| 2013/0065705 | A1 | 3/2013 | Morales et al. |
| 2013/0102410 | A1 | 4/2013 | Stites et al. |
| 2013/0165254 | A1 | 6/2013 | Rice et al. |
| 2013/0210542 | A1 | 8/2013 | Harbert et al. |
| 2013/0324284 | A1 | 12/2013 | Stites et al. |
| 2014/0080629 | A1 | 3/2014 | Sargent et al. |
| 2015/0011328 | A1 | 1/2015 | Harbert et al. |
| 2015/0065265 | A1 | 3/2015 | Motokawa et al. |
| 2015/0105177 | A1 | 4/2015 | Beach et al. |
| 2015/0217167 | A1 | 8/2015 | Frame et al. |
| 2015/0231453 | A1 | 8/2015 | Harbert et al. |
| 2015/0297961 | A1 | 10/2015 | Voshall |
| 2015/0306475 | A1 | 10/2015 | Curtis et al. |
| 2016/0023060 | A1 | 1/2016 | Harbert et al. |
| 2016/0250525 | A1 | 9/2016 | Motokawa et al. |
| 2016/0271464 | A1 | 9/2016 | Murphy et al. |

FOREIGN PATENT DOCUMENTS

| | | | |
|---|---|---|---|
| DE | 9012884 | | 9/1990 |
| EP | 0470488 | B1 | 3/1995 |
| EP | 0617987 | B1 | 11/1997 |
| EP | 1001175 | A2 | 5/2000 |
| EP | 2377586 | A2 | 10/2011 |
| GB | 194823 | | 12/1921 |
| JP | 57-157374 | | 10/1982 |
| JP | 4180778 | | 6/1992 |
| JP | 05-317465 | | 12/1993 |
| JP | 06-126004 | | 5/1994 |
| JP | 6190088 | A | 7/1994 |
| JP | 06-238022 | | 8/1994 |
| JP | 6-304271 | | 11/1994 |
| JP | 09-028844 | | 2/1997 |
| JP | 03035480 | U | 3/1997 |
| JP | 09-308717 | | 12/1997 |
| JP | 09-327534 | | 12/1997 |
| JP | 10-234902 | | 8/1998 |
| JP | 10-277187 | | 10/1998 |
| JP | 11114102 | A | 10/1998 |
| JP | 2000014841 | | 1/2000 |
| JP | 2000197718 | A | 7/2000 |
| JP | 2001054595 | | 2/2001 |
| JP | 2001-129130 | | 5/2001 |
| JP | 2001170225 | | 6/2001 |
| JP | 2001204856 | | 7/2001 |
| JP | 2001346918 | | 12/2001 |
| JP | 2002003969 | | 1/2002 |
| JP | 2002017910 | | 1/2002 |
| JP | 2002052099 | | 2/2002 |
| JP | 2002248183 | | 9/2002 |
| JP | 2002253706 | | 9/2002 |
| JP | 2003038691 | | 2/2003 |
| JP | 2003093554 | A | 4/2003 |
| JP | 2003126311 | | 5/2003 |

(56) References Cited

FOREIGN PATENT DOCUMENTS

| | | | |
|---|---|---|---|
| JP | 2003226952 | | 8/2003 |
| JP | 2004174224 | | 6/2004 |
| JP | 2004183058 | | 7/2004 |
| JP | 2004222911 | | 8/2004 |
| JP | 2004-261451 | | 9/2004 |
| JP | 2004267438 | | 9/2004 |
| JP | 2004313762 | A | 11/2004 |
| JP | 2004351054 | A | 12/2004 |
| JP | 2004351173 | A | 12/2004 |
| JP | 2005028170 | | 2/2005 |
| JP | 05-296582 | | 10/2005 |
| JP | 2005-296458 | | 10/2005 |
| JP | 05-323978 | | 11/2005 |
| JP | 2006231063 | A | 9/2006 |
| JP | 2006-320493 | | 11/2006 |
| JP | 2008515560 | A | 5/2008 |
| JP | 4128970 | | 7/2008 |
| JP | 2008200118 | A | 9/2008 |
| JP | 2009000281 | | 1/2009 |
| JP | 2010279847 | A | 12/2010 |
| JP | 2011024999 | A | 2/2011 |
| WO | WO88/02642 | | 4/1988 |
| WO | WO1999/020358 | A1 | 4/1999 |
| WO | WO2001/049376 | A1 | 7/2001 |
| WO | WO01/66199 | | 9/2001 |
| WO | WO02/062501 | | 8/2002 |
| WO | WO03/061773 | | 7/2003 |
| WO | WO2004/043549 | | 5/2004 |
| WO | WO2006/044631 | | 4/2006 |
| WO | WO2014/070343 | A1 | 5/2014 |

OTHER PUBLICATIONS

Callaway Golf, World's Straightest Driver: FT-i Driver downloaded from www.callawaygolf.com/ft%2Di/driver.aspx?lang=en on Apr. 5, 2007.

Declaration of Tim Reed, VP of R&D, Adams Golf, Inc., dated Dec. 7, 2012.

Jackson, Jeff, The Modern Guide to Golf Clubmaking, Ohio: Dynacraft Golf Products, Inc., copyright 1994, p. 237.

Nike Golf, Sasquatch 460, downloaded from www.nike.com/nikegolf/index.htm on Apr. 5, 2007.

Nike Golf, Sasquatch Sumo Squared Driver, downloaded from www.nike.com/nikegolf/index.htm on Apr. 5, 2007.

Office action from the Japanese Patent Office in Patent Application No. 2008264880, dated Nov. 21, 2012.

Office action from the U.S. Patent and Trademark Office in U.S. Appl. No. 12/781,727, dated Aug. 5, 2010.

Office action from the U.S. Patent and Trademark Office in U.S. Appl. No. 13/338,197, dated Jun. 5, 2014.

Office action from the U.S. Patent and Trademark Office in U.S. Appl. No. 13/401,690, dated May 23, 2012.

Office action from the U.S. Patent and Trademark Office in U.S. Appl. No. 13/401,690, dated Feb. 6, 2013.

Office action from the U.S. Patent and Trademark Office in U.S. Appl. No. 13/469,023, dated Jul. 31, 2012.

Office action from the U.S. Patent and Trademark Office in U.S. Appl. No. 13/469,031, dated Oct. 9, 2014.

Office action from the U.S. Patent and Trademark Office in U.S. Appl. No. 13/469,031, dated May 20, 2015. (copy attached).

Office action from the U.S. Patent and Trademark Office in U.S. Appl. No. 13/975,106, dated Feb. 24, 2014.

Office action from the U.S. Patent and Trademark Office in U.S. Appl. No. 13/828,675, dated Jun. 30, 2014.

Office action from the U.S. Patent and Trademark Office in U.S. Appl. No. 14/495,795, dated Jun. 15, 2015. (copy attached).

Office action from the U.S. Patent and Trademark Office in U.S. Appl. No. 14/701,476, dated Jun. 15, 2015. (copy attached).

Taylor Made Golf Company, Inc. Press Release, Burner Fairway Wood, www.tmag.com/media/pressreleases/2007/011807_burner_fairway_rescue.html, Jan. 26, 2007.

Taylor Made Golf Company Inc., R7 460 Drivers, downloaded from www.taylormadegolf.com/product detail.asp?pID=14section=overview on Apr. 5, 2007.

Titleist 907D1, downloaded from www.tees2greens.com/forum/Uploads/Images/7ade3521-192b-4611-870b-395d.jpg on Feb. 1, 2007.

* cited by examiner

GOLF CLUB HEAD

CROSS REFERENCE TO RELATED APPLICATIONS

This application is a continuation of U.S. patent application Ser. No. 14/575,745, filed Dec. 18, 2014, which is a continuation of U.S. patent application Ser. No. 13/975,106, filed Aug. 23, 2013, now U.S. Pat. No. 8,956,240, issued Feb. 17, 2015, which is a continuation of U.S. patent application Ser. No. 13/873,128, filed Apr. 29, 2013, now U.S. Pat. No. 8,753,222, issued Jun. 17, 2014, which is a continuation of U.S. patent application Ser. No. 13/469,023, filed May 10, 2012, now U.S. Pat. No. 8,430,763, issued Apr. 30, 2013, which is a continuation of U.S. patent application Ser. No. 13/338,197, filed Dec. 27, 2011, now U.S. Pat. No. 8,900,069, issued Dec. 2, 2014, which claims the benefit of U.S. Provisional Patent Application No. 61/427,772, filed Dec. 28, 2010, all of which are incorporated herein by reference.

FIELD

The present application concerns golf club heads, and more particularly, golf club heads having unique relationships between the club head's mass moments of inertia and center-of-gravity position, golf club heads having a center of gravity projection that is near the center of the face of the golf club, golf club heads having unique relationships between loft and center of gravity projection location, and golf club heads having increased striking face flexibility.

INCORPORATIONS BY REFERENCE

Other patents and patent applications concerning golf clubs, such as U.S. Pat. Nos. 7,407,447, 7,419,441, 7,513,296, and 7,753,806; U.S. Pat. Appl. Pub. Nos. 2004/0235584, 2005/0239575, 2010/0197424, and 2011/0312347; U.S. patent application Ser. Nos. 11/642,310, and 11/648,013; and U.S. Provisional Pat. Appl. Ser. Nos. 60/877,336 are incorporated herein by reference in their entireties.

BACKGROUND

Center-of-gravity (CG) and mass moments of inertia critically affect a golf club head's performance, such as launch angle and flight trajectory on impact with a golf ball, among other characteristics.

A mass moment of inertia is a measure of a club head's resistance to twisting about the golf club head's center-of-gravity, for example on impact with a golf ball. In general, a moment of inertia of a mass about a given axis is proportional to the square of the distance of the mass away from the axis. In other words, increasing distance of a mass from a given axis results in an increased moment of inertia of the mass about that axis. Higher golf club head moments of inertia result in lower golf club head rotation on impact with a golf ball, particularly on "off-center" impacts with a golf ball, e.g., mis-hits. Lower rotation in response to a mis-hit results in a player's perception that the club head is forgiving. Generally, one measure of "forgiveness" can be defined as the ability of a golf club head to reduce the effects of mis-hits on flight trajectory and shot distance, e.g., hits resulting from striking the golf ball at a less than ideal impact location on the golf club head. Greater forgiveness of the golf club head generally equates to a higher probability of hitting a straight golf shot. Moreover, higher moments of inertia typically result in greater ball speed on impact with the golf club head, which can translate to increased golf shot distance.

Most fairway wood club heads are intended to hit the ball directly from the ground, e.g., the fairway, although many golfers also use fairway woods to hit a ball from a tee. Accordingly, fairway woods are subject to certain design constraints to maintain playability. For example, compared to typical drivers, which are usually designed to hit balls from a tee, fairway woods often have a relatively shallow head height, providing a relatively lower center of gravity and a smaller top view profile for reducing contact with the ground. Such fairway woods inspire confidence in golfers for hitting from the ground. Also, fairway woods typically have a higher loft than most drivers, although some drivers and fairway woods share similar lofts. For example, most fairway woods have a loft greater than or equal to about 13 degrees, and most drivers have a loft between about 7 degrees and about 15 degrees.

Faced with constraints such as those just described, golf club manufacturers often must choose to improve one performance characteristic at the expense of another. For example, some conventional golf club heads offer increased moments of inertia to promote forgiveness while at the same time incurring a higher than desired CG-position and increased club head height. Club heads with high CG and/or large height might perform well when striking a ball positioned on a tee, such is the case with a driver, but not when hitting from the turf. Thus, conventional golf club heads that offer increased moments of inertia for forgiveness often do not perform well as a fairway wood club head.

Although traditional fairway wood club heads generally have a low CG relative to most traditional drivers, such clubs usually also suffer from correspondingly low mass moments of inertia. In part due to their relatively low CG, traditional fairway wood club heads offer acceptable launch angle and flight trajectory when the club head strikes the ball at or near the ideal impact location on the ball striking face. But because of their low mass moments of inertia, traditional fairway wood club heads are less forgiving than club heads with high moments of inertia, which heretofore have been drivers. As already noted, conventional golf club heads that have increased mass moments of inertia, and thus are more forgiving, have been ill-suited for use as fairway woods because of their relatively high CG.

Accordingly, to date, golf club designers and manufacturers have not offered golf club heads with high moments of inertia for improved forgiveness and low center-of-gravity for playing a ball positioned on turf.

Additionally, due to the nature of fairway wood shots, most such shots are impacted below the center of the face. For traditionally designed fairway woods, this means that ballspeed and ball launch parameters are less than ideal. A continual challenge to improving performance in fairway woods and hybrid clubs is the limitation in generating ballspeed. In addition to the center of gravity and center of gravity projection, the geometry of the face and clubhead play a major role in determining initial ball velocity.

SUMMARY

This application discloses, among other innovations, fairway wood-type golf club heads that provide improved forgiveness, ballspeed, and playability while maintaining durability.

The following describes golf club heads that include a body defining an interior cavity, a sole portion positioned at a bottom portion of the golf club head, a crown portion positioned at a top portion, and a skirt portion positioned around a periphery between the sole and crown. The body also has a forward portion and a rearward portion and a maximum above ground height.

Golf club heads according to a first aspect have a body height less than about 46 mm and a crown thickness less than about 0.65 mm throughout more than about 70% of the crown. The above ground center-of-gravity location, Zup, is less than about 19 mm and a moment of inertia about a center-of-gravity z-axis, $I_{zz}$, is greater than about 300 kg-mm$^2$.

Some club heads according to the first aspect provide an above ground center-of-gravity location, Zup, less than about 16 mm. Some have a loft angle greater than about 13 degrees. A moment of inertia about a golf club head center-of-gravity x-axis, $I_{xx}$, can be greater than about 170 kg-mm$^2$. A golf club head volume can be less than about 240 cm$^3$. A front to back depth ($D_{ch}$) of the club head can be greater than about 85 mm.

Golf club heads according to a second aspect have a body height less than about 46 mm and the face has a loft angle greater than about 13 degrees. An above ground center-of-gravity location, Zup, is less than about 19 mm, and satisfies, together with a moment of inertia about a center-of-gravity z-axis, $I_{zz}$, the relationship $I_{zz} \geq 13 \cdot Zup + 105$.

According to the second aspect, the above ground center-of-gravity location, Zup, can be less than about 16 mm. The volume of the golf club head can be less than about 240 cm$^3$. A front to back depth ($D_{ch}$) of the club head can be greater than about 85 mm. The crown can have a thickness less than about 0.65 mm over at least about 70% of the crown.

According to a third aspect, the crown has a thickness less than about 0.65 mm for at least about 70% of the crown, the golf club head has a front to back depth ($D_{ch}$) greater than about 85 mm, and an above ground center-of-gravity location, Zup, is less than about 19 mm. A moment of inertia about a center-of-gravity z-axis, $I_{zz}$, specified in units of kg-mm$^2$, a moment of inertia about a center-of-gravity x-axis, $I_{xx}$, specified in units of kg-mm$^2$, and, the above ground center-of-gravity location, Zup, specified in units of millimeters, together satisfy the relationship $I_{xx} + I_{zz} \geq 20 \cdot Zup + 165$.

In some instances, the above ground center-of-gravity above ground location, Zup, and the moment of inertia about the center-of-gravity z-axis, $I_{zz}$, specified in units of kg-mm$^2$, together satisfy the relationship $I_{zz} \geq 13 \cdot Zup + 105$. In some embodiments, the moment of inertia about the center-of-gravity z-axis, $I_{zz}$, exceeds one or more of 300 kg-mm$^2$, 320 kg-mm$^2$, 340 kg-mm$^2$, and 360 kg-mm$^2$. The moment of inertia about the center-of-gravity x-axis, $I_{xx}$, can exceed one or more of 150 kg-mm$^2$, 170 kg-mm$^2$, and 190 kg-mm$^2$.

Some golf club heads according to the third aspect also include one or more weight ports formed in the body and at least one weight configured to be retained at least partially within one of the one or more weight ports. The face can have a loft angle in excess of about 13 degrees. The golf club head can have a volume less than about 240 cm$^3$. The body can be substantially formed from a steel alloy, a titanium alloy, a graphitic composite, and/or a combination thereof. In some instances, the body is substantially formed as an investment casting. In some instances, the maximum height is less than one or more of about 46 mm, about 42 mm, and about 38 mm.

In golf club heads according to a fourth aspect, the crown has a thickness less than about 0.65 mm for at least about 70% of the crown, a front to back depth ($D_{ch}$) is greater than about 85 mm, and an above ground center-of-gravity location, Zup, is less than about 19 mm. In addition, a moment of inertia about a center-of-gravity x-axis, $I_{xx}$, specified in units of kg-mm$^2$, and the above ground center-of-gravity location, Zup, specified in units of millimeters, together satisfy the relationship $I_{xx} \geq 7 \cdot Zup + 60$.

In some instances, the above ground center-of-gravity location, Zup, and the moment of inertia about the center-of-gravity z-axis, $I_{zz}$, specified in units of kg-mm$^2$, together satisfy the relationship $I_{zz} \geq 13 \cdot Zup + 105$.

The moment of inertia about the center-of-gravity z-axis, $I_{zz}$, can exceed one or more of 300 kg-mm$^2$, 320 kg-mm$^2$, 340 kg-mm$^2$, and 360 kg-mm$^2$. The moment of inertia about the center-of-gravity x-axis, $I_{xx}$, can exceed one or more of 150 kg-mm$^2$, 170 kg-mm$^2$, and 190 kg-mm$^2$.

Some embodiments according to the fourth aspect also include one or more weight ports formed in the body and at least one weight configured to be retained at least partially within one of the one or more weight ports.

According to the fourth aspect, the face can have a loft angle in excess of about 13 degrees. The golf club head can have a volume less than about 240 cm$^3$. The body can be substantially formed from a selected material from a steel alloy, a titanium alloy, a graphitic composite, and/or a combination thereof. In some instances, the body is substantially formed as an investment casting. The maximum height of some club heads according to the fourth aspect is less than one or more of about 46 mm, about 42 mm, and about 38 mm.

In golf club heads according to a fifth aspect, the club head has a center of gravity projection (CG projection) on the striking surface of the club head that is located near to the center of the striking surface. In some instances, the center of gravity projection is at or below the center of the striking surface. For example, in some embodiments, the center of gravity projection on the striking surface is less than about 2.0 mm (i.e., the CG projection is below about 2.0 mm above the center of the striking surface), such as less than about 1.0 mm, or less than about 0 mm, or less than about −1.0 mm.

In some instances, the CG projection is related to the loft of the golf club head. For example, in some embodiments, the golf club head has a CG projection of about 3 mm or less for club heads where the loft angle is at least 16.2 degrees, and the CG projection is less than about 1.0 mm for club heads where the loft angle is 16.2 degrees or less.

In golf club heads according to a sixth aspect, the club head has a channel, a slot, or other member that increases or enhances the perimeter flexibility of the striking face of the golf club head in order to increase the coefficient of restitution and/or characteristic time of the golf club head. In some instances, the channel, slot, or other mechanism is located in the forward portion of the sole of the club head, adjacent to or near to the forwardmost edge of the sole.

The foregoing and other features and advantages of the golf club head will become more apparent from the following detailed description, which proceeds with reference to the accompanying figures.

DETAILED DESCRIPTION

The following describes embodiments of golf club heads for metalwood type golf clubs, including drivers, fairway woods, rescue clubs, hybrid clubs, and the like. Several of the golf club heads incorporate features that provide the golf club heads and/or golf clubs with increased moments of inertia and low centers of gravity, centers of gravity located in preferable locations, improved club head and face geometries, increased sole and lower face flexibility, higher coefficients or restitution ("COR") and characteristic times ("CT"), and/or decreased backspin rates relative to fairway wood and other golf club heads that have come before.

The following makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object.

Accordingly, the following detailed description shall not to be construed in a limiting sense and the scope of property rights sought shall be defined by the appended claims and their equivalents.

Normal Address Position

Club heads and many of their physical characteristics disclosed herein will be described using "normal address position" as the club head reference position, unless otherwise indicated.

Figure 1:
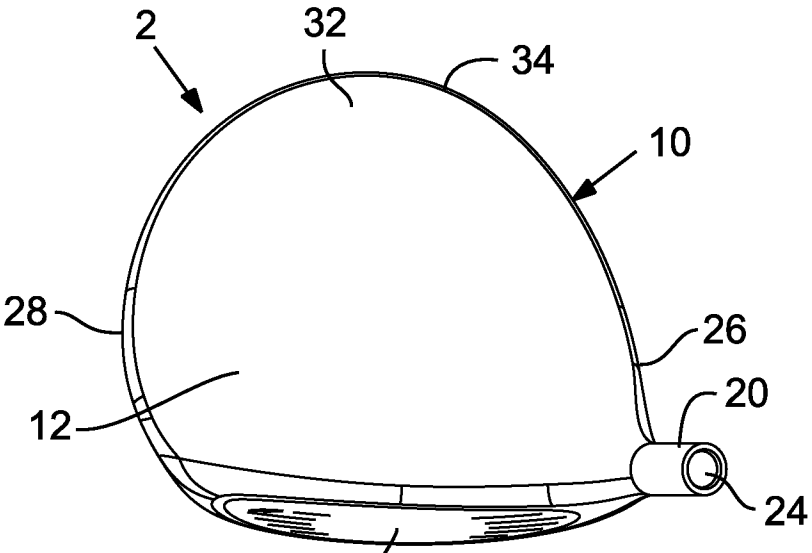
FIG. 1 is a top plan view of one embodiment of a golf club head.
Figure 3:
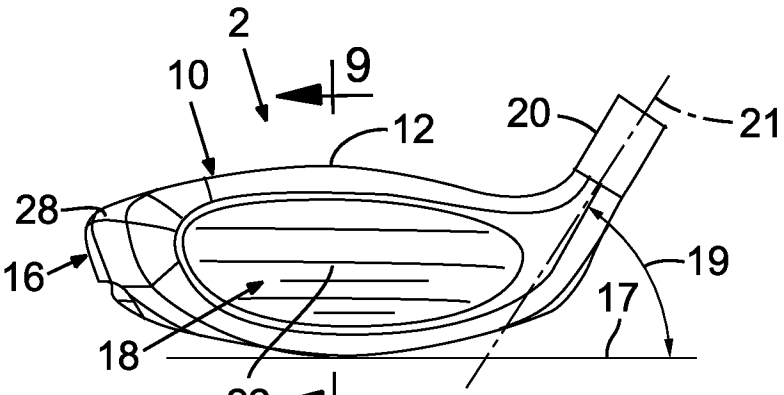
FIG. 3 is a front elevation view of the golf club head of FIG. 1.
Figure 2:
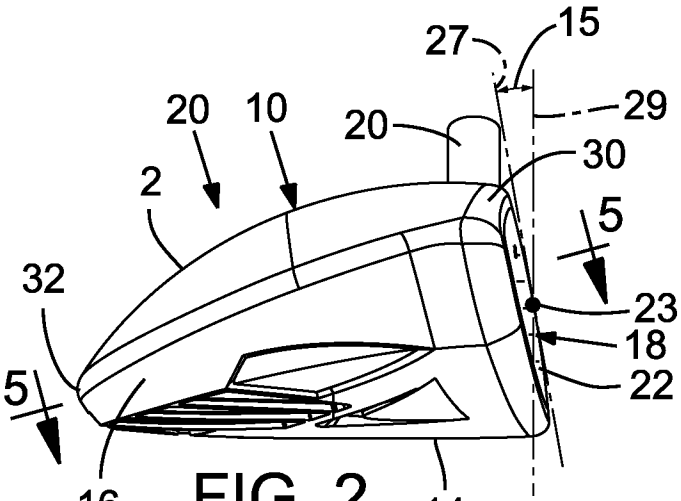
FIG. 2 is a side elevation view from a toe side of the golf club head of FIG. 1.
Figure 4:
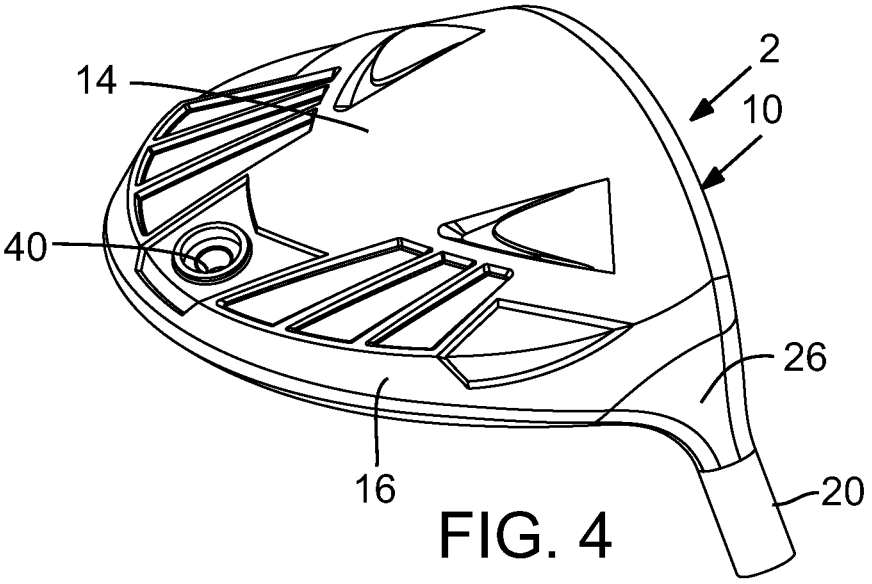
FIG. 4 is a bottom perspective view of the golf club head of FIG. 1.

FIGS. 1-3 illustrate one embodiment of a fairway wood type golf club head at normal address position. FIG. 1 illustrates a top plan view of the club head 2, FIG. 2 illustrates a side elevation view from the toe side of the club head 2, and FIG. 3 illustrates a front elevation view. By way of preliminary description, the club head 2 includes a hosel 20 and a ball striking club face 18. At normal address position, the club head 2 rests on the ground plane 17, a plane parallel to the ground.

As used herein, "normal address position" means the club head position wherein a vector normal to the club face 18 substantially lies in a first vertical plane (i.e., a vertical plane is perpendicular to the ground plane 17), the centerline axis 21 of the club shaft substantially lies in a second vertical plane, and the first vertical plane and the second vertical plane substantially perpendicularly intersect.

Club Head

A fairway wood-type golf club head, such as the golf club head 2, includes a hollow body 10 defining a crown portion 12, a sole portion 14 and a skirt portion 16. A striking face, or face portion, 18 attaches to the body 10. The body 10 can include a hosel 20, which defines a hosel bore 24 adapted to receive a golf club shaft. The body 10 further includes a heel portion 26, a toe portion 28, a front portion 30, and a rear portion 32.

The club head 2 also has a volume, typically measured in cubic-centimeters ($cm^3$), equal to the volumetric displacement of the club head 2, assuming any apertures are sealed by a substantially planar surface. (See United States Golf Association "Procedure for Measuring the Club Head Size of Wood Clubs," Revision 1.0, Nov. 21, 2003). In some implementations, the golf club head 2 has a volume between approximately 120 $cm^3$ and approximately 240 $cm^3$, such as between approximately 180 $cm^3$ and approximately 210 $cm^3$, and a total mass between approximately 185 g and approximately 245 g, such as between approximately 200 g and approximately 220 g. In a specific implementation, the golf club head 2 has a volume of approximately 181 $cm^3$ and a total mass of approximately 216 g. Additional specific implementations having additional specific values for volume and mass are described elsewhere herein.

Figure 9:
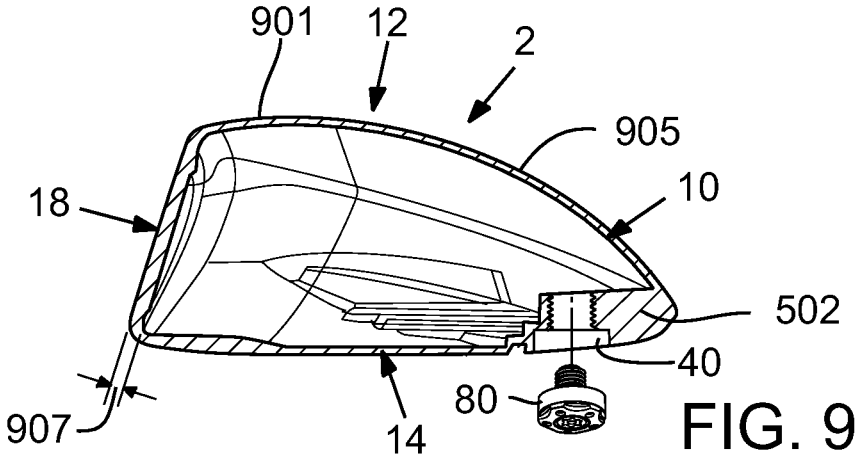
FIG. 9 is a cross-sectional view of the golf club head of FIG. 1 taken along line 9-9 of FIG. 3 showing internal features of the golf club head.

As used herein, "crown" means an upper portion of the club head above a peripheral outline 34 of the club head as viewed from a top-down direction and rearward of the topmost portion of a ball striking surface 22 of the striking face 18 (see e.g., FIGS. 1-2). FIG. 9 illustrates a cross-sectional view of the golf club head of FIG. 1 taken along line 9-9 of FIG. 3 showing internal features of the golf club head. Particularly, the crown 12 ranges in thickness from about 0.76 mm or about 0.80 mm at the front crown 901, near the club face 18, to about 0.60 mm at the back crown 905, a portion of the crown near the rear of the club head 2.

Figure 5:
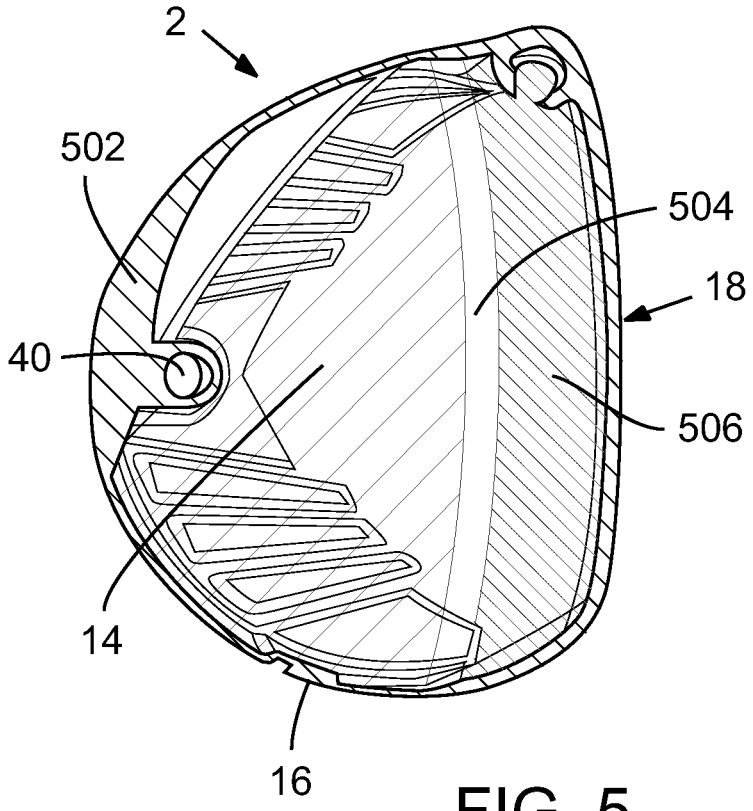
FIG. 5 is a cross-sectional view of the golf club head of FIG. 1 taken along line 5-5 of FIG. 2 and showing internal features of the embodiment of FIG. 1.

As used herein, "sole" means a lower portion of the club head 2 extending upwards from a lowest point of the club head when the club head is at normal address position. In some implementations, the sole 14 extends approximately 50% to 60% of the distance from the lowest point of the club head to the crown 12, which in some instances, can be approximately 10 mm and 12 mm for a fairway wood. For example, FIG. 5 illustrates a sole blend zone 504 that transitions from the sole 14 to the front sole 506. In the illustrated embodiment, the front sole 506 dimension extends about 15 mm rearward of the club face 18.

In other implementations, the sole 14 extends upwardly from the lowest point of the golf club body 10 a shorter distance than the sole 14 of golf club head 2. Further, the sole 14 can define a substantially flat portion extending substantially horizontally relative to the ground 17 when in normal address position. In some implementations, the bottommost portion of the sole 14 extends substantially parallel to the ground 17 between approximately 5% and approximately 70% of the depth ($D_{ch}$) of the golf club body 10.

In some implementations, an adjustable mechanism is provided on the sole 14 to "decouple" the relationship between face angle and hosel/shaft loft, i.e., to allow for separate adjustment of square loft and face angle of a golf club. For example, some embodiments of the golf club head 2 include an adjustable sole portion that can be adjusted relative to the club head body 2 to raise and lower the rear end of the club head relative to the ground. Further detail concerning the adjustable sole portion is provided in U.S. Patent Application Publication No. 2011/0312347, which is incorporated herein by reference.

As used herein, "skirt" means a side portion of the club head 2 between the crown 12 and the sole 14 that extends across a periphery 34 of the club head, excluding the striking surface 22, from the toe portion 28, around the rear portion 32, to the heel portion 26.

As used herein, "striking surface" means a front or external surface of the striking face 18 configured to impact a golf ball (not shown). In several embodiments, the striking face or face portion 18 can be a striking plate attached to the body 10 using conventional attachment techniques, such as welding, as will be described in more detail below. In some embodiments, the striking surface 22 can have a bulge and roll curvature. For example, referring to FIGS. 1 and 2, the striking surface 22 can have a bulge and roll each with a radius of approximately 254 mm. As illustrated by FIG. 9, the average face thickness 907 for the illustrated embodiment is in the range of from about 1.0 mm to about 4.5 mm, such as between about 2.0 mm and about 2.2 mm.

The body 10 can be made from a metal alloy (e.g., an alloy of titanium, an alloy of steel, an alloy of aluminum, and/or an alloy of magnesium), a composite material, such as a graphitic composite, a ceramic material, or any combination thereof. The crown 12, sole 14, and skirt 16 can be integrally formed using techniques such as molding, cold forming, casting, and/or forging and the striking face 18 can be attached to the crown, sole and skirt by known means.

For example, the striking face 18 can be attached to the body 10 as described in U.S. Patent Application Publication Nos. 2005/0239575 and 2004/0235584.

Figure 7:
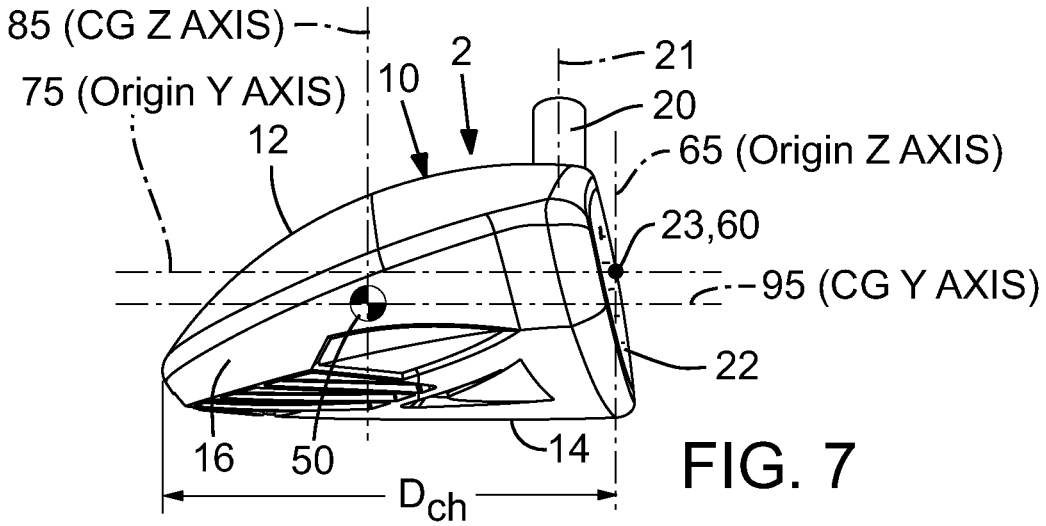
FIG. 7 is a side elevation view from the toe side of the golf club head of FIG. 1 showing the golf club head origin system and the center-of-gravity coordinate system.
Figure 8:
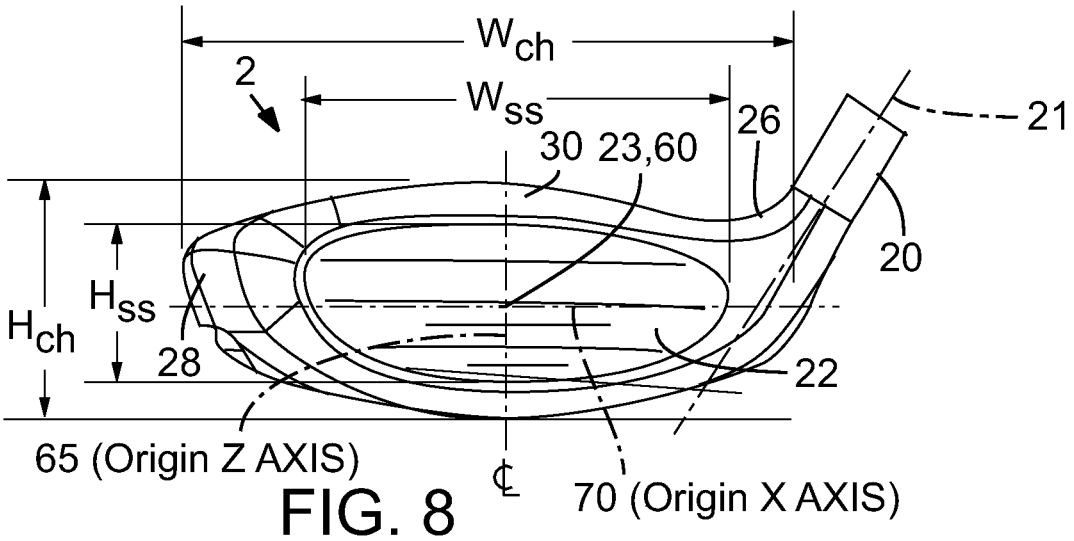
FIG. 8 is a front elevation view of the golf club head of FIG. 1, similar to FIG. 3, showing the golf club head origin system and the center-of-gravity coordinate system.

Referring to FIGS. 7 and 8, the ideal impact location 23 of the golf club head 2 is disposed at the geometric center of the striking surface 22. The ideal impact location 23 is typically defined as the intersection of the midpoints of a height ($H_{ss}$) and a width ($W_{ss}$) of the striking surface 22. Both $H_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body (see e.g., FIG. 8). In the illustrated example, $H_{ss}$ is the distance from the periphery proximate to the sole portion of $S_{ss}$ to the perhiphery proximate to the crown portion of $S_{ss}$ measured in a vertical plane (perpendicular to ground) that extends through the geometric center of the face (e.g., this plane is substantially normal to the x-axis). Similarly, $W_{ss}$ is the distance from the periphery proximate to the heel portion of $S_{ss}$ to the periphery proximate to the toe portion of $S_{ss}$ measured in a horizontal plane (e.g., substantially parallel to ground) that extends through the geometric center of the face (e.g., this plane is substantially normal to the z-axis). See USGA "Procedure for Measuring the Flexibility of a Golf Clubhead," Revision 2.0 for the methodology to measure the geometric center of the striking face. In some implementations, the golf club head face, or striking surface, 22, has a height ($H_{ss}$) between approximately 20 mm and approximately 45 mm, and a width ($W_{ss}$) between approximately 60 mm and approximately 120 mm. In one specific implementation, the striking surface 22 has a height ($H_{ss}$) of approximately 26 mm, width ($W_{ss}$) of approximately 71 mm, and total striking surface area of approximately 2050 $mm^2$. Additional specific implementations having additional specific values for striking surface height ($H_{ss}$), striking surface width ($W_{ss}$), and total striking surface area are described elsewhere herein.

In some embodiments, the striking face 18 is made of a composite material such as described in U.S. Patent Application Publication Nos. 2005/0239575, 2004/0235584, 2008/0146374, 2008/0149267, and 2009/0163291, which are incorporated herein by reference. In other embodiments, the striking face 18 is made from a metal alloy (e.g., an alloy of titanium, steel, aluminum, and/or magnesium), ceramic material, or a combination of composite, metal alloy, and/or ceramic materials. Examples of titanium alloys include 3-2.5, 6-4, SP700, 15-3-3-3, 10-2-3, or other alpha/near alpha, alpha-beta, and beta/near beta titanium alloys. Examples of steel alloys include 304, 410, 450, or 455 stainless steel.

When at normal address position, the club head 2 is disposed at a lie-angle 19 relative to the club shaft axis 21 and the club face has a loft angle 15 (FIG. 2). Referring to FIG. 3, lie-angle 19 refers to the angle between the centerline axis 21 of the club shaft and the ground plane 17 at normal address position. Lie angle for a fairway wood typically ranges from about 54 degrees to about 62 degrees, most typically about 56 degrees to about 60 degrees. Referring to FIG. 2, loft-angle 15 refers to the angle between a tangent line 27 to the club face 18 and a vector normal to the ground plane 29 at normal address position. Loft angle for a fairway wood is typically greater than about 13 degrees. For example, loft for a fairway wood typically ranges from about 13 degrees to about 28 degrees, and more preferably from about 13 degrees to about 22 degrees.

A club shaft is received within the hosel bore 24 and is aligned with the centerline axis 21. In some embodiments, a connection assembly is provided that allows the shaft to be easily disconnected from the club head 2. In still other embodiments, the connection assembly provides the ability for the user to selectively adjust the loft-angle 15 and/or lie-angle 19 of the golf club. For example, in some embodiments, a sleeve is mounted on a lower end portion of the shaft and is configured to be inserted into the hosel bore 24. The sleeve has an upper portion defining an upper opening that receives the lower end portion of the shaft, and a lower portion having a plurality of longitudinally extending, angularly spaced external splines located below the shaft and adapted to mate with complimentary splines in the hosel opening 24. The lower portion of the sleeve defines a longitudinally extending, internally threaded opening adapted to receive a screw for securing the shaft assembly to the club head 2 when the sleeve is inserted into the hosel opening 24. Further detail concerning the shaft connection assembly is provided in U.S. Patent Application Publication No. 2010/0197424, which is incorporated herein by reference.

Golf Club Head Coordinates

Figure 6:
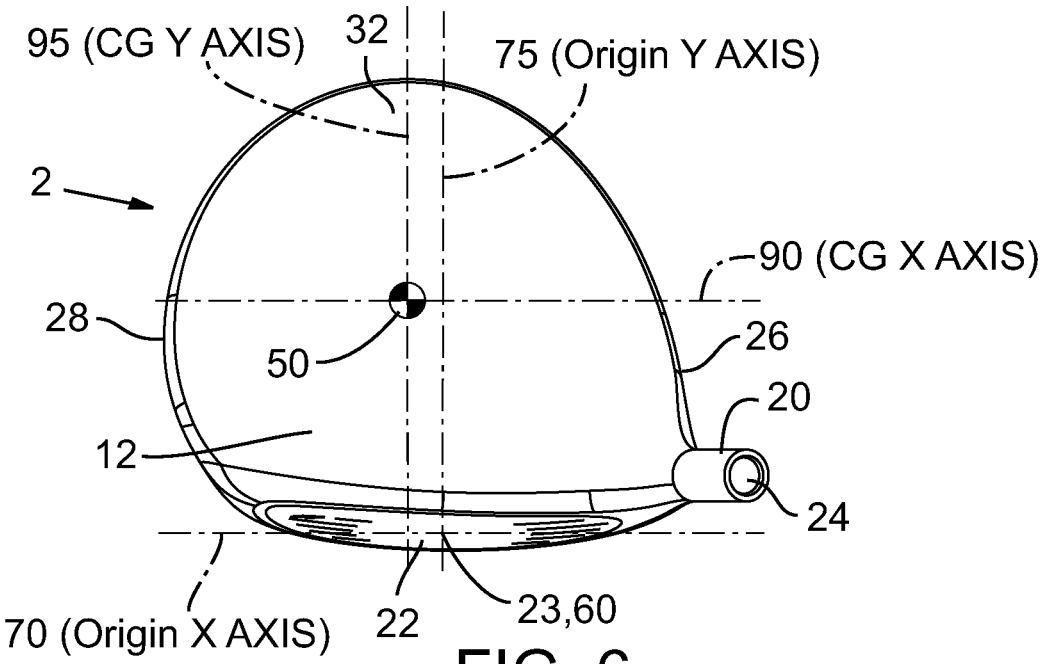
FIG. 6 is a top plan view of the golf club head of FIG. 1, similar to FIG. 1, showing a golf club head origin system and a center-of-gravity coordinate system.

Referring to FIGS. 6-8, a club head origin coordinate system can be defined such that the location of various features of the club head (including, e.g., a club head center-of-gravity (CG) 50) can be determined. A club head origin 60 is illustrated on the club head 2 positioned at the ideal impact location 23, or geometric center, of the striking surface 22.

The head origin coordinate system defined with respect to the head origin 60 includes three axes: a z-axis 65 extending through the head origin 60 in a generally vertical direction relative to the ground 17 when the club head 2 is at normal address position; an x-axis 70 extending through the head origin 60 in a toe-to-heel direction generally parallel to the striking surface 22, e.g., generally tangential to the striking surface 22 at the ideal impact location 23, and generally perpendicular to the z-axis 65; and a y-axis 75 extending through the head origin 60 in a front-to-back direction and generally perpendicular to the x-axis 70 and to the z-axis 65.

The x-axis 70 and the y-axis 75 both extend in generally horizontal directions relative to the ground 17 when the club head 2 is at normal address position. The x-axis 70 extends in a positive direction from the origin 60 to the heel 26 of the club head 2. The y-axis 75 extends in a positive direction from the origin 60 towards the rear portion 32 of the club head 2. The z-axis 65 extends in a positive direction from the origin 60 towards the crown 12.

An alternative, above ground, club head coordinate system places the origin 60 at the intersection of the z-axis 65 and the ground plane 17, providing positive z-axis coordinates for every club head feature.

As used herein, "Zup" means the CG z-axis location determined according to the above ground coordinate system. Zup generally refers to the height of the CG 50 above the ground plane 17.

In several embodiments, the golf club head can have a CG with an x-axis coordinate between approximately −2.0 mm and approximately 6.0 mm, such as between approximately −2.0 mm and approximately 3.0 mm, a y-axis coordinate between approximately 15 mm and approximately 40 mm, such as between approximately 20 mm and approximately 30 mm, or between approximately 23 mm and approximately 28 mm, and a z-axis coordinate between approximately 0.0 mm and approximately −12.0 mm, such as between approximately −3.0 mm and approximately −9.0 mm, or between approximately −5.0 mm and approximately −8.0 mm. In certain embodiments, a z-axis coordinate between about 0.0 mm and about −12.0 mm provides a Zup value of between approximately 10 mm and approximately 19 mm, such as between approximately 11 mm and approximately 18 mm, or between approximately 12 mm and approximately 16 mm. Referring to FIG. 1, in one specific implementation, the CG x-axis coordinate is approximately 2.5 mm, the CG y-axis coordinate is approximately 32 mm, the CG z-axis coordinate is approximately −3.5 mm, providing a Zup value of approximately 15 mm. Additional specific implementations having additional specific values for the CG x-axis coordinate, CG y-axis coordinate, CG z-axis coordinate, and Zup are described elsewhere herein.

Another alternative coordinate system uses the club head center-of-gravity (CG) 50 as the origin when the club head 2 is at normal address position. Each center-of-gravity axis passes through the CG 50. For example, the CG x-axis 90 passes through the center-of-gravity 50 substantially parallel to the ground plane 17 and generally parallel to the origin x-axis 70 when the club head is at normal address position. Similarly, the CG y-axis 95 passes through the center-of-gravity 50 substantially parallel to the ground plane 17 and generally parallel to the origin y-axis 75, and the CG z-axis 85 passes through the center-of-gravity 50 substantially perpendicular to the ground plane 17 and generally parallel to the origin z-axis 65 when the club head is at normal address position.

Mass Moments of Inertia

Referring to FIGS. 6-8, golf club head moments of inertia are typically defined about the three CG axes that extend through the golf club head center-of-gravity 50.

For example, a moment of inertia about the golf club head CG z-axis 85 can be calculated by the following equation $$Izz=\int(x^2+y^2)dm \quad (2)$$

where x is the distance from a golf club head CG yz-plane to an infinitesimal mass, dm, and y is the distance from the golf club head CG xz-plane to the infinitesimal mass, dm. The golf club head CG yz-plane is a plane defined by the golf club head CG y-axis 95 and the golf club head CG z-axis 85.

The moment of inertia about the CG z-axis (Izz) is an indication of the ability of a golf club head to resist twisting about the CG z-axis. Greater moments of inertia about the CG z-axis (Izz) provide the golf club head 2 with greater forgiveness on toe-ward or heelward off-center impacts with a golf ball. In other words, a golf ball hit by a golf club head on a location of the striking surface 18 between the toe 28 and the ideal impact location 23 tends to cause the golf club head to twist rearwardly and the golf ball to draw (e.g., to have a curving trajectory from right-to-left for a right-handed swing). Similarly, a golf ball hit by a golf club head on a location of the striking surface 18 between the heel 26 and the ideal impact location 23 causes the golf club head to twist forwardly and the golf ball to slice (e.g., to have a curving trajectory from left-to-right for a right-handed swing). Increasing the moment of inertia about the CG z-axis (Izz) reduces forward or rearward twisting of the golf club head, reducing the negative effects of heel or toe mis-hits.

A moment of inertia about the golf club head CG x-axis 90 can be calculated by the following equation $$Ixx=\int(y^2+z^2)dm \quad (1)$$

where y is the distance from a golf club head CG xz-plane to an infinitesimal mass, dm, and z is the distance from a golf club head CG xy-plane to the infinitesimal mass, dm. The golf club head CG xz-plane is a plane defined by the golf club head CG x-axis 90 and the golf club head CG z-axis 85. The CG xy-plane is a plane defined by the golf club head CG x-axis 90 and the golf club head CG y-axis 95.

As the moment of inertia about the CG z-axis (Izz) is an indication of the ability of a golf club head to resist twisting about the CG z-axis, the moment of inertia about the CG x-axis (Ixx) is an indication of the ability of the golf club head to resist twisting about the CG x-axis. Greater moments of inertia about the CG x-axis (Ixx) improve the forgiveness of the golf club head 2 on high and low off-center impacts with a golf ball. In other words, a golf ball hit by a golf club head on a location of the striking surface 18 above the ideal impact location 23 causes the golf club head to twist upwardly and the golf ball to have a higher trajectory than desired. Similarly, a golf ball hit by a golf club head on a location of the striking surface 18 below the ideal impact location 23 causes the golf club head to twist downwardly and the golf ball to have a lower trajectory than desired. Increasing the moment of inertia about the CG x-axis (Ixx) reduces upward and downward twisting of the golf club head 2, reducing the negative effects of high and low mis-hits.

Discretionary Mass

Desired club head mass moments of inertia, club head center-of-gravity locations, and other mass properties of a golf club head can be attained by distributing club head mass to particular locations. Discretionary mass generally refers to the mass of material that can be removed from various structures providing mass that can be distributed elsewhere for tuning one or more mass moments of inertia and/or locating the club head center-of-gravity.

Club head walls provide one source of discretionary mass. In other words, a reduction in wall thickness reduces the wall mass and provides mass that can be distributed elsewhere. For example, in some implementations, one or more walls of the club head can have a thickness (constant or average) less than approximately 0.7 mm, such as between about 0.55 mm and about 0.65 mm. In some embodiments, the crown 12 can have a thickness (constant or average) of approximately 0.60 mm or approximately 0.65 mm throughout more than about 70% of the crown, with the remaining portion of the crown 12 having a thickness (constant or average) of approximately 0.76 mm or approximately 0.80 mm. See for example FIG. 9, which illustrates a back crown thickness 905 of about 0.60 mm and a front crown thickness 901 of about 0.76 mm. In addition, the skirt 16 can have a similar thickness and the wall of the sole 14 can have a thickness of between approximately 0.6 mm and approximately 2.0 mm. In contrast, conventional club heads have crown wall thicknesses in excess of about 0.75 mm, and some in excess of about 0.85 mm.

Thin walls, particularly a thin crown 12, provide significant discretionary mass compared to conventional club heads. For example, a club head 2 made from an alloy of steel can achieve about 4 grams of discretionary mass for each 0.1 mm reduction in average crown thickness. Similarly, a club head 2 made from an alloy of titanium can achieve about 2.5 grams of discretionary mass for each 0.1 mm reduction in average crown thickness. Discretionary mass achieved using a thin crown 12, e.g., less than about 0.65 mm, can be used to tune one or more mass moments of inertia and/or center-of-gravity location.

For example, FIG. 5 illustrates a cross-section of the club head 2 of FIG. 1 along line 5-5 of FIG. 2. In addition to providing a weight port 40 for adjusting the club head mass distribution, the club head 2 provides a mass pad 502 located rearward in the club head 2.

To achieve a thin wall on the club head body 10, such as a thin crown 12, a club head body 10 can be formed from an alloy of steel or an alloy of titanium. Thin wall investment casting, such as gravity casting in air for alloys of steel (FIG. 10) and centrifugal casting in a vacuum chamber for alloys of titanium (FIG. 11), provides one method of manufacturing a club head body with one or more thin walls.

Figure 10:
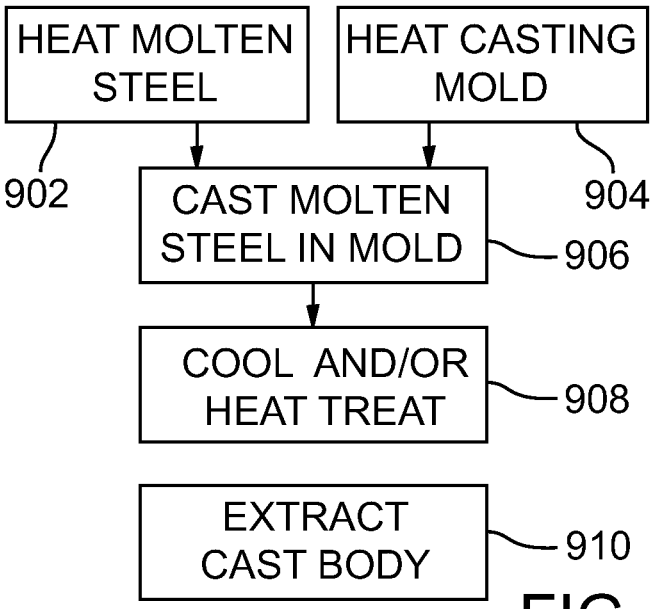
FIG. 10 is a flowchart of an investment casting process for club heads made of an alloy of steel.
Figure 11:
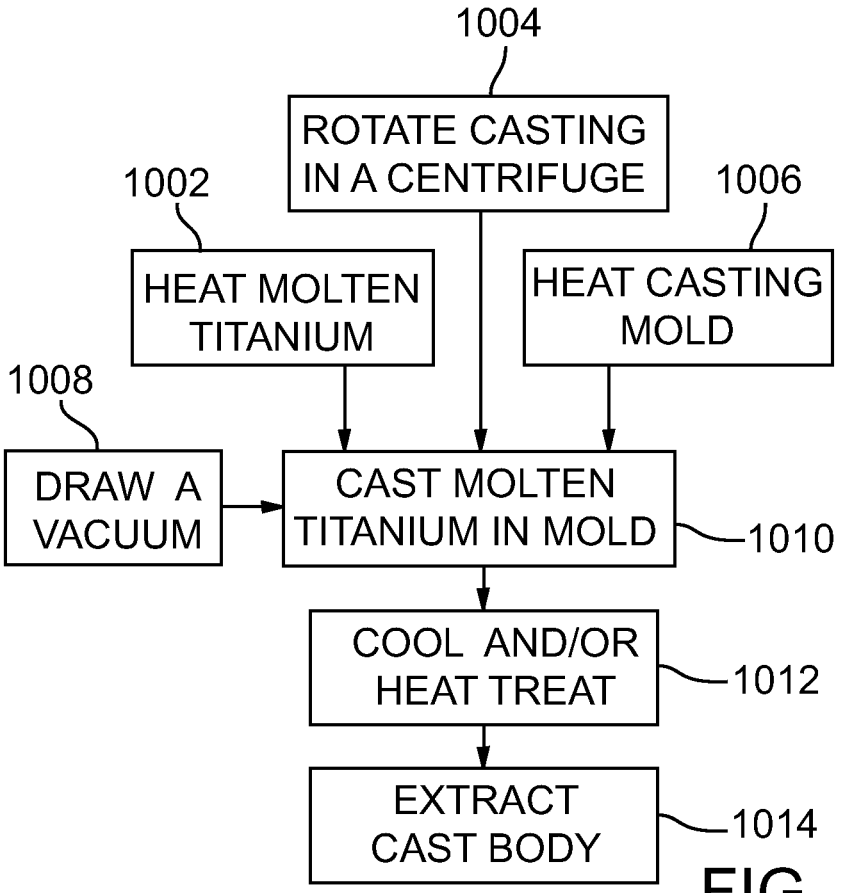
FIG. 11 is a flowchart of an investment casting process for club heads made of an alloy of titanium.

Referring to FIG. 10, a thin crown made of a steel alloy, for example between about 0.55 mm and about 0.65 mm, can be attained by heating a molten steel (902) to between about 2520 degrees Fahrenheit and about 2780 degrees Fahrenheit, such as about 2580 degrees. In addition, the casting mold can be heated (904) to between about 660 degrees and about 1020 degrees, such as about 830 degrees. The molten steel can be cast in the mold (906) and subsequently cooled and/or heat treated (908). The cast steel body 10 can be extracted from the mold (910) prior to applying any secondary machining operations or attaching a striking face 18.

Alternatively, a thin crown can be made from an alloy of titanium. In some embodiments of a titanium casting process, modifying the gating provides improved flow of molten titanium, aiding in casting thin crowns. For further details concerning titanium casting, please refer to U.S. Pat. No. 7,513,296, incorporated herein by reference. Molten titanium can be heated (1002) to between about 3000 degrees Fahrenheit and about 3750 degrees Fahrenheit, such as between about 3025 degrees Fahrenheit and about 3075 degrees Fahrenheit. In addition, the casting mold can be heated (1006) to between about 620 degrees Fahrenheit and about 930 degrees, such as about 720 degrees. The casting can be rotated in a centrifuge (1004) at a rotational speed between about 200 RPM and about 800 RPM, such as about 500 RPM. Molten titanium can be cast in the mold (1010) and the cast body can be cooled and/or heat treated (1012). The cast titanium body 10 can be extracted from the mold (1014) prior to applying secondary machining operations or attaching the striking face.

Weights and Weight Ports

Various approaches can be used for positioning discretionary mass within a golf club head. For example, many club heads have integral sole weight pads cast into the head at predetermined locations that can be used to lower, to move forward, to move rearward, or otherwise to adjust the location of the club head's center-of-gravity. Also, epoxy can be added to the interior of the club head through the club head's hosel opening to obtain a desired weight distribution. Alternatively, weights formed of high-density materials can be attached to the sole, skirt, and other parts of a club head. With such methods of distributing the discretionary mass, installation is critical because the club head endures significant loads during impact with a golf ball that can dislodge the weight. Accordingly, such weights are usually permanently attached to the club head and are limited to a fixed total mass, which of course, permanently fixes the club head's center-of-gravity and moments of inertia.

Figure 13A:
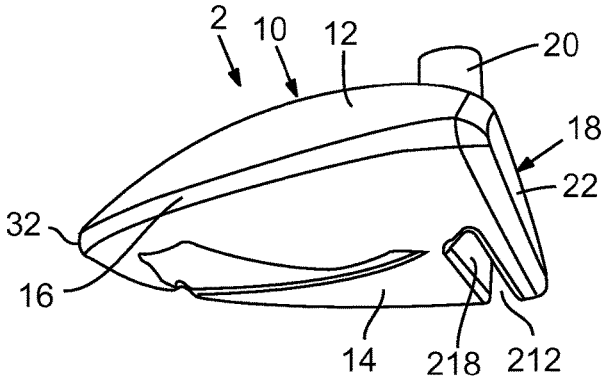
FIG. 13A is a side elevation view of another embodiment of a golf club head.
Figure 13B:
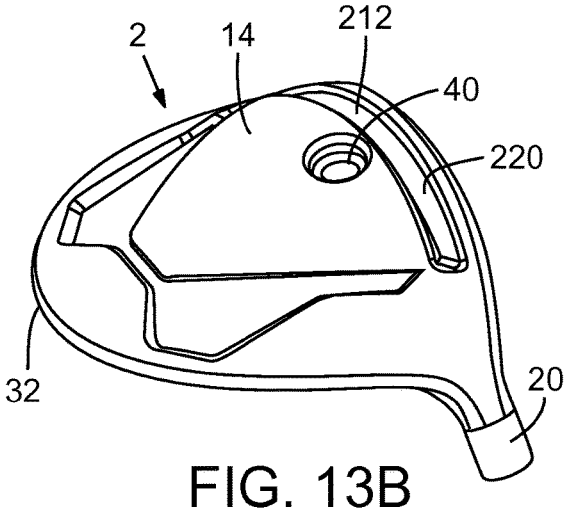
FIG. 13B is a bottom perspective view from a heel side of the golf club head of FIG. 13A.
Figure 13C:
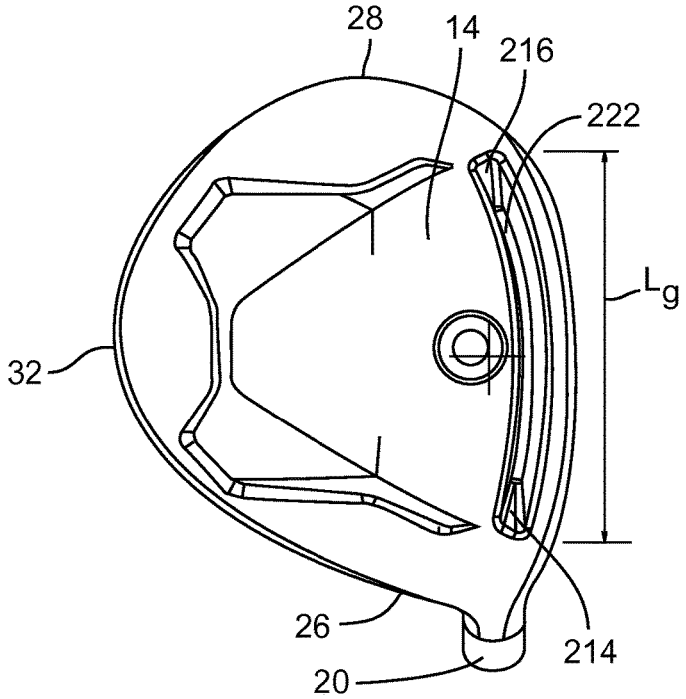
FIG. 13C is a bottom elevation view of the golf club head of FIG. 13A.
Figure 13D:
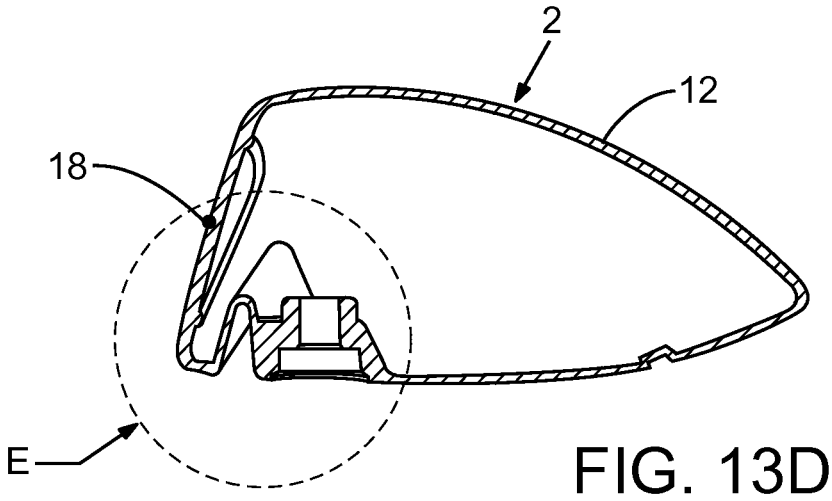
FIG. 13D is a cross-sectional view from the heel side of the golf club head of FIG. 13A showing internal features of the embodiment of FIG. 13A.
Figure 13E:
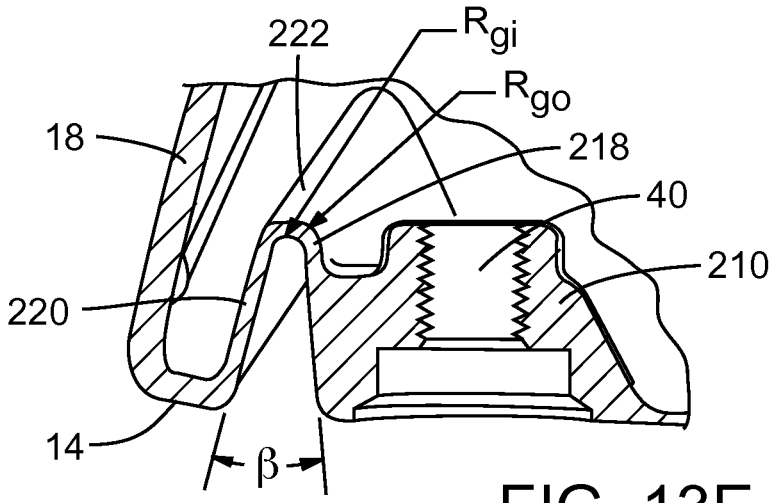
FIG. 13E is a cross-sectional view of the portion of the golf club head within the dashed circle labeled "E" in FIG. 13D.
Figure 13F:
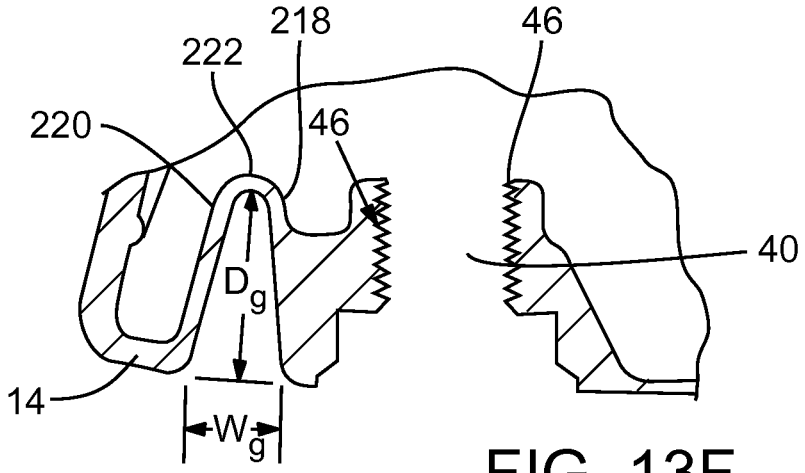
FIG. 13F is another cross-sectional view of the portion of the golf club head within the dashed circle labeled "E" in FIG. 13D.
Figure 13G:
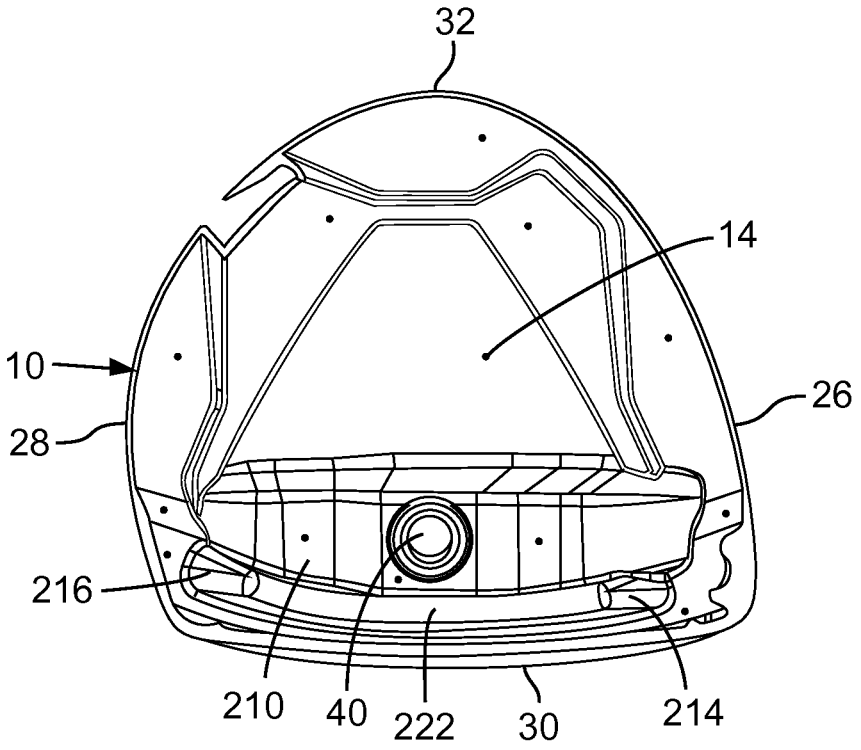
FIG. 13G is a cross-sectional view from the top of the golf club head of FIG. 13A showing internal features of the embodiment of FIG. 13A.
Figure 13H:
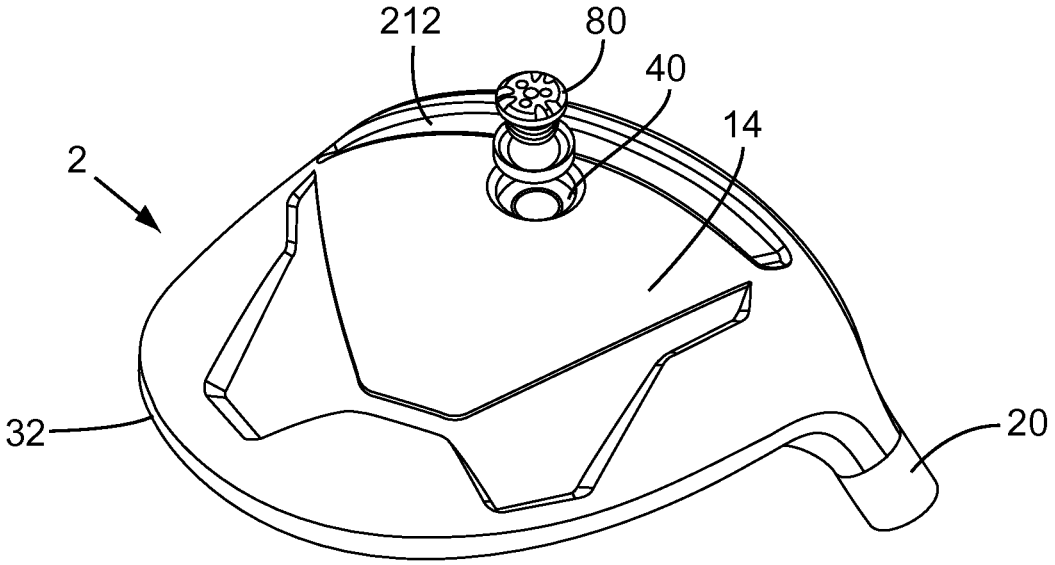
FIG. 13H is a bottom perspective view from a heel side of the golf club head of FIG. 13A, showing a weight in relation to a weight port.
Figure 14A:
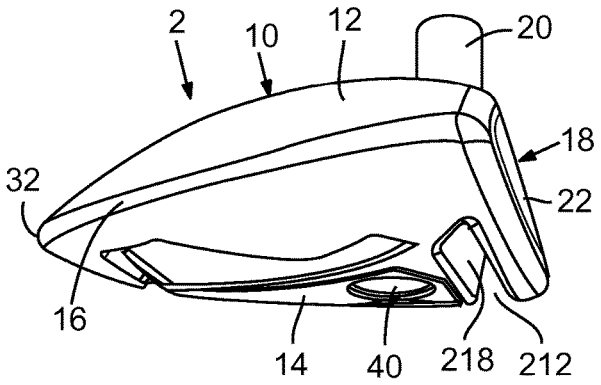
FIG. 14A is a side elevation view of another embodiment of a golf club head.
Figure 14B:
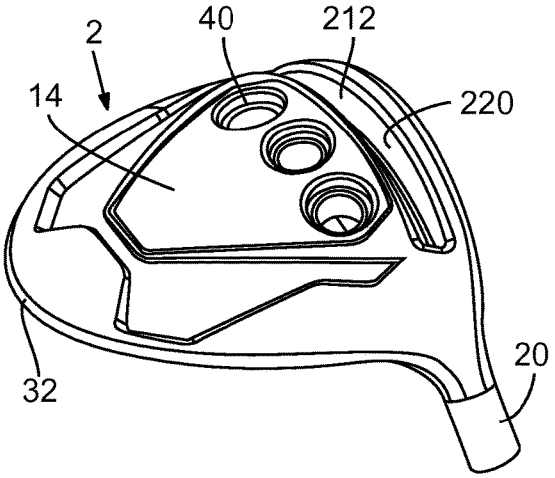
FIG. 14B is a bottom perspective view from a heel side of the golf club head of FIG. 14A.
Figure 14C:
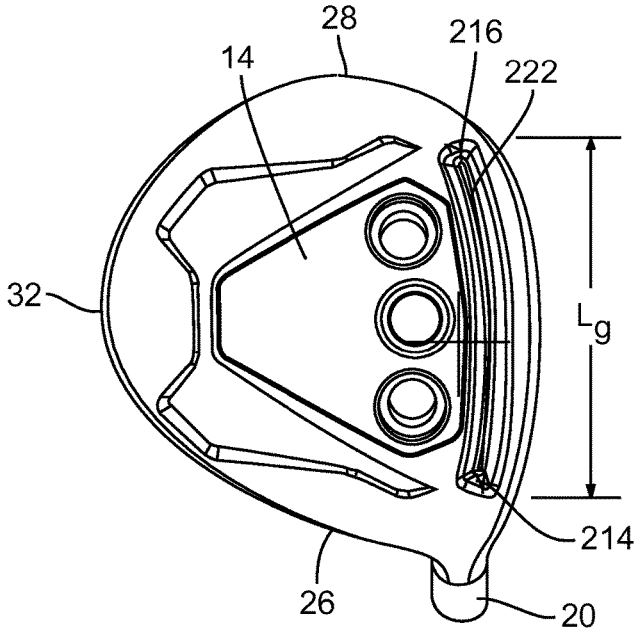
FIG. 14C is a bottom elevation view of the golf club head of FIG. 14A.
Figure 14D:
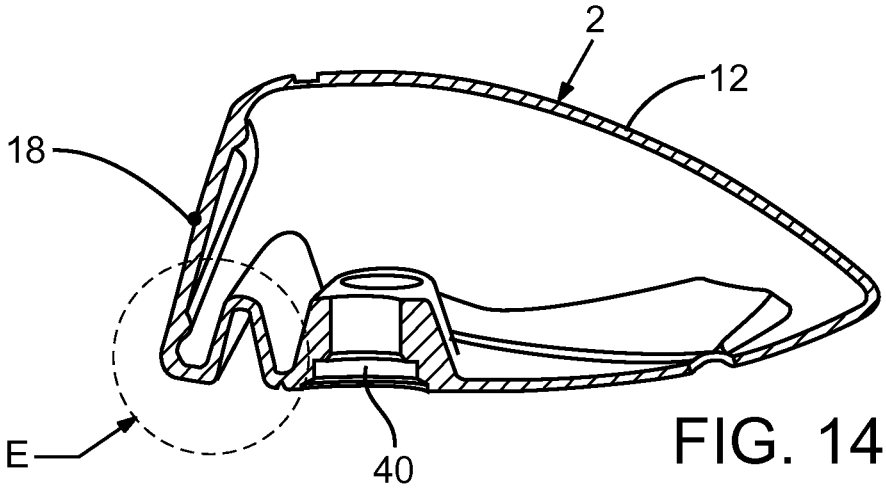
FIG. 14D is a cross-sectional view from the heel side of the golf club head of FIG. 14A showing internal features of the embodiment of FIG. 14A.
Figure 14E:
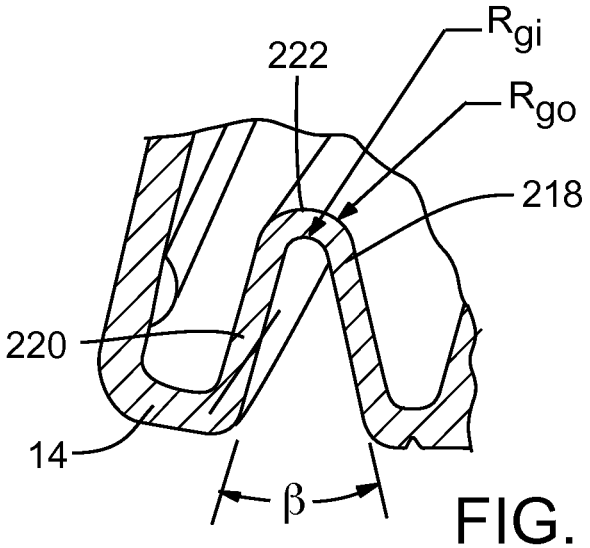
FIG. 14E is a cross-sectional view of the portion of the golf club head within the dashed circle labeled "E" in FIG. 14D.
Figure 14F:
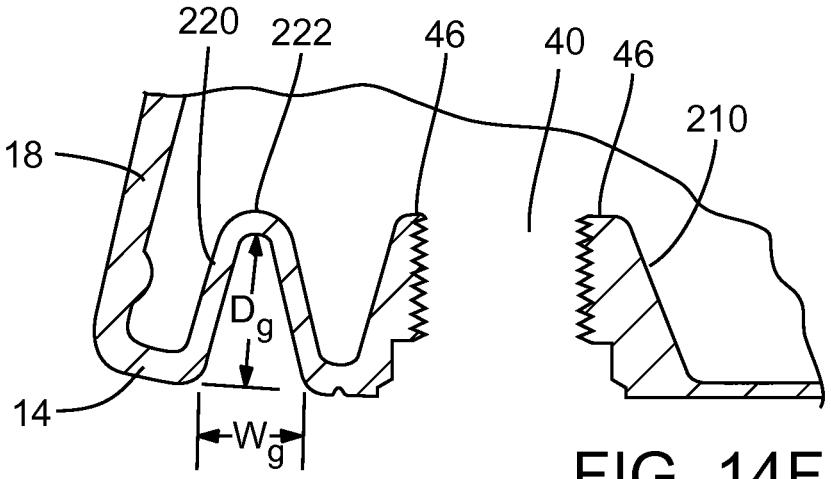
FIG. 14F is another cross-sectional view of the portion of the golf club head within the dashed circle labeled "E" in FIG. 14D.
Figure 14G:
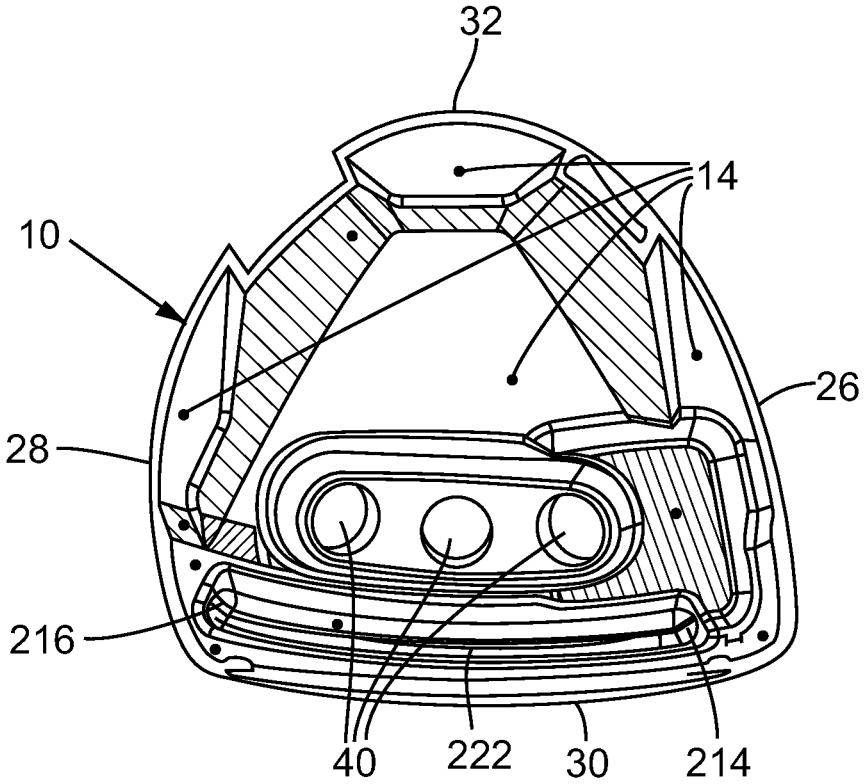
FIG. 14G is a cross-sectional view from the top of the golf club head of FIG. 14A showing internal features of the embodiment of FIG. 14A.
Figure 14H:
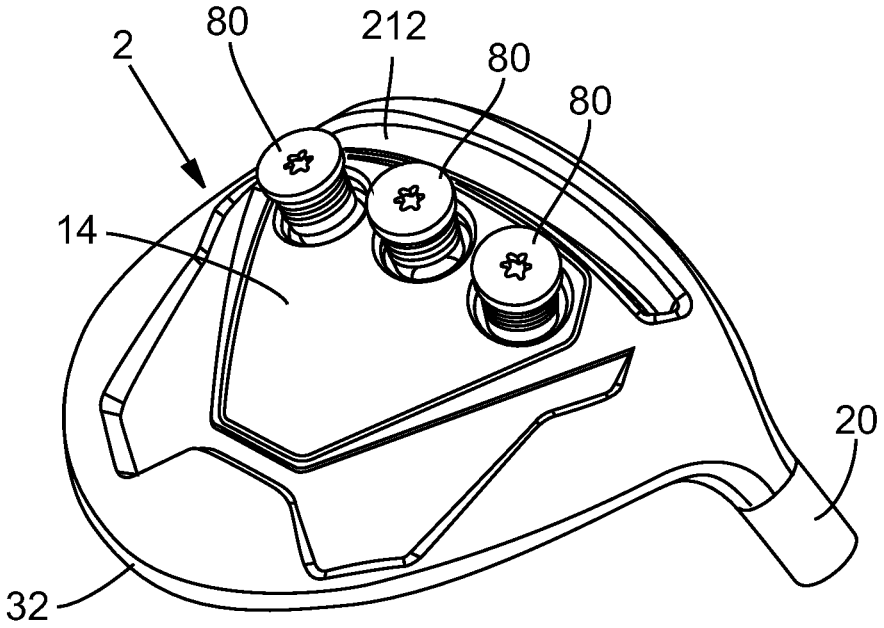
FIG. 14H is a bottom perspective view from a heel side of the golf club head of FIG. 14A, showing a plurality of weights in relation to a plurality of weight ports.

Alternatively, the golf club head 2 can define one or more weight ports 40 formed in the body 10 that are configured to receive one or more weights 80. For example, one or more weight ports can be disposed in the crown 12, skirt 16 and/or sole 14. The weight port 40 can have any of a number of various configurations to receive and retain any of a number of weights or weight assemblies, such as described in U.S. Pat. Nos. 7,407,447 and 7,419,441, which are incorporated herein by reference. For example, FIG. 9 illustrates a cross-sectional view that shows one example of the weight port 40 that provides the capability of a weight 80 to be removably engageable with the sole 14. Other examples of removable weights 80 engageable with weight ports 40 are shown in, e.g., FIGS. 13H, 14H, and 15B, which are described more fully below. In some embodiments, a single weight port 40 and engageable weight 80 is provided, while in others, a plurality of weight ports 40 (e.g., two, three, four, or more) and engageable weights 80 are provided. The illustrated weight port 40 defines internal threads 46 that correspond to external threads formed on the weight 80. Weights and/or weight assemblies configured for weight ports in the sole can vary in mass from about 0.5 grams to about 10 grams, or from about 0.5 grams to about 20 grams.

Inclusion of one or more weights in the weight port(s) 40 provides a customizable club head mass distribution, and corresponding mass moments of inertia and center-of-gravity 50 locations. Adjusting the location of the weight port(s) 40 and the mass of the weights and/or weight assemblies provides various possible locations of center-of-gravity 50 and various possible mass moments of inertia using the same club head 2.

As discussed in more detail below, in some embodiments, a playable fairway wood club head can have a low, rearward center-of-gravity. Placing one or more weight ports 40 and weights 80 rearward in the sole as shown, for example, in FIG. 9, helps desirably locate the center-of-gravity. In the foregoing embodiments, a center of gravity of the weight 80 is preferably located rearward of a midline of the golf club head along the y-axis 75, such as, for example, within about 40 mm of the rear portion 32 of the club head, or within about 30 mm of the rear portion 32 of the club head, or within about 20 mm of the rear portion of the club head. In other embodiments shown, for example, in FIGS. 13-16, a playable fairway wood club head can have a center-of-gravity that is located to provide a preferable center-of-gravity projection on the striking surface 22 of the club head.

In those embodiments, one or more weight ports 40 and weights 80 are placed in the sole portion 14 forward of a midline of the golf club head along the y-axis 75. For example, in some embodiments, a center of gravity of one or more weights 80 placed in the sole portion 14 of the club head is located within about 30 mm of the nearest portion of the forward edge of the sole, such as within about 20 mm of the nearest portion of the forward edge of the sole, or within about 15 mm of the nearest portion of the forward edge of the sole, or within about 10 mm of the nearest portion of the forward edge of the sole. Although other methods (e.g., using internal weights attached using epoxy or hot-melt glue) of adjusting the center-of-gravity can be used, use of a weight port and/or integrally molding a discretionary weight into the body 10 of the club head reduces undesirable effects on the audible tone emitted during impact with a golf ball.

Club Head Height and Length

In addition to redistributing mass within a particular club head envelope as discussed immediately above, the club head center-of-gravity location 50 can also be tuned by modifying the club head external envelope. For example, the club head body 10 can be extended rearwardly, and the overall height can be reduced.

Referring now to FIG. 8, the club head 2 has a maximum club head height ($H_{ch}$) defined as the maximum above ground z-axis coordinate of the outer surface of the crown 12. Similarly, a maximum club head width ($W_{ch}$) can be defined as the distance between the maximum extents of the heel and toe portions 26, 28 of the body measured along an axis parallel to the x-axis when the club head 2 is at normal address position and a maximum club head depth ($D_{ch}$), or length, defined as the distance between the forwardmost and rearwardmost points on the surface of the body 10 measured along an axis parallel to the y-axis when the club head 2 is at normal address position. Generally, the height and width of club head 2 should be measured according to the USGA "Procedure for Measuring the Clubhead Size of Wood Clubs" Revision 1.0.

In some embodiments, the fairway wood golf club head 2 has a height ($H_{ch}$) less than approximately 55 mm. In some embodiments, the club head 2 has a height ($H_{ch}$) less than about 50 mm. For example, some implementations of the golf club head 2 have a height ($H_{ch}$) less than about 45 mm. In other implementations, the golf club head 2 has a height ($H_{ch}$) less than about 42 mm. Still other implementations of the golf club head 2 have a height ($H_{ch}$) less than about 40 mm.

Some examples of the golf club head 2 have a depth ($D_{ch}$) greater than approximately 75 mm. In some embodiments, the club head 2 has a depth ($D_{ch}$) greater than about 85 mm. For example, some implementations of the golf club head 2 have a depth ($D_{ch}$) greater than about 95 mm. In other implementations, as discussed in more detail below, the golf club head 2 can have a depth ($D_{ch}$) greater than about 100 mm.

Forgiveness of Fairway Woods

Golf club head "forgiveness" generally describes the ability of a club head to deliver a desirable golf ball trajectory despite a mis-hit (e.g., a ball struck at a location on the striking surface 22 other than the ideal impact location 23). As described above, large mass moments of inertia contribute to the overall forgiveness of a golf club head. In addition, a low center-of-gravity improves forgiveness for golf club heads used to strike a ball from the turf by giving a higher launch angle and a lower spin trajectory (which improves the distance of a fairway wood golf shot). Providing a rearward center-of-gravity reduces the likelihood of a slice or fade for many golfers. Accordingly, forgiveness of fairway wood club heads, such as the club head 2, can be improved using the techniques described above to achieve high moments of inertia and low center-of-gravity compared to conventional fairway wood golf club heads.

For example, a club head 2 with a crown thickness less than about 0.65 mm throughout at least about 70% of the crown can provide significant discretionary mass. A 0.60 mm thick crown can provide as much as about 8 grams of discretionary mass compared to a 0.80 mm thick crown. The large discretionary mass can be distributed to improve the mass moments of inertia and desirably locate the club head center-of-gravity. Generally, discretionary mass should be located sole-ward rather than crown-ward to maintain a low center-of-gravity, forward rather than rearward to maintain a forwardly positioned center of gravity, and rearward rather than forward to maintain a rearwardly positioned center-of-gravity. In addition, discretionary mass should be located far from the center-of-gravity and near the perimeter of the club head to maintain high mass moments of inertia.

For example, in some of the embodiments described herein, a comparatively forgiving golf club head 2 for a fairway wood can combine an overall club head height ($H_{ch}$) of less than about 46 mm and an above ground center-of-gravity location, Zup, less than about 19 mm. Some examples of the club head 2 provide an above ground center-of-gravity location, Zup, less than about 16 mm.

In addition, a thin crown 12 as described above provides sufficient discretionary mass to allow the club head 2 to have a volume less than about 240 $cm^3$ and/or a front to back depth ($D_{ch}$) greater than about 85 mm. Without a thin crown 12, a similarly sized golf club head would either be overweight or would have an undesirably located center-of-gravity because less discretionary mass would be available to tune the CG location.

In addition, in some embodiments of a comparatively forgiving golf club head 2, discretionary mass can be distributed to provide a mass moment of inertia about the CG z-axis 85, $I_{zz}$, greater than about 300 kg-$mm^2$. In some instances, the mass moment of inertia about the CG z-axis 85, $I_{zz}$, can be greater than about 320 kg-$mm^2$, such as greater than about 340 kg-$mm^2$ or greater than about 360 kg-$mm^2$. Distribution of the discretionary mass can also provide a mass moment of inertia about the CG x-axis 90, $I_{xx}$, greater than about 150 kg-$mm^2$. In some instances, the mass moment of inertia about the CG x-axis 85, $I_{xx}$, can be greater than about 170 kg-$mm^2$, such as greater than about 190 kg-$mm^2$.

Alternatively, some examples of a forgiving club head 2 combine an above ground center-of-gravity location, Zup, less than about 19 mm and a high moment of inertia about the CG z-axis 85, $I_{zz}$. In such club heads, the moment of inertia about the CG z-axis 85, $I_{zz}$, specified in units of kg-$mm^2$, together with the above ground center-of-gravity location, Zup, specified in units of millimeters (mm), can satisfy the relationship $$I_{zz} \geq 13 \cdot Zup + 105.$$

Alternatively, some forgiving fairway wood club heads have a moment of inertia about the CG z-axis 85, $I_{zz}$, and a moment of inertia about the CG x-axis 90, $I_{xx}$, specified in units of kg-$mm^2$, together with an above ground center-of-gravity location, Zup, specified in units of millimeters, that satisfy the relationship $$I_{xx} + I_{zz} \geq 20 \cdot Zup + 165.$$

As another alternative, a forgiving fairway wood club head can have a moment of inertia about the CG x-axis, $I_{xx}$, specified in units of kg-mm$^2$, and, an above ground center-of-gravity location, Zup, specified in units of millimeters, that together satisfy the relationship $$I_{xx} \geq 7 \cdot Zup + 60.$$

Coefficient of Restitution and Center of Gravity Projection

Another parameter that contributes to the forgiveness and successful playability and desirable performance of a golf club is the coefficient of restitution (COR) of the golf club head. Upon impact with a golf ball, the club head's face plate deflects and rebounds, thereby imparting energy to the struck golf ball. The club head's coefficient of restitution (COR) is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. In order to maximize the moment of inertia (MOI) about the center of gravity (CG) and achieve a high COR, it typically is desirable to incorporate thin walls and a thin face plate into the design of the club head. Thin walls afford the designers additional leeway in distributing club head mass to achieve desired mass distribution, and a thinner face plate may provide for a relatively higher COR.

Thus, thin walls are important to a club's performance. However, overly thin walls can adversely affect the club head's durability. Problems also arise from stresses distributed across the club head upon impact with the golf ball, particularly at junctions of club head components, such as the junction of the face plate with other club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the club head. Thus, these club heads fail to provide optimal MOI, CG, and/or COR parameters, and as a result, fail to provide much forgiveness for off-center hits for all but the most expert golfers.

In addition to the thickness of the face plate and the walls of the golf club head, the location of the center of gravity also has a significant effect on the COR of a golf club head. For example, a given golf club head having a given CG will have a projected center of gravity or "balance point" or "CG projection" that is determined by an imaginary line passing through the CG and oriented normal to the striking face 18. The location where the imaginary line intersects the striking face 18 is the CG projection, which is typically expressed as a distance above or below the center of the striking face 18. When the CG projection is well above the center of the face, impact efficiency, which is measured by COR, is not maximized. It has been discovered that a fairway wood with a relatively lower CG projection or a CG projection located at or near the ideal impact location on the striking surface of the club face, as described more fully below, improves the impact efficiency of the golf club head as well as initial ball speed. One important ball launch parameter, namely ball spin, is also improved.

The CG projection above centerface of a golf club head can be measured directly, or it can be calculated from several measurable properties of the club head. For example, using the measured value for the location of the center of gravity CG, one is able to measure the distance from the origin to the CG along the Y-axis ($CG_y$) and the distance from the origin along the Z-axis ($CG_z$). Using these values, and the loft angle 15 (see FIG. 2) of the club, the CG projection above centerface is determined according to the following formula:

$$CG_projection = [CGy - CGz * Tan(Loft)] * Sin(Loft) + CGz/Cos(Loft)$$

The foregoing equation provides positive values where the CG projection is located above the ideal impact location 23, and negative values where the CG projection is located below the ideal impact location 23.

Fairway wood shots typically involve impacts that occur below the center of the face, so ball speed and launch parameters are often less than ideal. This results because most fairway wood shots are from the ground and not from a tee, and most golfers have a tendency to hit their fairway wood ground shots low on the face of the club head. Maximum ball speed is typically achieved when the ball is struck at the location on the striking face where the COR is greatest.

Figure 20A:
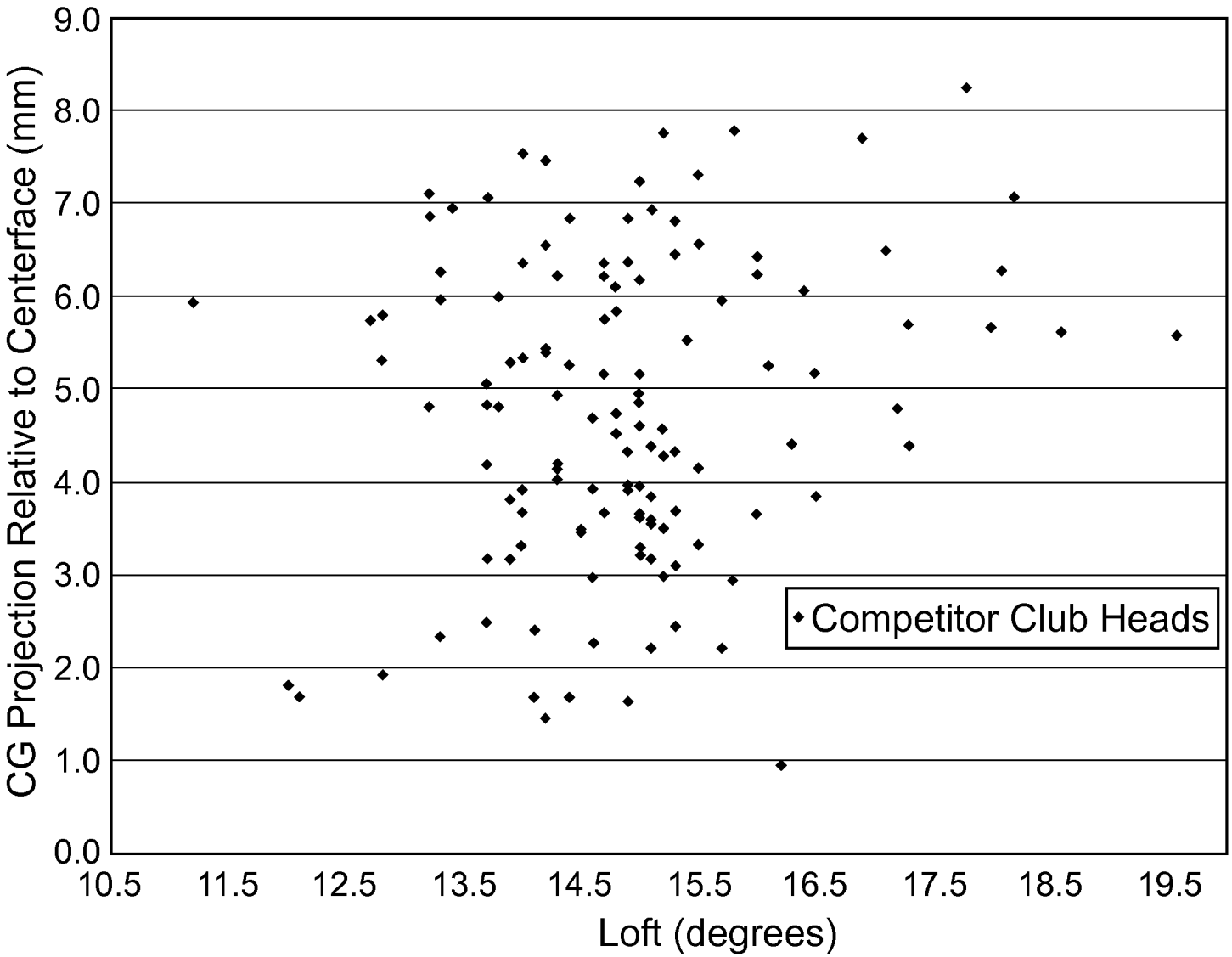
FIG. 20A is a plot of the a club head's center of gravity projection, measured in distance above the center of its face plate, versus the loft angle of the club head for a large collection of golf club heads of different manufacturers.

For traditionally designed fairway woods, the location where the COR is greatest is the same as the location of the CG projection on the striking surface. This location, however, is generally higher on the striking surface than the below center location of typical ball impacts during play. For example, FIG. 20A shows a plot of the golf club head CG projection, measured in distance above the center of its face plate, versus the loft angle of the club head for a large collection of commercially available fairway wood golf club heads of several golf club manufacturers. As shown in FIG. 20A, all of the commercially available fairway wood golf club heads represented on the graph include a center of gravity projection that is at least 1.0 mm above the center of the face of the golf club head, with most of these golf clubs including a center of gravity projection that is 2.0 mm or more above the center of the face of the golf club head.

In contrast to these conventional golf clubs, it has been discovered that greater shot distance is achieved by configuring the club head to have a CG projection that is located near to the center of the striking surface of the golf club head. Table 20B shows a plot of the golf club head CG projection versus the loft angle of the club head for several embodiments of the inventive golf clubs described herein. In some embodiments, the golf club head 2 has a CG projection that is less than about 2.0 mm from the center of the striking surface of the golf club head, i.e., −2.0 mm<CG projection<2.0 mm. For example, some implementations of the golf club head 2 have a CG projection that is less than about 1.0 mm from the center of the striking surface of the golf club head (i.e., −1.0 mm<CG projection<1.0 mm), such as about 0.7 mm or less from the center of the striking surface of the golf club head (i.e., −0.7 mm<CG projection<0.7 mm), or such as about 0.5 mm or less from the center of the striking surface of the golf club head (i.e., −0.5 mm<CG projection<0.5 mm).

In other embodiments, the golf club head 2 has a CG projection that is less than about 2.0 mm (i.e., the CG projection is below about 2.0 mm above the center of the striking surface), such as less than about 1.0 mm (i.e., the CG projection is below about 1.0 mm above the center of the striking surface), or less than about 0.0 mm (i.e., the CG projection is below the center of the striking surface), or less than about −1.0 mm (i.e., the CG projection is below about 1.0 mm below the center of the striking surface). In each of these embodiments, the CG projection is located above the bottom of the striking surface.

In still other embodiments, an optimal location of the CG projection is related to the loft 15 of the golf club head. For example, in some embodiments, the golf club head 2 has a CG projection of about 3 mm or less above the center of the striking surface for club heads where the loft angle is at least 15.8 degrees. Similarly, greater shot distance is achieved if the CG projection is about 1.4 mm or less above the center of the striking surface for club heads where the loft angle is less than 15.8 degrees. In still other embodiments, the golf club head 2 has a CG projection that is below about 3 mm above the center of the striking surface for club heads where the loft angle 15 is more than about 16.2 degrees, and has a CG projection that is below about 2.0 mm above the center of the striking surface for club heads where the loft angle 15 is 16.2 degrees or less. In still other embodiments, the golf club head 2 has a CG projection that is below about 3 mm above the center of the striking surface for golf club heads where the loft angle 15 is more than about 16.2 degrees, and has a CG projection that is below about 1.0 mm above the center of the striking surface for club heads where the loft angle 15 is 16.2 degrees or less. In still other embodiments, the golf club head 2 has a CG projection that is below about 3 mm above the center of the striking surface for golf club heads where the loft angle 15 is more than about 16.2 degrees, and has a CG projection that is below about 1.0 mm above the center of the striking surface for club heads where the loft angle 15 is between about 14.5 degrees and about 16.2 degrees. In all of the foregoing embodiments, the CG projection is located above the bottom of the striking surface. Further, greater initial ball speeds and lower backspin rates are achieved with the lower CG projections.

Figure 21A:
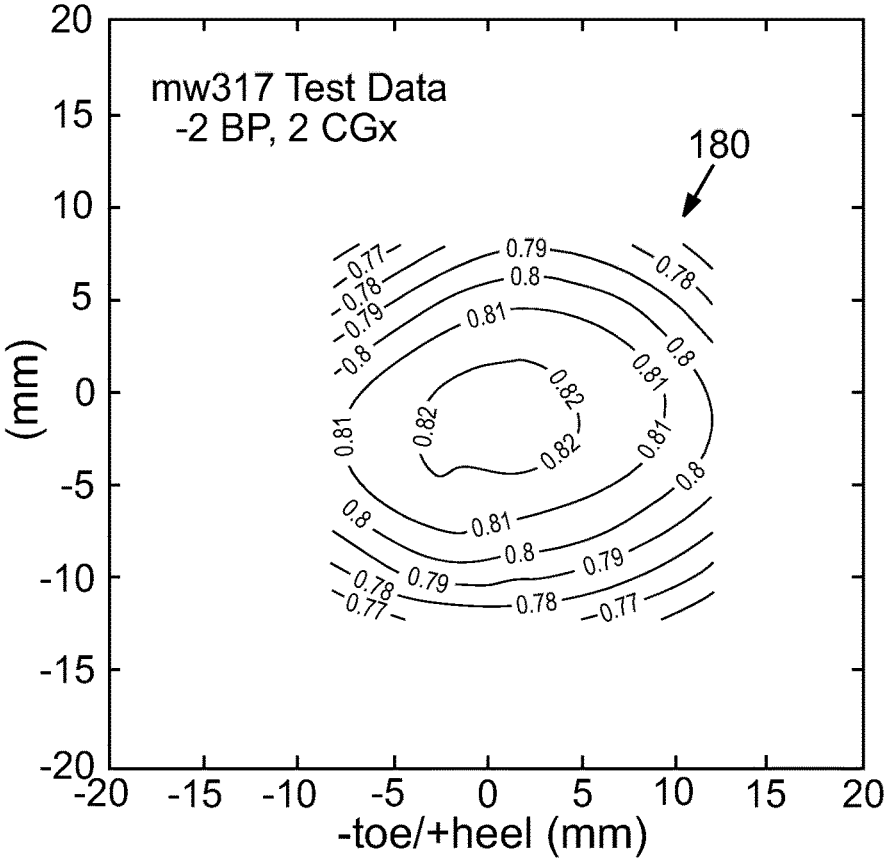
FIG. 21A is a contour plot of a first golf club head having a high coefficient of restitution (COR) approximately aligned with the center of its striking face.

For otherwise similar golf club heads, it was found that locating the CG projection nearer to the center of the striking surface increases the COR of the golf club head as well as the ball speed values for balls struck by the golf club head. For example, FIG. 21A is a contour plot of COR values for a high COR fairway wood golf club head 180 having its CG projection near the center of the striking surface. Specifically, the CG projection is 2 mm below (−2 mm in the z direction) the center of the face and 2 mm toward the heel from the center of the face (+2 mm in the x direction). The golf club head 180 has a loft of 16 degrees. The contour plot was constructed from 17 individual data points with the curves being fit to show regions having the same COR values. The area demarcated by the 0.82 COR line includes the point 0 mm, 0 mm, which is the center of the striking face, Thus, the highest COR region is approximately aligned with the center of the striking face of the golf club head 180. The highest COR value for the golf club head 180 is 0.825. Also, the area demarcated by the 0.81 COR line is large and shows that satisfactorily high COR is achieved over a sizable portion of the striking face.

Figure 21B:
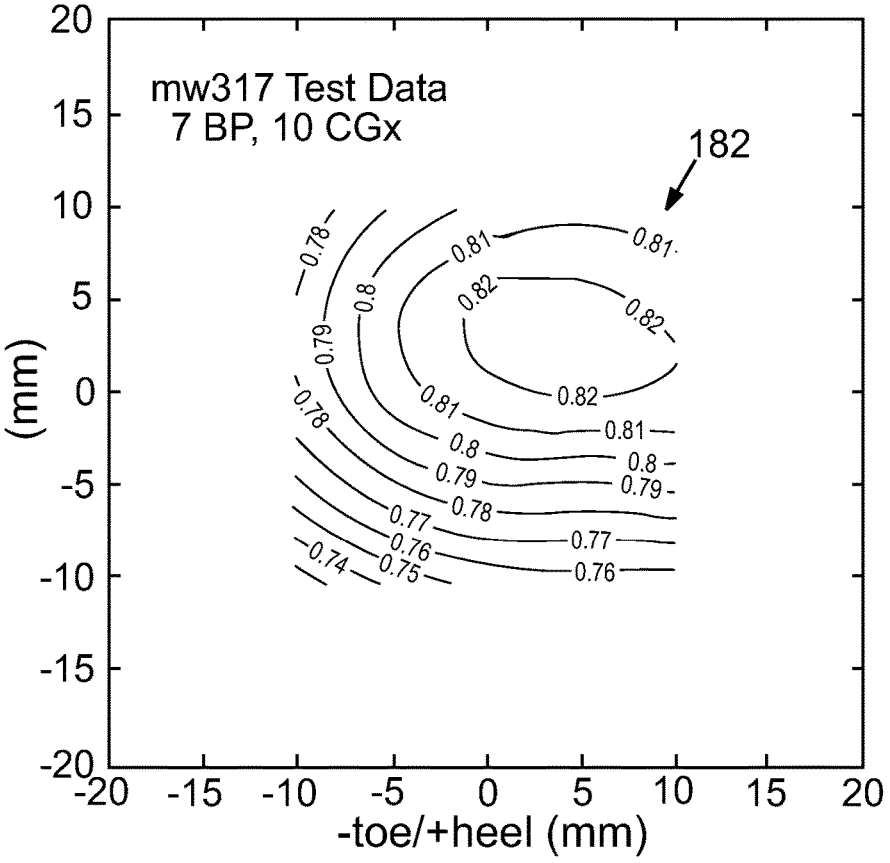
FIG. 21B is a contour plot of a second golf club head having a slightly lower COR and a highest COR zone that is not aligned with the center of its striking face.

FIG. 21B is a contour plot similar to FIG. 21A, except showing COR values for a comparative example high COR fairway wood golf club head 182. For the comparative example fairway wood golf club head 182, the CG projection is 7 mm above center (+7 mm in the z direction) and 10 mm toward the heel (+10 mm in the x direction). The comparative example golf club head 182 also has a loft of 16 degrees. By comparison to FIG. 21A, it can be seen that the center of the striking face (0 mm, 0 mm) for the comparative example golf club head 182 is not within the highest COR region, which means this desirable area of the striking face will be underutilized.

Figure 22A:
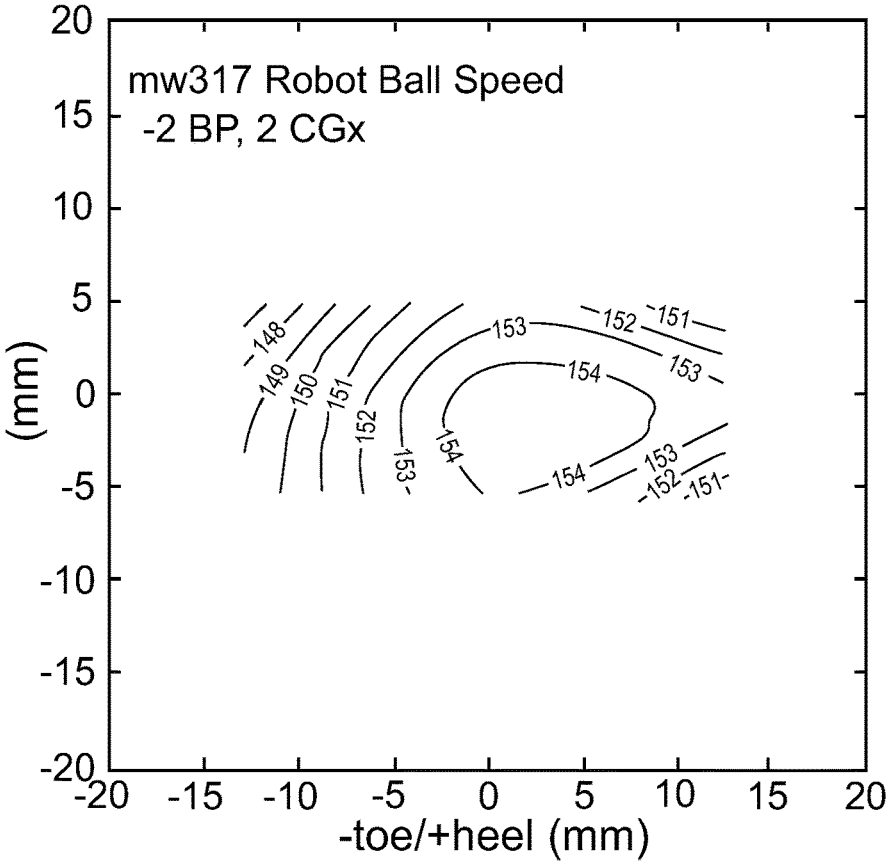
FIG. 22A is a contour plot of the first golf club head having a high resulting ball speed area that is approximately aligned with the center of the striking face.

FIG. 22A is a contour plot for the same golf club head 180 discussed above in relation to FIG. 21A, showing ball speed values for balls struck by the golf club head in the region of the center of the striking face. Nine points were used to generate the curves of FIGS. 22A and 22B. A maximum ball speed of 154.5 mph is achieved at a point within the 154 mph contour line, which as seen in FIG. 22A desirably contains the 0 mm, 0 mm center point.

Figure 22B:
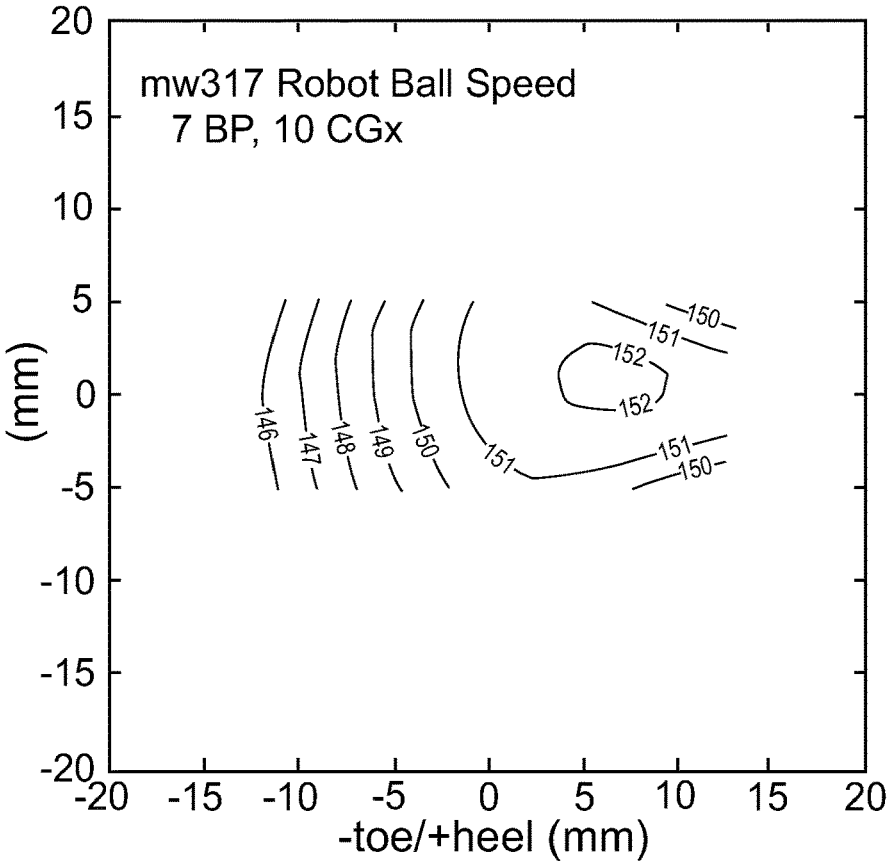
FIG. 22B is a contour plot of the second golf club head having a slightly lower high resulting ball speed area that is not aligned with the center of the striking face.

FIG. 22B is similar to FIG. 22A, but shows ball speed for balls struck by the comparative example golf club head 182 discussed above in relation to FIG. 21B. A maximum ball speed of 151.8 mph is achieved, but only in a region that is spaced away from the center of the face. Comparing FIG. 22A to FIG. 22B, the golf club head 180 yields higher ball speeds and has a larger sweet spot than the golf club head 182. If the comparative example golf club head 182 is struck on center, which is typically the golfer's goal, the golfer will miss out on the portion of the striking surface that can generate the highest ball speed.

Increased Striking Face Flexibility

It is known that the coefficient of restitution (COR) of a golf club may be increased by increasing the height $H_{ss}$ of the striking face 18 and/or by decreasing the thickness of the striking face 18 of a golf club head 2. However, in the case of a fairway wood, hybrid, or rescue golf club, increasing the face height may be considered undesirable because doing so will potentially cause an undesirable change to the mass properties of the golf club (e.g., center of gravity location) and to the golf club's appearance.

FIGS. 12-18 show golf club heads that provide increased COR by increasing or enhancing the perimeter flexibility of the striking face 18 of the golf club without necessarily increasing the height or decreasing the thickness of the striking face 18. For example, FIG. 12A is a side sectional view in elevation of a club head 200*a* having a high COR. Near the face plate 18, a channel 212*a* is formed in the sole 14. A mass pad 210*a* is separated from and positioned rearward of the channel 212*a*. The channel 212*a* has a substantial height (or depth), e.g., at least 20% of the club head height, $H_{CH}$, such as, for example, at least about 23%, or at least about 25%, or at least about 28% of the club head height $H_{CH}$. In the illustrated embodiment, the height of the channel 212*a* is about 30% of the club head height. In addition, the channel 212*a* has a substantial dimension (or width) in the y direction.

Figures 12A, 12B, 12C, 12D, 12E:
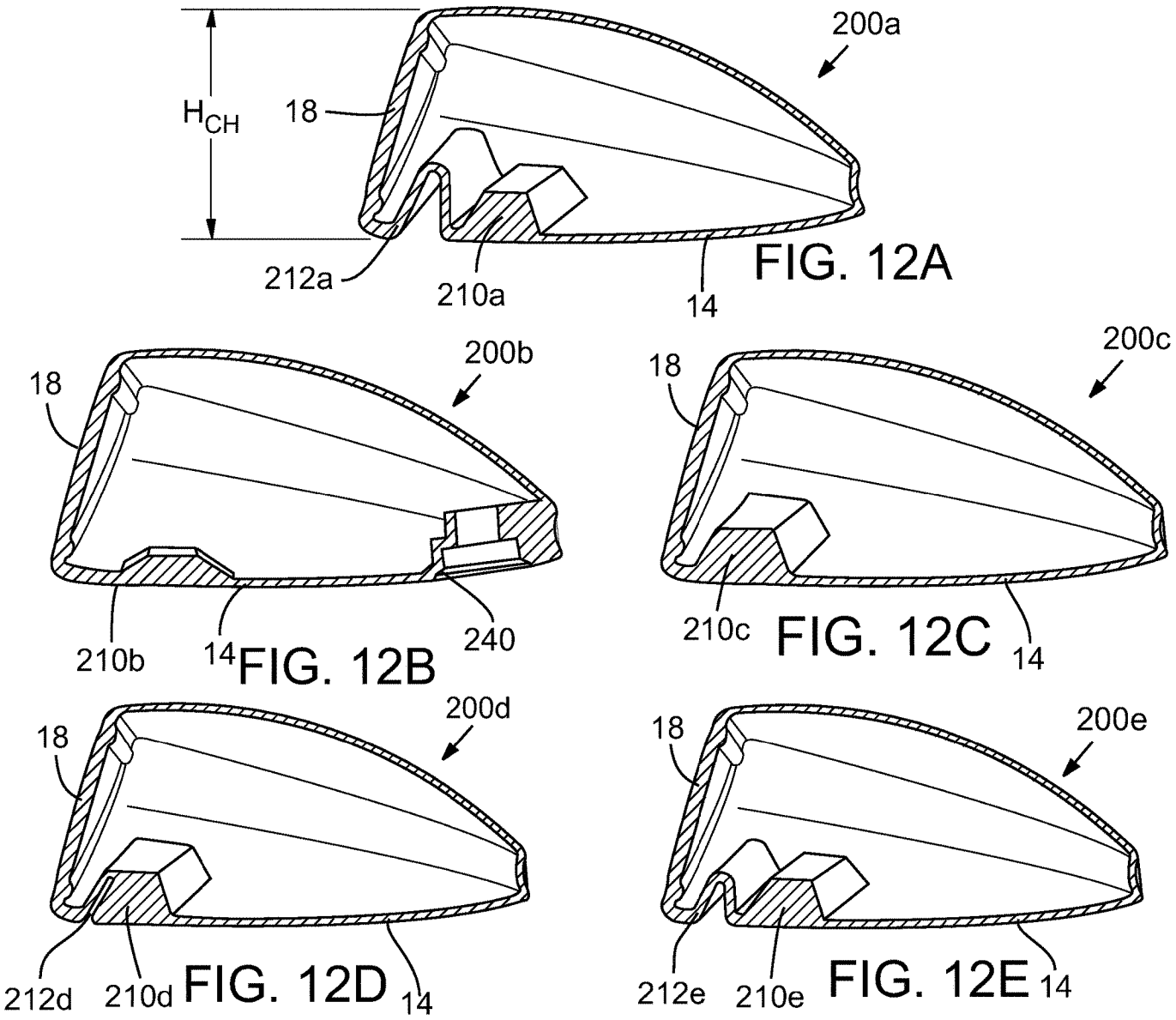
FIG. 12A is a side sectional view in elevation of a golf club head having a channel formed in the sole and a mass pad positioned rearwardly of the channel.
FIGS. 12B-E are side sectional views in elevation of golf club heads having mass pads mounted to the sole in different configurations and in some cases, a channel formed in the sole.

As seen in FIG. 12A, the cross section of the channel 212*a* is a generally inverted V. In some embodiments, the mouth of the channel has a width of from about 3 mm to about 11 mm, such as about 5 mm to about 9 mm, such as about 7 mm in the Y direction (from the front to the rear) and has a length of from about 50 mm to about 110 mm, such as about 65 mm to about 95 mm, such as about 80 mm in the X direction (from the heel to the toe). The front portion of the sole in which the channel is formed may have a thickness of about 1.25-2.3 mm, for example about 1.4-1.8 mm. The configuration of the channel 212*a* and its position near the face plate 18 allows the face plate to undergo more deformation while striking a ball than a comparable club head without the channel 212*a*, thereby increasing both COR and the speed of golf balls struck by the golf club head. Too much deformation, however, can detract from performance. By positioning the mass pad 210*a* rearward of the channel 212*a*, as shown in the embodiment shown in FIG. 12A, the deformation is localized in the area of the channel, since the club head is much stiffer in the area of the mass pad 210*a*. As a result, the ball speed after impact is greater for the club head 200*a* than for a conventional club head, which results in a higher COR.

FIGS. 12B-12E are side sectional views in elevation similar to FIG. 12A and showing several additional examples of club head configurations. The illustrated golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Representative COR and stress values for the modeled golf club heads were determined and allow for a qualitative comparison among the illustrated club head configurations.

In the club head 200*b* embodiment shown in FIG. 12B, a mass pad 210*b* is positioned on the sole 14 and the resulting COR is the lowest of the five club head configurations in FIGS. 12A-12E. In the club head 200*c* embodiment shown in FIG. 12C, a mass pad 210*c* that is larger than the mass pad 210*b* is positioned on the sole 14 in a more forward location in the club head than the position of the mass pad 210*b* in the FIG. 13B embodiment. The resulting COR for the club head 200*c* is higher than the COR for the club head 200*b*. By moving the mass forward, the CG is also moved forward. As a result, the projection of the CG on the striking face 18 is moved downward, i.e., it is at a lower height, for the club head 200*c* compared to the club head 200*b*.

In the club head 200*d* shown in FIG. 12D, the mass pad 210*d* is positioned forwardly, similar to the mass pad 210*c* in the club head 200*c* shown in FIG. 12C. A channel or gap 212*d* is located between a forward edge of the mass pad 210*d* and the surrounding material of the sole 14, e.g., because of the fit in some implementations between the added mass and a channel in the sole, as is described below in greater detail. The resulting COR in the club head 200*d* is higher than the club head 200*b* or 200*c*.

In the club head 210*e* shown in FIG. 12E, the club head 200*e* has a dedicated channel 212*e* in the sole, similar to the channel 212*a* in the club head 200*a*, except shorter in height. The resulting COR in the club head 200*d* is higher than for the club head 200*c* but lower than for the club head 200*a*. The maximum stress values created in the areas of the channels 212*a* and 212*e* while striking a golf ball for the club heads 210*a*, 210*e* are lower than for the club head 200*d*, in part because the geometry of the channels 212*a*, 212*e* is much smoother and with fewer sharp corners than the channel 210*d*, and because the channel 210*d* has a different configuration (it is defined by a thinner wall on the forward side and the mass pad on the rearward side).

Additional golf club head embodiments are shown in FIGS. 13A-H, 14A-H, 15A-B, and 16A-C. Like the examples shown in FIGS. 12A-E, the illustrated golf club heads provide increased COR by increasing or enhancing the perimeter flexibility of the striking face 18 of the golf club. For example, FIGS. 13A-H show a golf club head 2 that includes a channel 212 extending over a portion of the sole 14 of the golf club head 2 in the forward portion of the sole 14 adjacent to or near the striking face 18. The location, shape, and size of the channel 212 provides an increased or enhanced flexibility to the striking face 18, which leads to increased COR and characteristic time ("CT").

Turning to FIGS. 13A-H, an embodiment of a golf club head 2 includes a hollow body 10 defining a crown portion 12, a sole portion 14, and a skirt portion 16. A striking face 18 is provided on the forward-facing portion of the body 10. The body 10 can include a hosel 20, which defines a hosel bore 24 adapted to receive a golf club shaft. The body 10 further includes a heel portion 26, toe portion 28, a front portion 30, and a rear portion 32.

The club head 2 has a channel 212 located in a forward position of the sole 14, near or adjacent to the striking face 18. The channel 212 extends into the interior of the club head body 10 and has an inverted "V" shape defined by a heel channel wall 214, a toe channel wall 216, a rear channel wall 218, a front channel wall 220, and an upper channel wall 222. In the embodiment shown, the upper channel wall 222 is semi-circular in shape, defining an inner radius $R_{gi}$ and outer radius $R_{go}$, extending between and joining the rear channel wall 218 and front channel wall 220. In other embodiments, the upper channel wall 222 may be square or another shape. In still other embodiments, the rear channel wall 218 and front channel wall 220 simply intersect in the absence of an upper channel wall 222.

The channel 212 has a length $L_g$ along its heel-to-toe orientation, a width $W_g$ defined by the distance between the rear channel wall 218 and the front channel wall 220, and a depth $D_g$ defined by the distance from the outer surface of the sole portion 14 at the mouth of the channel 212 to the uppermost extent of the upper channel wall 222. In the embodiment shown, the channel has a length $L_g$ of from about 50 mm to about 90 mm, or about 60 mm to about 80 mm. Alternatively, the length $L_g$ of the channel can be defined relative to the width of the striking surface $W_{ss}$. For example, in some embodiments, the length of the channel $L_g$ is from about 80% to about 120%, or about 90% to about 110%, or about 100% of the width of the striking surface $W_{ss}$. In the embodiment shown, the channel width Wg at the mouth of the channel can be from about 3.5 mm to about 8.0 mm, such as from about 4.5 mm to about 6.5 mm, and the channel depth Dg can be from about 10 mm to about 13 mm.

The rear channel wall 218 and front channel wall 220 define a channel angle β therebetween. In some embodiments, the channel angle β can be between about 10° to about 30°, such as about 13° to about 28°, or about 13° to about 22°. In some embodiments, the rear channel wall 218 extends substantially perpendicular to the ground plane when the club head 2 is in the normal address position, i.e., substantially parallel to the z-axis 65. In still other embodiments, the front channel wall 220 defines a surface that is substantially parallel to the striking face 18, i.e., the front channel wall 220 is inclined relative to a vector normal to the ground plane (when the club head 2 is in the normal address position) by an angle that is within about ±5° of the loft angle 15, such as within about ±3° of the loft angle 15, or within about ±1° of the loft angle 15.

In the embodiment shown, the heel channel wall 214, toe channel wall 216, rear channel wall 218, and front channel wall 220 each have a thickness 221 of from about 0.7 mm to about 1.5 mm, e.g., from about 0.8 mm to about 1.3 mm, or from about 0.9 mm to about 1.1 mm. Also, in the embodiment shown, the upper channel wall outer radius $R_{go}$ is from about 1.5 mm to about 2.5 mm, e.g., from about 1.8 mm to about 2.2 mm, and the upper channel wall inner radius $R_{gi}$ is from about 0.8 mm to about 1.2 mm, e.g., from about 0.9 mm to about 1.1 mm.

A weight port 40 is located on the sole portion 14 of the golf club head 2, and is located adjacent to and rearward of the channel 212. As described previously in relation to FIG.

9, the weight port 40 can have any of a number of various configurations to receive and retain any of a number of weights or weight assemblies, such as described in U.S. Pat. Nos. 7,407,447 and 7,419,441, which are incorporated herein by reference. For example, FIGS. 13E-H show an example of a weight port 40 that provides the capability of a weight 80 to be removably engageable with the sole 14. The illustrated weight port 40 defines internal threads 46 that correspond to external threads formed on the weight 80. Weights and/or weight assemblies configured for weight ports in the sole can vary in mass from about 0.5 grams to about 10 grams, or from about 0.5 grams to about 20 grams. In an embodiment, the body 10 of the golf club head shown in FIGS. 13A-H is constructed primarily of stainless steel (e.g., 304, 410, 450, or 455 stainless steel) and the golf club head 2 includes a single weight 80 having a mass of approximately 0.9 g. Inclusion of the weight 80 in the weight port 40 provides a customizable club head mass distribution, and corresponding mass moments of inertia and center-of-gravity 50 locations.

In the embodiment shown, the weight port 40 is located adjacent to and rearward of the rear channel wall 218. One or more mass pads 210 may also be located in a forward position on the sole 14 of the golf club head 2, continguous with both the rear channel wall 218 and the weight port 40, as shown. As discussed above, the configuration of the channel 212 and its position near the face plate 18 allows the face plate to undergo more deformation while striking a ball than a comparable club head without the channel 212, thereby increasing both COR and the speed of golf balls struck by the golf club head. By positioning the mass pad 210 rearward of the channel 212, the deformation is localized in the area of the channel 212, since the club head is much stiffer in the area of the mass pad 210. As a result, the ball speed after impact is greater for the club head having the channel 212 and mass pad 210 than for a conventional club head, which results in a higher COR.

Turning next to FIGS. 14A-H, another embodiment of a golf club head 2 includes a hollow body 10 defining a crown portion 12, a sole portion 14, and a skirt portion 16. A striking face 18 is provided on the forward-facing portion of the body 10. The body 10 can include a hosel 20, which defines a hosel bore 24 adapted to receive a golf club shaft. The body 10 further includes a heel portion 26, toe portion 28, a front portion 30, and a rear portion 32.

The club head 2 has a channel 212 located in a forward position of the sole 14, near or adjacent to the striking face 18. The channel 212 extends into the interior of the club head body 10 and has an inverted "V" shape defined by a heel channel wall 214, a toe channel wall 216, a rear channel wall 218, a front channel wall 220, and an upper channel wall 222. In the embodiment shown, the upper channel wall 222 is semi-circular in shape, defining an inner radius $R_{gi}$ and outer radius $R_{go}$, extending between and joining the rear channel wall 218 and front channel wall 220. In other embodiments, the upper channel wall 222 may be square or another shape. In still other embodiments, the rear channel wall 218 and front channel wall 220 simply intersect in the absence of an upper channel wall 222.

The channel 212 has a length $L_g$ along its heel-to-toe orientation, a width $W_g$ defined by the distance between the rear channel wall 218 and the front channel wall 220, and a depth $D_g$ defined by the distance from the outer surface of the sole portion 14 at the mouth of the channel 212 to the uppermost extent of the upper channel wall 222. In the embodiment shown, the channel has a length $L_g$ of from about 50 mm to about 90 mm, or about 60 mm to about 80 mm. Alternatively, the length $L_g$ of the channel can be defined relative to the width of the striking surface $W_{ss}$. For example, in some embodiments, the length of the channel $L_g$ is from about 80% to about 120%, or about 90% to about 110%, or about 100% of the width of the striking surface $W_{ss}$. In the embodiment shown, the channel width Wg at the mouth of the channel can be from about 3.5 mm to about 8.0 mm, such as from about 4.5 mm to about 6.5 mm, and the channel depth Dg can be from about 10 mm to about 13 mm.

The rear channel wall 218 and front channel wall 220 define a channel angle β therebetween. In some embodiments, the channel angle β can be between about 10° to about 40°, such as about 16° to about 34°, or about 16° to about 30°. In some embodiments, the rear channel wall 218 extends substantially perpendicular to the ground plane when the club head 2 is in the normal address position, i.e., substantially parallel to the z-axis 65. In other embodiments, such as shown in FIGS. 14A-H, the rear channel wall 218 is inclined toward the forward end of the club head by an angle of about 1° to about 30°, such as between about 5° to about 25°, or about 10° to about 20°. In still other embodiments, the front channel wall 220 defines a surface that is substantially parallel to the striking face 18, i.e., the front channel wall 220 is inclined relative to a vector normal to the ground plane (when the club head 2 is in the normal address position) by an angle that is within about ±5° of the loft angle 15, such as within about ±3° of the loft angle 15, or within about ±1° of the loft angle 15. In the embodiment shown, the heel channel wall 214, toe channel wall 216, rear channel wall 218, and front channel wall 220 each have a thickness of from about 0.7 mm to about 1.5 mm, e.g., from about 0.8 mm to about 1.3 mm, or from about 0.9 mm to about 1.1 mm. Also, in the embodiment shown, the upper channel wall outer radius $R_{go}$ is from about 1.5 mm to about 2.5 mm, e.g., from about 1.8 mm to about 2.2 mm, and the upper channel wall inner radius $R_{gi}$ is from about 0.8 mm to about 1.2 mm, e.g., from about 0.9 mm to about 1.1 mm.

A plurality of weight ports 40—three are included in the embodiment shown—are located on the sole portion 14 of the golf club head 2, and are located adjacent to and rearward of the channel 212. As described previously in relation to FIG. 9, the weight ports 40 can have any of a number of various configurations to receive and retain any of a number of weights or weight assemblies, such as described in U.S. Pat. Nos. 7,407,447 and 7,419,441, which are incorporated herein by reference. For example, FIGS. 14A-H show examples of weight ports 40 that each provide the capability of a weight 80 to be removably engageable with the sole 14. The illustrated weight ports each 40 define internal threads 46 that correspond to external threads formed on the weights 80. Weights and/or weight assemblies configured for weight ports in the sole can vary in mass from about 0.5 grams to about 10 grams, or from about 0.5 grams to about 20 grams. In an embodiment, the golf club head 2 shown in FIGS. 14A-H has a body 10 formed primarily of a titanium alloy (e.g., 3-2.5, 6-4, SP700, 15-3-3-3, 10-2-3, or other alpha/near alpha, alpha-beta, and beta/near beta titanium alloys), and includes three tungsten weights 80 each having a density of approximately 15 g/cc and a mass of approximately 18 g. Inclusion of the weights 80 in the weight ports 40 provides a customizable club head mass distribution, and corresponding mass moments of inertia and center-of-gravity 50 locations.

In the embodiment shown, the weight ports 40 are located adjacent to and rearward of the rear channel wall 218. The weight ports 40 are separated from the rear channel wall 218 by a distance of approximately 1 mm to about 5 mm, such as about 1.5 mm to about 3 mm. As discussed above, the configuration of the channel 212 and its position near the face plate 18 allows the face plate to undergo more deformation while striking a ball than a comparable club head without the channel 212, thereby increasing both COR and the speed of golf balls struck by the golf club head. As a result, the ball speed after impact is greater for the club head having the channel 212 than for a conventional club head, which results in a higher COR.

In FIGS. 15A-B and 16A-C, additional golf club head 2 embodiments include a slot 312 formed in the sole 14, rather than the channel 212 shown in FIGS. 13A-H and 14A-H. The slot 312 is located in a forward position of the sole 14, near or adjacent to the striking face 18. For example, in some embodiments a forwardmost portion of the forward edge of the slot 312 is located within about 20 mm from the forward edge of the sole 14, such as within about 15 mm from the forward edge of the sole 14, or within about 10 mm from the forward edge of the sole 14, or within about 5 mm from the forward edge of the sole 14, or within about 3 mm from the forward edge of the sole 14.

In some embodiments, the slot 312 has a substantially constant width $W_g$, and the slot 312 is defined by a radius of curvature for each of the forward edge and rearward edge of the slot 312. In some embodiments, the radius of curvature of the forward edge of the slot 312 is substantially the same as the radius of curvature of the forward edge of the sole 14. In other embodiments, the radius of curvature of each of the forward and rearward edges of the slot 312 is from about 15 mm to about 90 mm, such as from about 20 mm to about 70 mm, such as from about 30 mm to about 60 mm. In still other embodiments, the slot width $W_g$ changes at different locations along the length of the slot 312.

The slot 312 comprises an opening in the sole 14 that provides access into the interior cavity of the body 10 of the club head. As discussed above, the configuration of the slot 312 and its position near the face plate 18 allows the face plate to undergo more deformation while striking a ball than a comparable club head without the slot 312, thereby increasing both COR and the speed of golf balls struck by the golf club head. In some embodiments, the slot 312 may be covered or filled with a polymeric or other material to prevent grass, dirt, moisture, or other materials from entering the interior cavity of the body 10 of the club head.

Figure 15A:
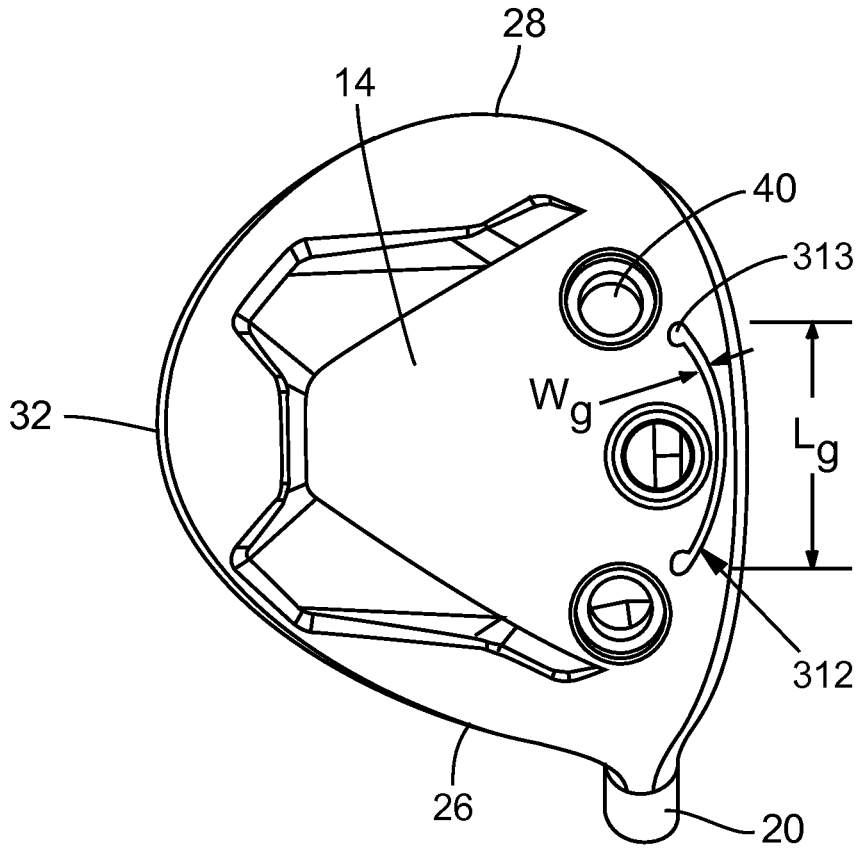
FIG. 15A is a bottom elevation view of another embodiment of a golf club head.
Figure 15B:
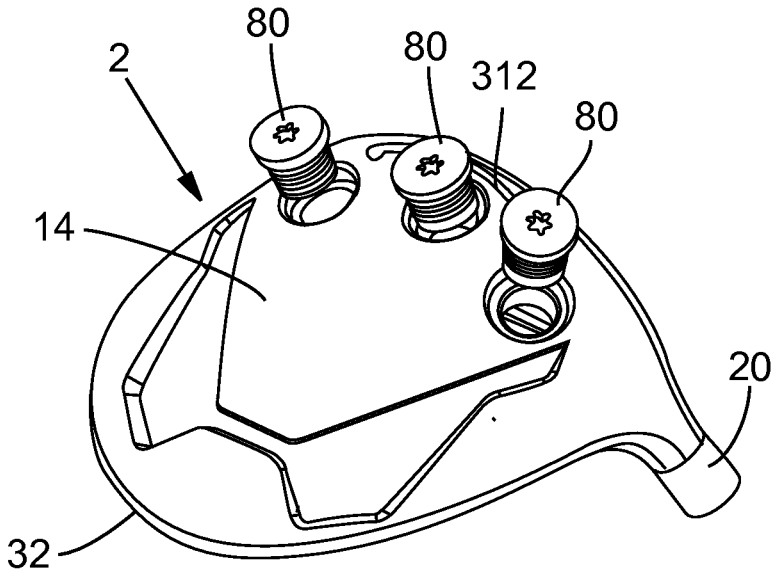
FIG. 15B is a bottom perspective view from a heel side of the golf club head of FIG. 15A, showing a plurality of weights in relation to a plurality of weight ports.

In the embodiment shown in FIGS. 15A-B, the slot 312 includes enlarged, rounded terminal ends 313 at both the toe and heel ends of the slot 312. The rounded terminal ends 313 reduce the stress incurred in the portions of the club head near the terminal ends of the slot 312, thereby enhancing the flexibility and durability of the slot 312.

The slot 312 formed in the sole of the club head embodiment shown in FIGS. 15A-B has a length $L_g$ along its heel-to-toe orientation, and a substantially constant width $W_g$. In some embodiments, the length $L_g$ of the slot can range from about 25 mm to about 70 mm, such as from about 30 mm to about 60 mm, or from about 35 mm to about 50 mm. Alternatively, the length $L_g$ of the slot can be defined relative to the width of the striking surface $W_{ss}$. For example, in some embodiments, the length $L_g$ of the slot is from about 25% to about 95% of the width of the striking surface $W_{ss}$, such as from about 40% to about 70% of the width of the striking surface $W_{ss}$. In the embodiment shown, the slot width $W_g$ can be from about 1 mm to about 5 mm, such as from about 2 mm to about 4 mm. In the illustrated embodiment, the rounded terminal ends 313 of the slot defines a diameter of from about 2 mm to about 4 mm.

In the embodiment shown in FIGS. 15A-B, the forward and rearward edges of the slot 312 each define a radius of curvature, with each of the forward and rearward edges of the slot having a radius of curvature of about 65 mm. In the embodiment shown, the slot 312 has a width $W_g$ of about 1.20 mm.

A plurality of weight ports 40—three are included in the embodiment shown—are located on the sole portion 14 of the golf club head 2. A center weight port is located between a toe-side weight port and a heel-side weight port and is located adjacent to and rearward of the channel 312. As described previously in relation to FIG. 9, the weight ports 40 can have any of a number of various configurations to receive and retain any of a number of weights or weight assemblies, such as described in U.S. Pat. Nos. 7,407,447 and 7,419,441, which are incorporated herein by reference. For example, FIGS. 15A-B show examples of weight ports 40 that each provide the capability of a weight 80 to be removably engageable with the sole 14. The illustrated weight ports each 40 define internal threads 46 that correspond to external threads formed on the weights 80. Weights and/or weight assemblies configured for weight ports in the sole can vary in mass from about 0.5 grams to about 10 grams, or from about 0.5 grams to about 20 grams. In an embodiment, the golf club head 2 shown in FIGS. 15A-B has a body 10 formed primarily of a titanium alloy (e.g., 3-2.5, 6-4, SP700, 15-3-3-3, 10-2-3, or other alpha/near alpha, alpha-beta, and beta/near beta titanium alloys), and includes three tungsten weights 80 each having a density of approximately 15 g/cc and a mass of approximately 18 g. Inclusion of the weights 80 in the weight ports 40 provides a customizable club head mass distribution, and corresponding mass moments of inertia and center-of-gravity 50 locations.

In the embodiment shown, the weight ports 40 are located adjacent to and rearward of the rear channel wall 218. The weight ports 40 are separated from the rear channel wall 218 by a distance of approximately 1 mm to about 5 mm, such as about 1.5 mm to about 3 mm. As discussed above, the configuration of the channel 212 and its position near the face plate 18 allows the face plate to undergo more deformation while striking a ball than a comparable club head without the channel 212, thereby increasing both COR and the speed of golf balls struck by the golf club head. As a result, the ball speed after impact is greater for the club head having the channel 212 than for a conventional club head, which results in a higher COR.

Figure 16A:
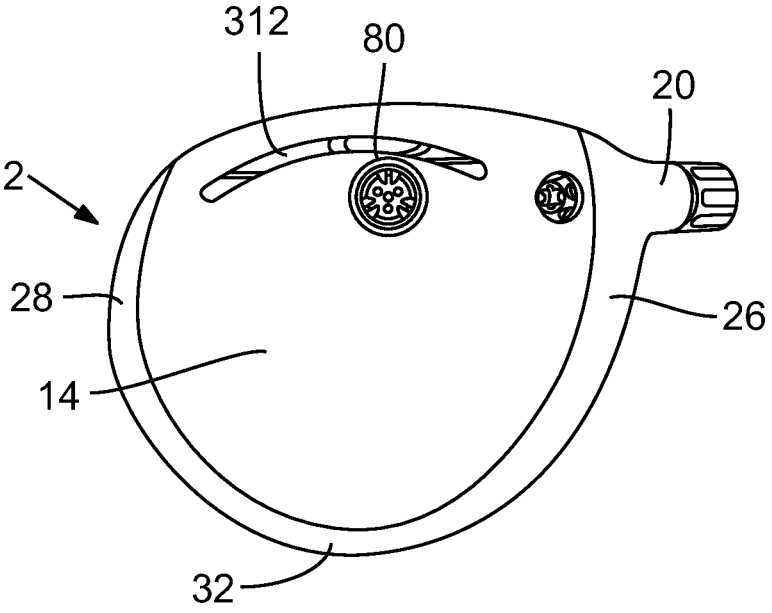
FIG. 16A is a bottom elevation view of another embodiment of a golf club head.
Figure 16B:
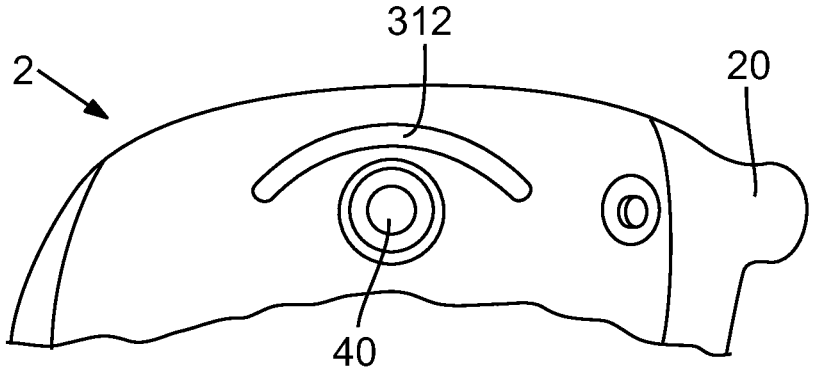
FIG. 16B is a bottom elevation view of a portion of another embodiment of a golf club head.
Figure 16C:
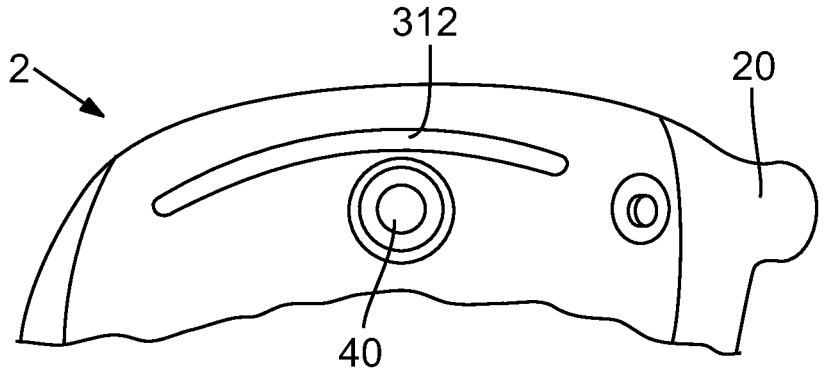
FIG. 16C is a bottom elevation view of a portion of another embodiment of a golf club head.

Three additional embodiments of golf club heads 2 each having a slot 312 formed on the sole 14 near the face plate 18 are shown in FIGS. 16A-C. Each of these additional embodiments includes a slot 312 that does not include the enlarged, rounded terminal ends 313 of the FIG. 15A-B embodiments, each instead having constant width, rounded terminal ends. In the embodiment shown in FIG. 16A, the slot 312 has a length Lg of about 56 mm, and a width Wg of about 3 mm. The forward edge of the slot 312 is defined by a radius of curvature of about 53 mm, while the rearward edge of the slot 312 is defined by a radius of curvature of about 50 mm. In the embodiment shown in FIG. 16B, the slot 312 has a length Lg of about 40 mm, and a width Wg of about 3 mm. The forward edge of the slot 312 is defined by a radius of curvature of about 27 mm, while the rearward edge of the slot 312 is defined by a radius of curvature of about 24 mm. Finally, in the embodiment shown in FIG. 16C, the slot 312 has a length Lg of about 60.6 mm, and a width Wg of about 3 mm. The forward edge of the slot 312 is defined by a radius of curvature of about 69 mm, while the rearward edge of the slot 312 is defined by a radius of curvature of about 66 mm.

Mass Pads and High Density Weights

In the implementations shown in FIGS. 12A-E, discretionary mass is added to the golf club head on an interior side of the sole at a forward location. Thus, this location for added discretionary mass, alone or in conjunction with other locations, produces playable golf club head configurations, in addition to the rearward sole location described above.

Figure 17:
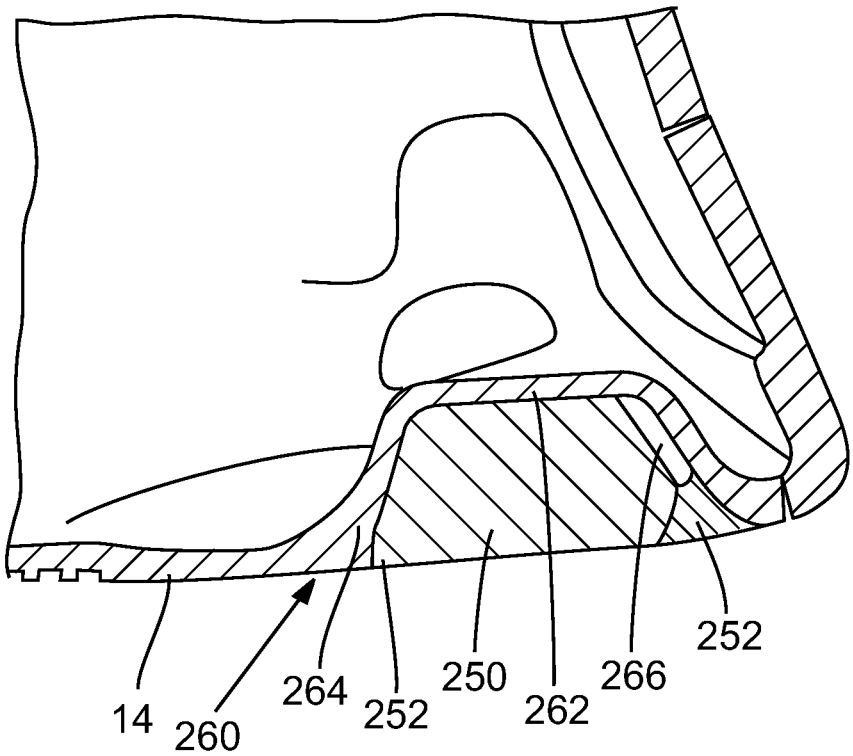
FIG. 17 is a partial side sectional view in elevation of a golf club head showing added weight secured to the sole by welding.
Figure 18:
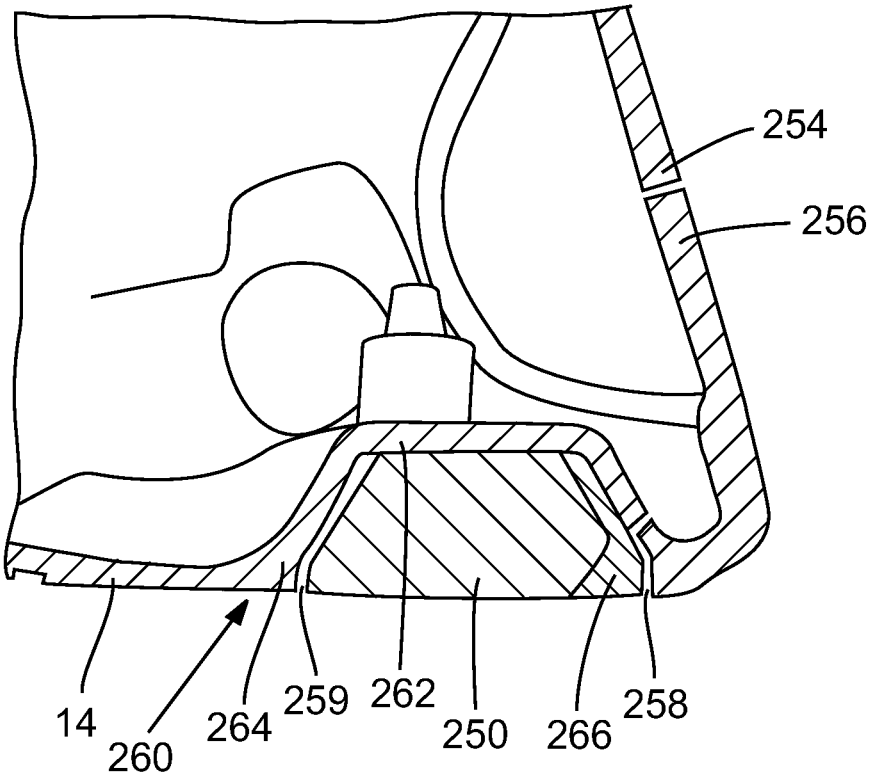
FIG. 18 is a partial side sectional view in elevation of a golf club head showing added weight mechanically attached to the sole, e.g., with threaded fasteners.

As described, desired discretionary mass can be added in the form of a mass pad, such as the mass pad 502 (see FIG. 5) or the mass pads 210*a*, 210*b*, 210*c*, 210*d*, or 210*e*. FIGS. 17 and 18 show examples of different mass pad configurations. In FIG. 17, added mass 250 is secured to the outside of the sole 14 by one or more welds 252 in a mass pad configuration similar to FIG. 12C. The welds 252 create a generally continuous interface between the added mass 250 and the surrounding material of the sole 14. Specifically, the added mass is fitted into a channel 260 formed in the sole 14. In the illustrated implementation, the channel 260 has a cross section with a generally flat base 262 and sloping side surfaces 264, 266. In FIG. 17, it can be seen that the welds 252 have united the added mass 250 with the sole 14 in the area of the sloping side surface 264 and the base 262. Although there is a region along the sloping side surface 266 where no weld material is present, a substantial portion of that side surface closest to the outer side of the sole 14 is united with the added mass 250.

In FIG. 18, the added mass 250 is secured to the outside of the sole by mechanical fasteners, such as using one or more screws 254. As shown in FIG. 18, the screw 254, the tip or distal end of which is visible, has been threaded through an aperture in the added mass 250, through an aperture in the base 262 of the channel 260 and through an attached boss 256 projecting from its inner side. This mechanical mounting of the added mass 250 to the sole 14, although sufficiently secure, does not result in the added mass 250 being united with the sole 14 as a continuous interface. As can be seen, there are gaps 258, 259 between the added mass 250 and the sloping side surfaces 266, 264, respectively. In most cases, it is only the inner side of the added mass 250 and the base 262 against which the added mass 250 is tightened that are in continuous contact. Surprisingly, the flexible boundary provided by one or both of the gaps 258, 259 between the added mass 250 and the sole 14 results in a higher COR: the COR is about 0.819 for the relatively flexible boundary club head of FIG. 18, which is higher than the COR of about 0.810 for the relatively inflexible boundary or continuous interface of FIG. 17. Thus, the gap or gaps between the added mass 250 and the adjacent sloping side surface 264 behave similar to a channel, such as the channels 212*a*, 212*d* and 212*e*, and results in a higher COR. It should be noted that the specific configuration shown in FIG. 18 is just one example that yields a flexible boundary, and that it would be possible to achieve the same desirable results with other configurations that result in attachment of the mass pad to the sole with at least one surface of the mass pad that is not secured to an adjacent portion of the sole.

In alternative embodiments, a mass pad or other high density weight is added to the body of a golf club by co-casting the weight into the golf club head or a component of a club head. For example, a mass pad or other high density weight can be added to a golf club head by co-casting the mass pad with the golf club head. In some embodiments, the mass pad/high density weight is co-casted using a negative draft angle in order to affix or secure the mass pad/high density weight within the club head body. Moreover, in some embodiments, the surface of the mass pad/high density weight is coated with a thermal resistant coating prior to casting. The thermal resistant coating on the surface of the weight acts as a thermal barrier between two dissimilar materials (i.e., the golf club body material and the material of the high density weight), and prevents any reaction between the molten metal of the club head body and the weight material. The coating also promotes adhesion between the molten metal and the weight by improving wetting of the molten metal on the surface of the weight.

For example, as shown in FIGS. 19A-E, a high density weight 250 is provided for co-casting with a body 10 of a golf club head. The weight 250 is formed of a material having a higher density than the material used to form the body 10 of the golf club head. For example, in some embodiments, the weight 250 is formed of a tungsten-containing alloy having a density of from about 8 g/cc to about 19 g/cc. The weight 250 is formed having a negative draft, i.e., at least a portion of the interior region has a larger cross-section or projected area than the area of the exterior region opening. In other embodiments, the weight 250 is formed having a projection, such as a step, a ledge, a shoulder, a tab, or other member that causes the weight 250 to have a cross-section, a projected area, or a portion of the cross-section or projected area that extends outward of the exterior region opening. In the embodiment shown in FIG. 19A, the weight 250 has an interior surface 270 that has a larger projected area than the exterior surface 272, whereby at least one of the sides 274 defines a negative draft angle 276 or taper relative to the normal axis of the weight 250.

Figure 19A:
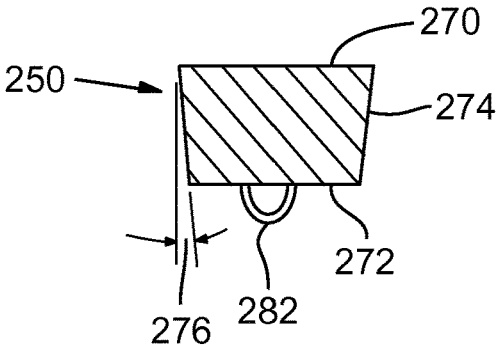
FIG. 19A is a cross-sectional view of a high density weight.
Figure 19B:
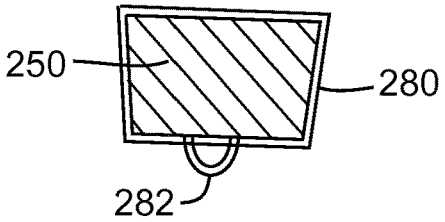
FIG. 19B is a cross-sectional view of the high density weight of FIG. 19A having a thermal resistant coating.
Figure 19C:
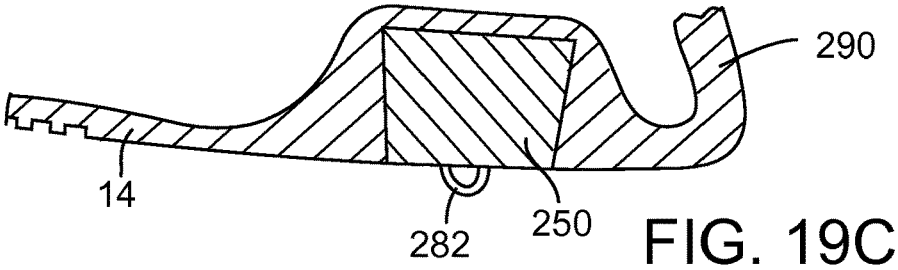
FIG. 19C is a cross-sectional view of the high density weight of FIG. 19A embedded within a wax pattern.

The surface of the high density weight 250 is preferably coated with a thermal resistant coating 280, as shown in FIG. 19B. Depending upon the temperatures to be encountered during the casting process, the coating 280 is preferably one that is capable of providing thermal resistance over temperatures in the range of from about 500° C. to about 1700° C. The coating can contain multiple layers of materials, such as metallic, ceramics, oxides, carbides, graphite, organic, and polymer materials. For example, typical thermal barrier coatings contain up to three layers: a metallic bond coat, a thermally grown oxide, and a ceramic topcoat. The ceramic topcoat is typically composed of yttria-stabilized zirconia (YSZ) which is desirable for having very low conductivity while remaining stable at nominal operating temperatures typically seen in applications. This ceramic layer creates the largest thermal gradient of the thermal resistant coating and keeps the lower layers at a lower temperature than the surface. An example of a suitable ceramic topcoat material is one that contains about 92% zirconium oxide and about 8% yttrium oxide in its outer layer. In the embodiments shown, the thermal resistant coating 280 has a thickness of from about 0.1 mm to about 3.0 mm.

As noted above, the thermal resistant coating 280 provides a thermal barrier that prevents the materials contained in the high density weight 250 (e.g., tungsten, iron, nickel, et al.) from reacting with the materials contained in the club head body 10 (e.g., stainless steel alloys, carbon steel, titanium alloys, aluminum alloys, magnesium alloys, copper alloys, or the like) during the co-casting process. These reactions may cause unwanted gaps or other defects to occur, which gaps or defects are inhibited or prevented by the thermal resistant coating 280. In addition, the thermal coating 280 has been observed to improve the wetting of the surface of the high density weight 250 by the molten metal of the club head body 10 during the co-casting process, thereby also reducing the occurrence of gaps or other defects.

A method of co-casting the high density weight 250 and golf club head 10 will be described with reference to FIGS. 19A-E. Although the method is shown and described in reference to making a golf club head 10 of a metal wood style golf club (e.g., a driver, fairway wood, etc.), the method may also be practiced in the manufacture of an iron, wedge, putter, or other style golf club head. The method may also be adapted for use in the manufacture of other non-golf club related items. Turning first to FIG. 19A, a high density weight 250 is provided with one or more sacrificial handle bars 282. The handle bar 282 is attached to or embedded within the high density weight 250 in a manner that retains the ability to remove the handle bar from the high density weight 250 at a later point in the process, as described more fully below. The high density weight 250 is then coated with a single-layer or multiple-layer thermal resistant coating 280, as shown in FIG. 19B. Depending upon the material used to construct the handle bar 282, the handle bar 282 may also be coated with the thermal resistant coating 280.

Figure 19D:
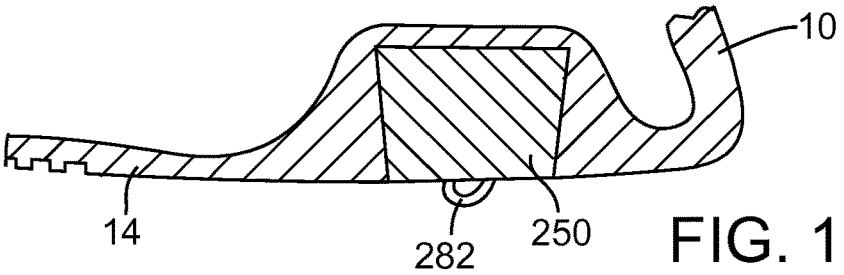
FIG. 19D is a cross-sectional view of the high density weight of FIG. 19A co-cast within a golf club head.
Figure 19E:
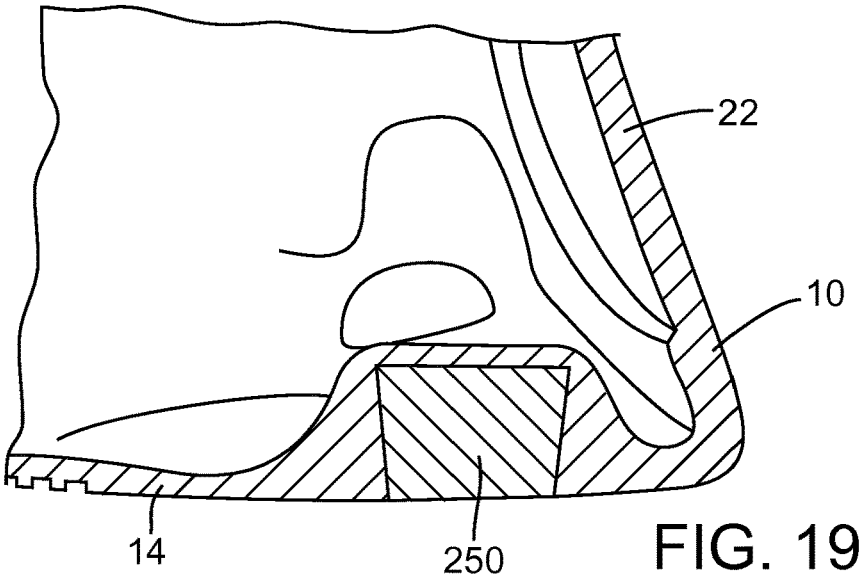
FIG. 19E is a cross-sectional view of the high density weight of FIG. 19A co-cast within a golf club head.

Once coated with the thermal resistant coating 280, the high density weight 250 is embedded in a wax pattern 290 used in an investment casting process. See FIG. 19C. The weight 250 is embedded in the wax pattern 290 in such a way that the handle bar 282 extends outward from the wax pattern 290 and the embedded weight 250. The wax pattern 290 and embedded weight 250 are then used to build a ceramic mold (not shown) in which the handle bar 282 is securely embedded, in a manner known to those skilled in the investment casting art. The wax pattern 290 is then melted out of the ceramic mold in a dewaxing process. The molten metal of the golf club head 10 is then casted into the ceramic mold, where it surrounds the embedded high density weight 250 and solidifies after cooling. The ceramic shell is then removed to release the casted components of the golf club head 10, still including the exposed sacrificial handle bar 282 extending from the high density weight 250, as shown in FIG. 19D. The handle bar 282 is then removed via a cutting and/or polishing process, and the remaining portions of the golf club head 10 are attached according to the specifications described elsewhere herein, resulting in the finished golf club head shown in FIG. 19E.

The foregoing method may be adapted to include multiple high density weights 250 into one golf club head 10 simultaneously. Moreover, in other embodiments, the high density weight 250 is placed in other locations within the mold or golf club head 10. Unlike other methods for installing high density weights or mass pads, there are no density or mechanical property constraints relating to the materials used for the weights, and no welding, deformation, or pressing of the weight(s) is required for installation. Moreover, the shape and size of the co-casted high density weight 250 may be varied to obtain desired results. For example, whereas the high density weight 250 shown in FIGS. 19A-E includes a generally trapezoidal cross-sectional shape, weights that define a negative draft angle over at least a portion of the exterior surface using other alternative (i.e., non-trapezoidal) shapes are also possible.

Characteristic Time

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

Examples 1 and 2

Table 1 summarizes characteristics of two exemplary 3-wood club heads that embody one or more of the above described aspects. In particular, the exemplary club heads achieve desirably low centers of gravity in combination with high mass moments of inertia.

Example 1

Club heads formed according to the Example 1 embodiment are formed largely of an alloy of steel. As indicated by Table 1 and depending on the manufacturing tolerances achieved, the mass of club heads according to Example 1 is between about 210 g and about 220 grams and the Zup dimension is between about 13 mm and about 17 mm. As designed, the mass of the Example 1 design is 216.1 g and the Zup dimension 15.2 mm. The loft is about 16 degrees, the overall club head height is about 38 mm, and the head depth is about 87 mm. The crown is about 0.60 mm thick. The relatively large head depth in combination with a thin and light crown provides significant discretionary mass for redistribution to improve forgiveness and overall playability. For example, the resulting mass moment of inertia about the CG z-axis (Izz) is about 325 kg-mm$^2$.

Example 2

Club heads formed according to the Example 2 embodiment are formed largely of an alloy of titanium. As indicated by Table 1 and depending on the manufacturing tolerances achieved, the mass of club heads according to Example 2 is between about 210 g and about 220 grams and the Zup dimension is between about 13 mm and about 17 mm. As designed, the mass of the Example 2 design is 213.8 g and the Zup dimension 14.8 mm. The loft is about 15 degrees, the overall club head height is about 40.9 mm, and the head depth is about 97.4 mm. The crown is about 0.80 mm thick. The relatively large head depth in combination with a thin and light crown provides significant discretionary mass for redistribution to improve forgiveness and overall playability. For example, the resulting mass moment of inertia about the CG z-axis (Izz) is about 302 kg-mm$^2$.

Overview of Examples 1 and 2

Both of these examples provide improved playability compared to conventional fairway woods, in part by providing desirable combinations of low CG position, e.g., a Zup dimension less than about 16 mm, and high moments of inertia, e.g., $I_{zz}$ greater than about 300 kg-mm$^2$, $I_{xx}$ greater than about 170 kg-mm$^2$, and a shallow head height, e.g., less than about 46 mm. Such examples are possible, in part, because they incorporate an increased head depth, e.g., greater than about 85 mm, in combination with a thinner, lighter crown compared to conventional fairway woods. These features provide significant discretionary mass for achieving desirable characteristics, such as, for example, high moments of inertia and low CG.

TABLE 1

| Exemplary Embodiment | Units | Example 1 | Example 2 |
|---|---|---|---|
| Mass | g | 216.1 | 213.8 |
| Volume | cc | 181.0 | 204.0 |
| CGX | mm | 2.5 | 4.7 |
| CGY | mm | 31.8 | 36.1 |
| CGZ | mm | −3.54 | −4.72 |
| Z Up | mm | 15.2 | 14.8 |
| Loft | ° | 16 | 15 |
| Lie | ° | 58.5 | 58.5 |
| Face Height | mm | 26.3 | 30.6 |
| Head Height | mm | 38 | 40.9 |
| Face Thickness | mm | 2.00 | 2.30 |
| Crown Thickness | mm | 0.60 | 0.80 |
| Sole Thickness | mm | 1.00 | 2.50 |

Example 3

Referring to Table 2, golf club heads with added weight attached mechanically to the sole (e.g., as in FIG. 18) showed higher COR values than golf club heads having added weight attached to the sole by welding (e.g., as in FIG. 17). In Table 2, measurements of COR are given for the center of the club face and at four other locations, each spaced by 7.5 mm from center of the club face along the horizontal and vertical axes.

TABLE 2

| Distance of measurement location from center of club face | COR for club head with mass pad attached to sole by welding | COR for club head with mass pad attached with screws | COR for comparable conventional club head |
|---|---|---|---|
| 0 | 0.81 | 0.82 | 0.79 |
| 7.5 mm toward heel | 0.80 | 0.80 | 0.78 |
| 7.5 mm toward toe | 0.80 | 0.81 | 0.78 |
| 7.5 mm toward crown | 0.79 | 0.79 | 0.79 |
| 7.5 mm toward sole | 0.78 | 0.80 | 0.75 |

For a sample of five parts, the golf club heads having added weight attached by welding showed an average COR of 0.81 and an average characteristic time (CT) of 241 μs. Also for a sample of five parts, the club heads having added weight attached with screws had an average COR of 0.82 and an average CT of 252 μs.

Simulation results confirmed these empirical findings. In simulated results, a golf club head in which the added weight is mechanically attached, resulting in a flexible boundary, yielded a higher COR than a golf club head in which the added weight was welded to the sole without a flexible boundary.

Example A Through J

As noted above, several of the illustrated golf club head designs were modeled using commercially available computer aided modeling software. Table 3 below summarizes characteristics of several exemplary 3-wood club heads that embody one or more of the above described aspects.

TABLE 3

| | Units | Example A | Example B | Example C | Example D | Example E |
|---|---|---|---|---|---|---|
| Mass | g | 214 | 214 | 214 | 216 | 216.3 |
| Volume | cc | 197 | 210 | 184 | 195 | 199 |
| CGX | mm | 4.8 | 2.4 | 2.23 | 4 | 1.3 |
| CGY | mm | 30.1 | 23.8 | 23.3 | 24.0 | 28.6 |
| CGZ | mm | −8.9 | −6.99 | −6.6 | −7.45 | −7.91 |
| Z Up | mm | 12.7 | 14.5 | 14.9 | 14.1 | 13.6 |
| Loft | ° | 16 | 16.8 | 17.3 | 15.4 | 16 |
| Lie | ° | 57.5 | 56.5 | 56.8 | 58.5 | 58 |
| Face Height | mm | 37.9 | 39.4 | 39.4 | 39.4 | 39.4 |
| Head Height | mm | 39.1 | 42.6 | 42.6 | 42.8 | 42.6 |
| Head Depth | mm | 100.9 | 84.8 | 85.5 | 87.4 | 89.0 |
| CG Projection | mm | −0.2 | 0.2 | 0.6 | −0.8 | 0.3 |
| Body Material | | SS | Ti alloy | Ti alloy | Ti alloy | Ti alloy |
| Channel/Slot | | N/A | N/A | N/A | N/A | FIG. 14 |

| | Units | Example F | Example G | Example H | Example I | Example J |
|---|---|---|---|---|---|---|
| Mass | g | 213.5 | 210.2 | 211 | 214.4 | 214.5 |
| Volume | cc | 191.2 | 206.2 | 203 | 192 | 192 |
| CGX | mm | 2.54 | 0.84 | 1.9 | 2.1 | 2.3 |
| CGY | mm | 21.4 | 25.7 | 22.3 | 21.8 | 21.7 |
| CGZ | mm | −5.4 | −7.29 | −7.6 | −5.52 | −5.79 |
| Z Up | mm | 16.1 | 14.2 | 13.9 | 16 | 15.7 |
| Loft | ° | 16 | 16 | 16 | 16 | 16 |
| Lie | ° | 58 | 58 | 58 | 58 | 58 |
| Face Height | mm | 39.4 | 39.4 | 39.4 | 39.4 | 39.4 |
| Head Height | mm | 42.8 | 42.8 | 42.8 | 42.6 | 42.6 |
| Head Depth | mm | 87.3 | 93.1 | 93.1 | 89.3 | 89.3 |
| CG Projection | mm | 0.7 | 0.1 | −1.2 | 0.7 | 0.4 |
| Body Material | | Steel | Ti alloy | Ti alloy | SS | SS |
| Channel/Slot | | FIG. 13 | FIG. 14 | FIG. 15 | FIG. 16B | FIG. 16B |

Figure 20B:
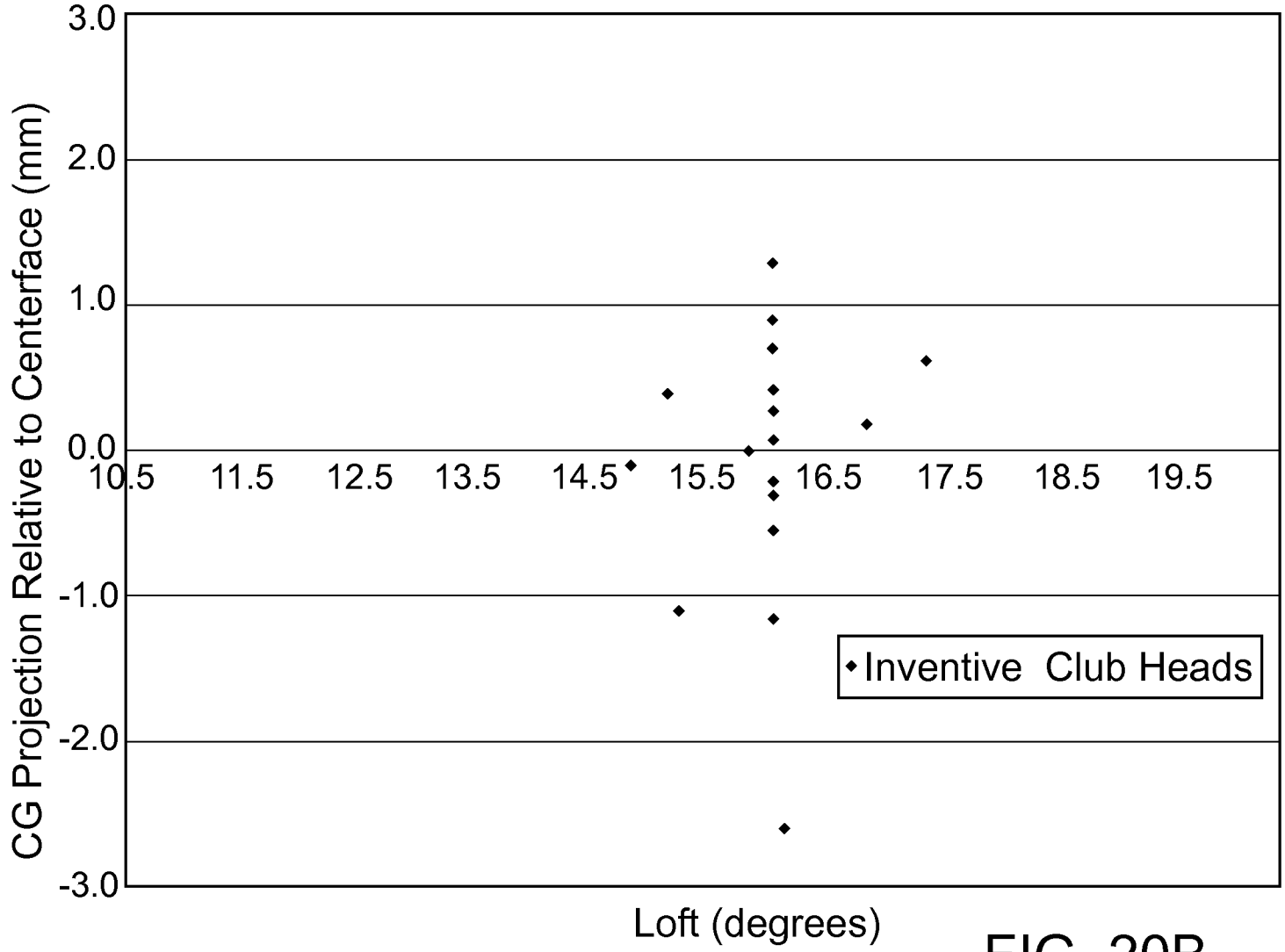
FIG. 20B is a plot of the a club head's center of gravity projection, measured in distance above the center of its face plate, versus the loft angle of the club head for several embodiments of the golf club heads described herein.

As shown in Table 3, Examples A through D describe embodiments of club heads that do not include a slot or channel formed in the sole of the club head. Examples E through J, on the other hand, each include a slot or channel of one of the types described above in relation to FIGS. 13-16. Each of these exemplary club heads is included in the plot shown in FIG. 20B, which shows relationships between the club head CG projection and the static loft of the inventive golf club heads described herein.

Example K Through T

Several golf club head were constructed and analyzed. Table 4 below summarizes characteristics of several exemplary 3-wood club heads that embody one or more of the above described aspects.

TABLE 4

| | Units | Example K | Example L | Example M | Example N |
|---|---|---|---|---|---|
| Mass | g | 214.4 | 214.3 | 216.0 | 211.8 |
| Volume | cc | 193.8 | 193.8 | 191.4 | |

TABLE 4-continued

| | | | | | |
|---|---|---|---|---|---|
| CGX | mm | 2.3 | 3.0 | 0.5 | 2.1 |
| CGY | mm | 22.1 | 22.1 | 29.7 | 25.8 |
| CGZ | mm | −5.4 | −5.0 | −8.0 | −7.7 |
| Z Up | mm | 16.2 | 16.6 | 13.6 | 13.9 |
| Loft | ° | 16 | 16 | 14.8 | 16 |
| Lie | ° | 58 | 58 | 58 | 58 |
| Face Height | mm | 35.2 | 35.2 | 36.0 | |
| Head Height | mm | 43 | 43 | 42.5 | |
| Head Depth | mm | 91.4 | 91.4 | 91.2 | |
| CG Projection | mm | 0.9 | 1.3 | −0.1 | −0.3 |
| Body Material | | SS | SS | Ti Alloy | Ti Alloy |
| Channel/Slot | | FIG. 16B | FIG. 16B | FIG. 14 | FIG. 14 |

| | Units | Example O | Example P | Example Q | Example R |
|---|---|---|---|---|---|
| Mass | g | 210.9 | 214.4 | 216.2 | 220.1 |
| Volume | cc | | | 187.3 | 186.5 |
| CGX | mm | −0.6 | 0.2 | −1.5 | −0.2 |
| CGY | mm | 21.9 | 23.3 | 27.7 | 26.1 |
| CGZ | mm | −7.1 | −5.9 | −7.8 | −10.2 |
| Z Up | mm | 13.4 | 14.3 | 15.2 | 13.5 |
| Loft | ° | 15.2 | 15.1 | 15.8 | 16.1 |
| Lie | ° | 58 | 58 | 57.5 | 59 |
| Face Height | mm | 36.2 | | 34.1 | 35.9 |
| Head Height | mm | 42.7 | | 41.9 | 42.0 |
| Head Depth | mm | 95.9 | | 91.3 | 92.4 |
| CG Projection | mm | −1.1 | 0.4 | 0.0 | −2.6 |
| Body Material | | Ti Alloy | Ti Alloy | Ti Alloy | Ti Alloy |
| Channel/Slot | | FIG. 15 | FIG. 15 | FIG. 17 | FIG. 17 |

As shown in Table 4, each of Examples K through T includes a slot or channel of one of the types described above in relation to FIGS. 14-17. Each of these exemplary club heads is included in the plot shown in FIG. 20B, which shows relationships between the club head CG projection and the static loft of the inventive golf club heads described herein.

Sole Channel

The following study illustrates the effect of forming a channel in the sole near or adjacent to the face of a fairway wood golf club. Two golf club heads having the general design shown in FIG. 12A were constructed. The body portions of the club heads were formed primarily of stainless steel (custom 450SS). The center face characteristic time (CT) and balance point coefficient of restitution (COR) were measured on each of the two heads. The channel of each of the club heads were then filled with DP420 epoxy adhesive (3M Corp.) and the same CT and COR measurements were repeated. Each head was measured three times before and three times after the epoxy adhesive was introduced into the channel. The measurements are shown below in Table 5:

TABLE 5

| | Measurements w/o Epoxy | | | | | Measurements with Epoxy | | | | | Change | |
|---|---|---|---|---|---|---|---|---|---|---|---|---|
| Head ID | Mass (g) | | CT | | COR | Mass (g) | | CT | | COR | CT | COR |
| 44300 | 210 | 1 | 228 | 227 | 0.810 | 210 | 1 | 221 | 219 | 0.805 | −8 | −0.005 |
| | | 2 | 226 | | | | 2 | 219 | | | | |
| | | 3 | 228 | | | | 3 | 218 | | | | |
| 44301 | 209.4 | 1 | 235 | 233 | 0.808 | 209.4 | 1 | 224 | 223 | 0.803 | −10 | −0.005 |
| | | 2 | 232 | | | | 2 | 223 | | | | |
| | | 3 | 232 | | | | 3 | 222 | | | | |

From the information presented in Table 5 it is seen that the unfilled channel produces a COR that is 0.005 higher than the filled channel for both heads tested. Note that the mass was kept constant by placing lead tape on the sole of the heads when tested before the epoxy adhesive was introduced into the channel.

The epoxy adhesive is not a perfectly rigid material. For example, the modulus of elasticity of the DP420 epoxy adhesive is approximately 2.3 GPa, as compared to the modulus of elasticity of the stainless steel (Custom 450SS), which is approximately 193 GPa. As a result, the filled channel is still able to deflect during ball impact. This suggests that the increase in CT and COR due to the presence of the channel on the sole of the club head is even greater than illustrated by the data contained in Table 5.

Sole Slot

The following study illustrates the effect of forming a curved slot in the sole near or adjacent to the face of a fairway wood golf club. A Burner Superfast 2.0 fairway wood (3-) 15° was used in the study. Five club heads were measured for center face characteristic time (CT) and balance point coefficient of restitution (COR) both before and after machining a curved slot in the sole having the general design shown in FIGS. 15A-B. The results of the measurements are reported in Table 6 below:

TABLE 6

| Head | Before Slot | | After Slot | | | |
|---|---|---|---|---|---|---|
| ID | CT | COR | CT | Change | COR | Change |
| 43303 | 195 | 0.787 | 218 | 23 | 0.802 | 0.015 |
| 43563 | 193 | 0.791 | 211 | 18 | 0.801 | 0.010 |
| 43678 | 192 | 0.792 | 214 | 22 | 0.800 | 0.008 |
| 46193 | 194 | 0.792 | 217 | 23 | 0.804 | 0.012 |
| 46194 | 196 | 0.793 | 219 | 23 | 0.802 | 0.009 |
| Average | 194 | 0.791 | 216 | 22 | 0.802 | 0.011 |

From the information presented in Table 6 it is seen that the club heads had an average CT increase of 22 and an average COR increase of 0.011 after forming a curved slot in the sole of the club head. The slotted club heads proved to be durable after being submitted to endurance testing.

Additional COR testing was performed on Head ID 43563 from Table 6. The testing included measuring COR at several locations on the striking face of the club head. The results are shown below in table 7.

TABLE 7

| | Measured COR | | |
|---|---|---|---|
| Face Location | Before Slot | After Slot | Change |
| Balance Point | 0.791 | 0.800 | 0.015 |
| 10 mm sole | 0.765 | 0.782 | 0.017 |
| 10 mm toe | 0.769 | 0.775 | 0.006 |
| 10 mm heel | 0.767 | 0.766 | −0.001 |
| 5 mm crown | 0.783 | 0.788 | 0.005 |
| AVERAGE | 0.775 | 0.782 | 0.007 |

From the information presented in Table 7 it is seen that there was an average COR increase of 0.007 for the locations measured. The most significant increase of 0.017 COR points was at the low face location. This location is the nearest to the slot formed in the sole of the club head, and is therefore most influenced by the increased flexibility at the boundary condition of the bottom of the face.

Comparison of Slot, Channel, and No Slot/No Channel Clubs

The following study provides a comparison of the performance of three golf club heads having very similar properties, with one of the clubs having a channel formed in the sole (e.g., the design shown in FIG. 13A-H), a second having a slot formed in the sole (e.g., the design shown in FIG. 16B), and a third having no slot or channel. The club heads were constructed of stainless steel (custom 450SS). The COR measurements for the three club heads are shown below in Table 8:

TABLE 8

| COR | Measured COR (change from No Slot/ Channel in brackets) | | | | |
|---|---|---|---|---|---|
| Measurement Location | No Slot/ No Channel | Channel | | Slot | |
| Balance Point | 0.799 | 0.812 | [0.013] | 0.803 | [0.004] |
| Center Face | 0.798 | 0.811 | [0.013] | 0.806 | [0.008] |
| 0, 7.5 mm heel | 0.792 | 0.808 | [0.016] | 0.796 | [0.004] |
| 0, 7.5 mm toe | 0.775 | 0.776 | [0.001] | 0.776 | [0.001] |
| 0, 7.5 mm sole | 0.772 | 0.788 | [0.016] | 0.793 | [0.021] |
| 0, 7.5 mm crown | 0.770 | 0.775 | [0.005] | 0.759 | [−0.011] |
| AVERAGE | 0.784 | 0.795 | [0.011] | 0.789 | [0.005] |
| Face thickness | 1.90 mm | 2.05 mm | | 2.00 mm | |

As noted in Table 8, the face thickness of the sample club heads were different, with the channel sole having the thickest face and the regular (no slot, no channel) sole having the thinnest face. It would be expected that the thicker face of the club heads having a channel and a slot (relative to the no slot/no channel sole) would tend to cause the measured COR to decrease relative to the measured COR of the No Slot/No Channel sole. Accordingly, the data presented in Table 8 supports the conclusion that the channel and slot features formed in the identified club heads provide additional sole flexibility leading to an increase in the COR of the club head.

Player Testing

Player testing was conducted to compare the performance of the inventive golf clubs to a current, commercially available golf club. Golf clubs according to Examples K and L were constructed and compared to a TaylorMade Burner Superfast 2.0 golf club. The head properties of these three golf clubs are presented in Table 9 below.

TABLE 9

| | Units | Burner Superfast 2.0 | Example K | Example L |
|---|---|---|---|---|
| Mass | g | 212.0 | 214.4 | 214.3 |
| Volume | cc | 194.1 | 193.8 | 193.8 |
| Delta 1 | mm | −12.2 | −8.9 | −8.9 |
| Delta 2 | mm | 30.8 | 30.0 | 29.6 |
| Delta 3 | mm | 60.0 | 56.6 | 55.9 |
| CGX | mm | 1.4 | 2.3 | 3.0 |
| CGY | mm | 27.1 | 22.1 | 22.1 |
| CGZ | mm | −4.1 | −5.4 | −5.0 |
| Z Up | mm | 17.0 | 16.2 | 16.6 |
| Loft | ° | 15.8 | 16 | 16 |
| Lie | ° | 58 | 58 | 58 |
| Face Height | mm | 34.4 | 35.2 | 35.2 |
| Head Height | mm | 42.5 | 43 | 43 |
| Head Depth | mm | 93.1 | 91.4 | 91.4 |
| CG Projection | mm | 3.4 | 0.9 | 1.3 |
| Body Material | | SS | SS | SS |
| Channel/Slot | | N/A | FIG. 16B | FIG. 16B |

The information in Table 9 shows that the Example K and L clubs include a CG that is located significantly lower and forward in relation to the CG location of the Burner Superfast 2.0 golf club, thereby providing a CG projection that is significantly lower on the club face. The static loft of the inventive club heads are approximately equal to that of the Burner Superfast 2.0 comparison club. Accordingly, changes in the spin and launch angle would be associated with differences in dynamic loft, which is verifiable by player testing.

Head-to-head player tests were conducted to compare the performance of the Burner Superfast 2.0 to the two inventive clubs listed in Table 9. The testing showed that the inventive golf clubs (Examples K and L) provided significantly more distance (carry and total), less backspin, a lower peak trajectory, and higher initial ball speed relative to the Burner Superfast 2.0 fairway wood. All clubs had comparable initial launch angles, and both of the inventive golf clubs (Examples K and L) appeared to generate the same initial ball speed. In both tests, the Example K club head produced approximately 380 rpm less backspin, had more carry, and had more roll out distance than the Example L club head.

Figure 23:
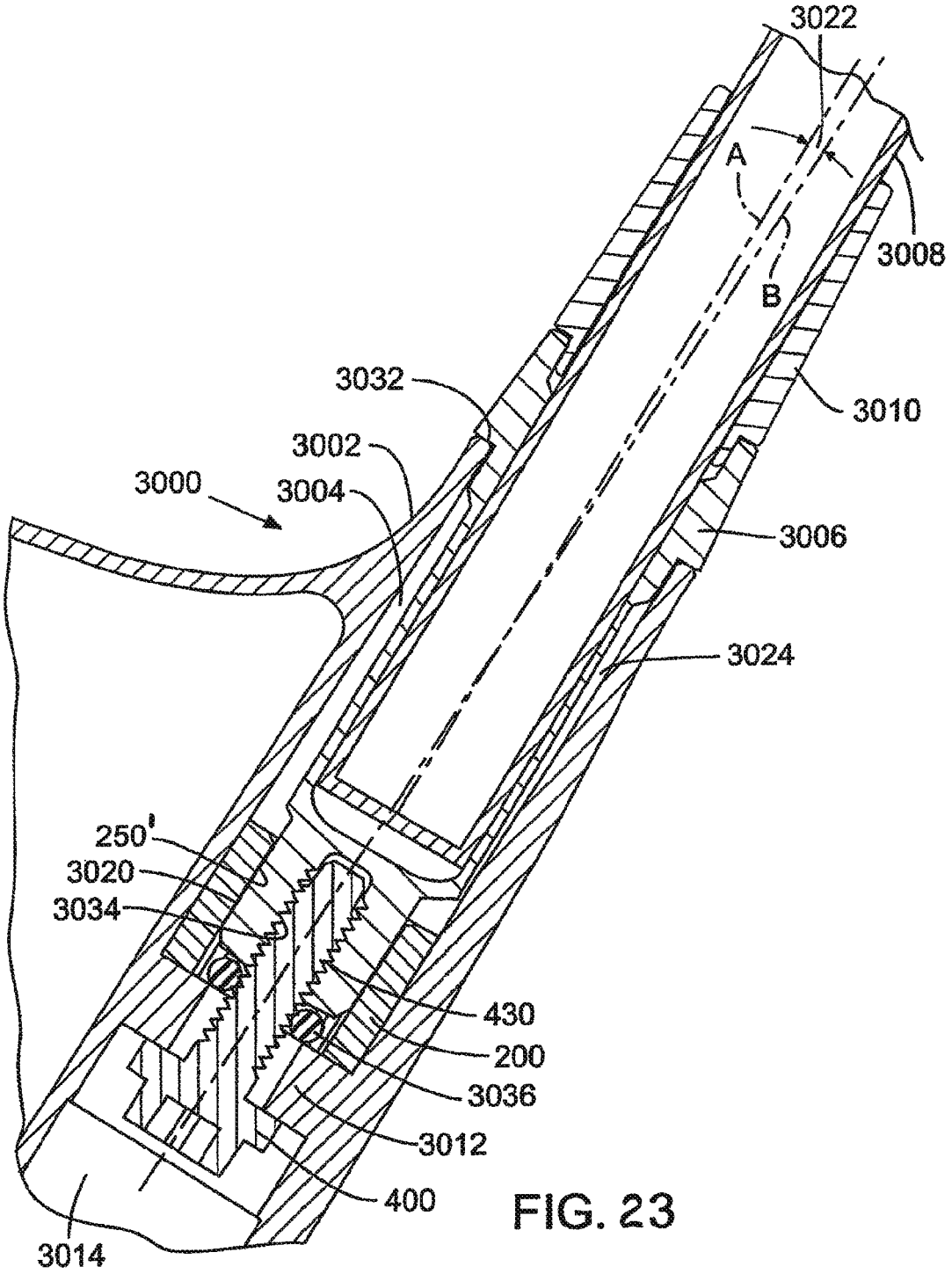
FIG. 23 is an enlarged cross-sectional view of a golf club head having a removable shaft, in accordance with another embodiment.

FIG. 23 shows another embodiment of a golf club assembly that has a removable shaft that can be supported at various positions relative to the head to vary the shaft loft and/or the lie angle of the club. The assembly comprises a club head 3000 having a hosel 3002 defining a hosel opening

3004. The hosel opening 3004 is dimensioned to receive a shaft sleeve 3006, which in turn is secured to the lower end portion of a shaft 3008. The shaft sleeve 3006 can be adhesively bonded, welded or secured in equivalent fashion to the lower end portion of the shaft 3008. In other embodiments, the shaft sleeve 3006 can be integrally formed with the shaft 3008. As shown, a ferrule 3010 can be disposed on the shaft just above the shaft sleeve 3006 to provide a transition piece between the shaft sleeve and the outer surface of the shaft 3008.

The hosel opening 3004 is also adapted to receive a hosel insert 200 (described in detail above), which can be positioned on an annular shoulder 3012 inside the club head. The hosel insert 200 can be secured in place by welding, an adhesive, or other suitable techniques. Alternatively, the insert can be integrally formed in the hosel opening. The club head 3000 further includes an opening 3014 in the bottom or sole of the club head that is sized to receive a screw 400. The screw 400 is inserted into the opening 3014, through the opening in shoulder 3012, and is tightened into the shaft sleeve 3006 to secure the shaft to the club head. The shaft sleeve 3006 is configured to support the shaft at different positions relative to the club head to achieve a desired shaft loft and/or lie angle.

Figure 24:
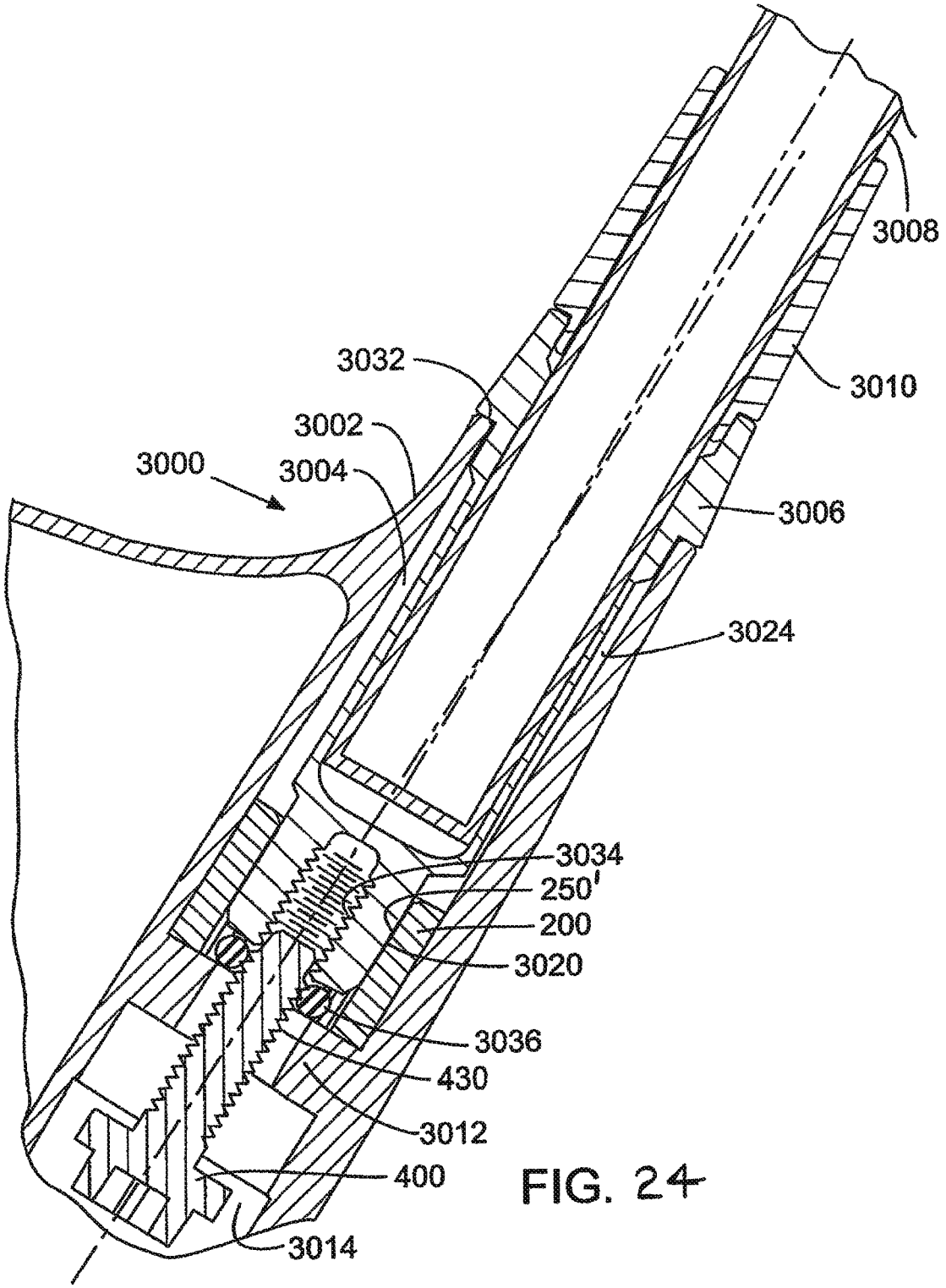
FIG. 24 shows the golf club head of FIG. 23 with the screw loosened to permit removal of the shaft from the club head.
Figure 25:
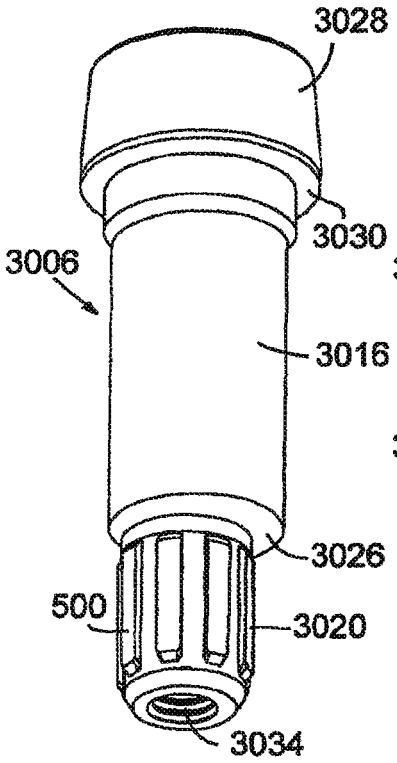
FIG. 25 is a perspective view of the shaft sleeve of the assembly shown in FIG. 23.
Figure 26:
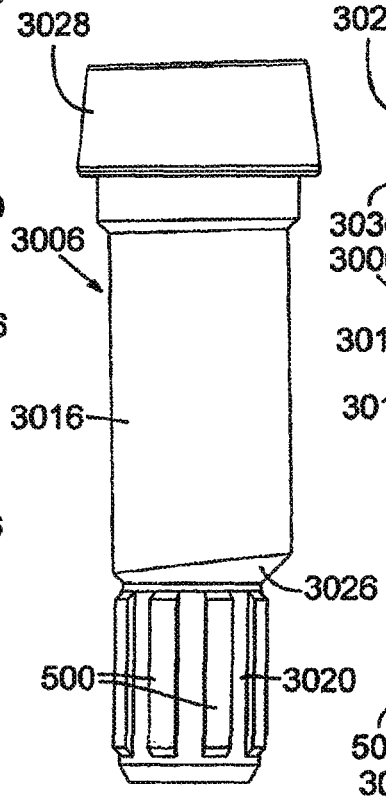
FIG. 26 is a side elevation view of the shaft sleeve of FIG. 25.

If desired, a screw capturing device, such as in the form of an o-ring or washer 3036, can be placed on the shaft of the screw 400 above shoulder 3012 to retain the screw in place within the club head when the screw is loosened to permit removal of the shaft from the club head. The ring 3036 desirably is dimensioned to frictionally engage the threads of the screw and has an outer diameter that is greater than the central opening in shoulder 3012 so that the ring 3036 cannot fall through the opening. When the screw 400 is tightened to secure the shaft to the club head, as depicted in FIG. 23, the ring 3036 desirably is not compressed between the shoulder 3012 and the adjacent lower surface of the shaft sleeve 3006. FIG. 24 shows the screw 400 removed from the shaft sleeve 3006 to permit removal of the shaft from the club head. As shown, in the disassembled state, the ring 3036 captures the distal end of the screw to retain the screw within the club head to prevent loss of the screw. The ring 3036 desirably comprises a polymeric or elastomeric material, such as rubber, Viton, Neoprene, silicone, or similar materials. The ring 3036 can be an o-ring having a circular cross-sectional shape as depicted in the illustrated embodiment. Alternatively, the ring 3036 can be a flat washer having a square or rectangular cross-sectional shape. In other embodiments, the ring 3036 can have various other cross-sectional profiles.

The shaft sleeve 3006 is shown in greater detail in FIGS. 25-28. The shaft sleeve 3006 in the illustrated embodiment comprises an upper portion 3016 having an upper opening 3018 for receiving and a lower portion 3020 located below the lower end of the shaft. The lower portion 3020 can have a threaded opening 3034 for receiving the threaded shaft of the screw 400. The lower portion 3020 of the sleeve can comprise a rotation prevention portion configured to mate with a rotation prevention portion of the hosel insert 200 to restrict relative rotation between the shaft and the club head. As shown, the rotation prevention portion can comprise a plurality of longitudinally extending external splines 500 that are adapted to mate with corresponding internal splines 240 of the hosel insert 200. The lower portion 3020 and the external splines 500 formed thereon can have the same configuration as the shaft lower portion and splines 500.

The upper portion 3016 of the sleeve extends at an offset angle 3022 relative to the lower portion 3020. As shown in FIG. 23, when inserted in the club head, the lower portion 3020 is co-axially aligned with the hosel insert 200 and the hosel opening 3004, which collectively define a longitudinal axis B. The upper portion 3016 of the shaft sleeve 3006 defines a longitudinal axis A and is effective to support the shaft 3008 along axis A, which is offset from longitudinal axis B by offset angle 3022. Inserting the shaft sleeve at different angular positions relative to the hosel insert is effective to adjust the shaft loft and/or the lie angle, as further described below.

Figure 28:
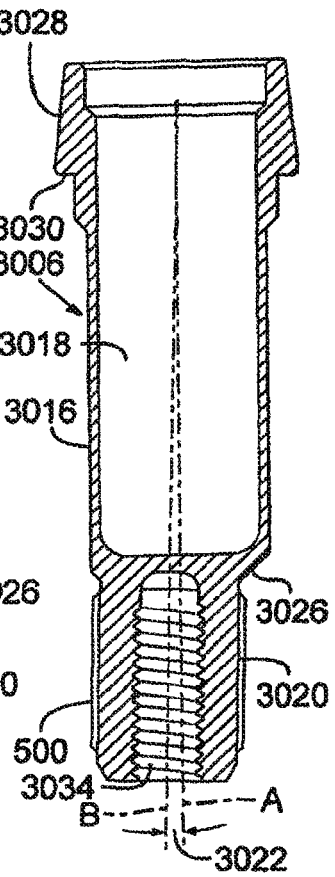
FIG. 28 is a cross-sectional view of the shaft sleeve taken along line 28-28 of FIG. 27.
Figure 27:
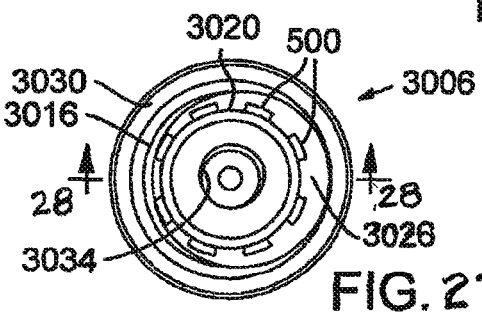
FIG. 27 is a bottom plan view of the shaft sleeve of FIG. 25.

As best shown in FIG. 28, the upper portion 3016 of the shaft sleeve desirably has a constant wall thickness from the lower end of opening 3018 to the upper end of the shaft sleeve. A tapered surface portion 3026 extends between the upper portion 3016 and the lower portion 3020. The upper portion 3016 of the shaft sleeve has an enlarged head portion 3028 that defines an annular bearing surface 3030 that contacts an upper surface 3032 of the hosel 3002 (FIG. 23). The bearing surface 3030 desirably is oriented at a 90-degree angle with respect to longitudinal axis B so that when the shaft sleeve is inserted in to the hosel, the bearing surface 3030 can make complete contact with the opposing surface 3032 of the hosel through 360 degrees.

As further shown in FIG. 23, the hosel opening 3004 desirably is dimensioned to form a gap 3024 between the outer surface of the upper portion 3016 of the sleeve and the opposing internal surface of the club head. Because the upper portion 3016 is not co-axially aligned with the surrounding inner surface of the hosel opening, the gap 3024 desirably is large enough to permit the shaft sleeve to be inserted into the hosel opening with the lower portion extending into the hosel insert at each possible angular position relative to longitudinal axis B. For example, in the illustrated embodiment, the shaft sleeve has eight external splines 500 that are received between eight internal splines 240 of the hosel insert 200. This allows the sleeve to be positioned within the hosel insert at two positions spaced 180 degrees from each other, as previously described.

Figure 29:
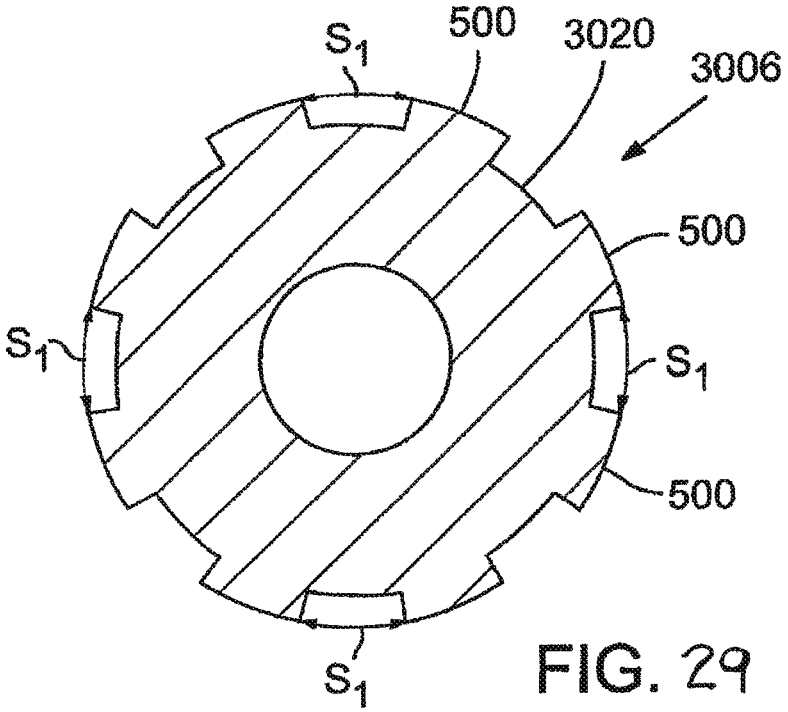
FIG. 29 is a cross-sectional view of another embodiment of a shaft sleeve.
Figure 30:
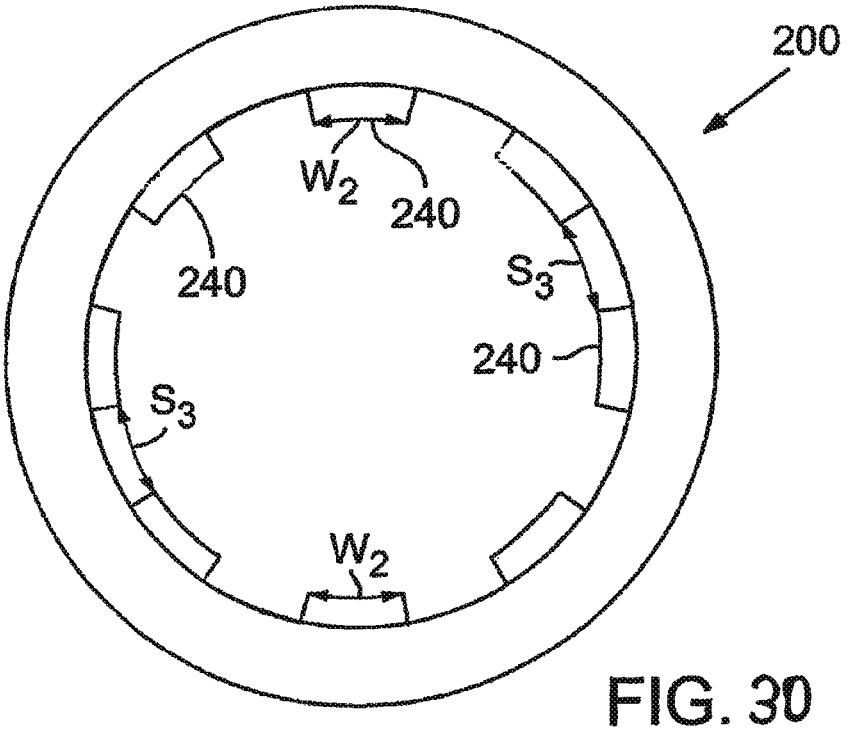
FIG. 30 is a top plan view of a hosel insert that is adapted to receive the shaft sleeve.

Other shaft sleeve and hosel insert configurations can be used to vary the number of possible angular positions for the shaft sleeve relative to the longitudinal axis B. FIGS. 29 and 30, for example, show an alternative shaft sleeve and hosel insert configuration in which the shaft sleeve 3006 has eight equally spaced splines 500 with radial sidewalls 502 that are received between eight equally spaced splines 240 of the hosel insert 200. Each spline 500 is spaced from an adjacent spline by spacing Si dimensioned to receive a spline 240 of the hosel insert having a width W2. This allows the lower portion 3020 of the shaft sleeve to be inserted into the hosel insert 200 at eight angularly spaced positions around longitudinal axis B. In a specific embodiment, the spacing Si is about 23 degrees, the arc angle of each spline 500 is about 22 degrees, and the width W2 is about 22.5 degrees.

As can be appreciated, the assembly shown in FIGS. 23-30 permits a shaft to be supported at different orientations relative to the club head to vary the shaft loft and/or lie angle. An advantage of the assembly of FIGS. 23-30 is that it includes less pieces and therefore is less expensive to manufacture and has less mass (which allows for a reduction in overall weight).

Whereas this technology has been described in connection with representative embodiments, it will be understood that it is not limited to those embodiments. On the contrary, it is intended to encompass all alternatives, modifications, combinations, and equivalents as may be included within the spirit and scope of the disclosure as defined by the appended claims.

The invention claimed is:

1. A golf club, comprising:

a club head defining an interior cavity, a sole defining a bottom portion of the club head, a crown defining a top portion of the club head, a skirt portion defining a periphery of the club head between the sole and crown, a face defining a forward portion of the club head and including a striking surface width ($W_{ss}$), and a hosel defining a hosel bore;

a golf club shaft having a lower end portion;

a mass pad located on the sole within the interior cavity and positioned proximate the face in a forward portion of the sole, the mass pad extending substantially in a heel-to-toe direction;

a lower opening positioned in the sole of the club head and extending into the interior cavity of a club head, the lower opening being located proximate a bottom end of the hosel such that a passage in the bottom end of the hosel provides communication between the hosel bore and the lower opening;

a sleeve mounted on the lower end portion of the golf club shaft and adapted to be inserted into the hosel bore; and a fastener having a head portion and a shaft portion, the shaft portion of the fastener extending through the passage, the sleeve being selectively attachable to the shaft portion of the fastener when the sleeve is inserted into the hosel bore;

wherein selectively attaching the sleeve adjusts at least one of a loft angle and a lie angle of the club head;

wherein the club head has a coefficient of restitution (COR) having a value of at least 0.80 as measured at a geometric center of the club face;

wherein the club head has a balance point located on the face and the balance point is no more than 3 mm above of the geometric center of the face;

wherein the club head has a center of gravity located no more than 30 mm horizontally rearward of the geometric center of the face, the coefficient of restitution (COR) of no less than 0.80 as measured at the balance point on the face, and a characteristic time measured at the geometric center of the face of no less than 218 microseconds; and wherein the club head has a height less than 46 mm and a volume less than 210 $cm^3$.

2. The golf club of claim 1, wherein a distance between forwardmost and rearwardmost points on the club head measured along an axis parallel to the y-axis when the club head is at normal address position is greater than 75 mm.

3. The golf club of claim 1, further comprising:

one or more weight ports formed in the club head; and at least one weight configured to be retained at least partially within one of the one or more weight ports.

4. The golf club of claim 1, wherein at least one of the one or more weight ports formed in the club head is formed in the mass pad.

5. The golf club of claim 1, further comprising:

two or more weight ports formed in the club head; and at least one weight configured to be retained at least partially within at least one of the two or more weight ports.

6. The golf club of claim 1, further comprising:

a gap defined in the sole adjacent the face and extending into the interior cavity of the club head and extending generally in a heel-to-toe direction; wherein a portion of the sole being located between the face and the gap, and the mass pad being located rearward of the gap.

7. The golf club of claim 6, wherein the gap is a slot having a gap width (Wg) from about 1 mm to about 5 mm, and the gap width is defined as the distance between a forward edge of the gap and a rearward edge of the gap.

8. The golf club of claim 6, wherein the gap is a channel having a gap width (Wg) from about 3 mm to about 11 mm, and the gap width is defined as the distance between a forward edge of the gap and a rearward edge of the gap.

9. The golf club of claim 1, wherein the club head has an above ground center-of-gravity location, Zup, less than about 19.0 mm.

10. The golf club of claim 9, wherein the coefficient of restitution of the club head measured at the geometric center of the face is 0.81 or greater.

11. The golf club of claim 9, further comprising:

one or more weight ports formed in the club head; and at least one weight configured to be retained at least partially within one of the one or more weight ports.

12. The golf club of claim 11, wherein a distance between forwardmost and rearwardmost points on the club head measured along an axis parallel to the y-axis when the club head is at normal address position is greater than 75 mm.

13. The golf club of claim 11, wherein the at least one weight is removably engageable with the one or more weight ports.

14. The golf club of claim 13, wherein the at least one weight is configured to threadedly engage the one or more weight ports.

15. The golf club of claim 14, wherein the at least one weight varies in mass from about 0.5 gram to about 20 grams.

16. The golf club of claim 15, wherein the club head is formed of at least a combination of at least one alloy of steel and a graphitic composite.

17. The golf club of claim 15, wherein the club head is formed of at least a combination of at least one alloy of titanium and a graphitic composite.

18. A golf club, comprising:

a club head defining an interior cavity, a sole defining a bottom portion of the club head, a crown defining a top portion of the club head, a skirt portion defining a periphery of the club head between the sole and crown, a face defining a forward portion of the club head and including a striking surface width ($W_{ss}$), and a hosel defining a hosel bore;

a golf club shaft having a lower end portion;

a mass pad located on the sole within the interior cavity and positioned proximate the face in a forward portion of the sole, the mass pad extending substantially in a heel-to-toe direction;

one or more weight ports formed in the club head and at least one weight removably engageable with the one of the one or more weight ports;

a lower opening positioned in the sole of the club head and extending into the interior cavity of a club head, the lower opening being located proximate a bottom end of the hosel such that a passage in the bottom end of the hosel provides communication between the hosel bore and the lower opening;

a sleeve mounted on the lower end portion of the golf club shaft and adapted to be inserted into the hosel bore; and a fastener having a head portion and a shaft portion, the shaft portion of the fastener extending through the passage, the sleeve being selectively attachable to the shaft portion of the fastener when the sleeve is inserted into the hosel bore;

wherein selectively attaching the sleeve adjusts at least one of a loft angle and a lie angle of the club head;

wherein the club head has a coefficient of restitution (COR) having a value of at least 0.80 as measured at a geometric center of the club face;

wherein the club head has an above ground center-of-gravity location, Zup, less than about 19.0 mm;

wherein the at least one weight is configured to threadedly engage the one or more weight ports;

wherein the club head has a balance point located on the face and the balance point is no more than 3 mm above of the geometric center of the face;

wherein the club head has a center of gravity located no more than 30 mm horizontally rearward of the geometric center of the face, the coefficient of restitution (COR) of no less than 0.80 as measured at the balance point on the face, and a characteristic time measured at the geometric center of the face of no less than 218 microseconds; and wherein the club head has a height less than 46 mm and a volume less than 210 $cm^3$.

19. The golf club of claim 18, wherein the club head is formed of at least a combination of at least one metal alloy and a graphitic composite.

* * * * *